US011047201B1

(12) United States Patent
Wilson et al.

(10) Patent No.: US 11,047,201 B1
(45) Date of Patent: Jun. 29, 2021

(54) DOWNHOLE LANDING ASSEMBLIES

(71) Applicants: Paul James Wilson, Cypress, TX (US); Robert Bradley Cook, Mandeville, LA (US); Daniel Teen, Mandeville, LA (US); Glenn Mitchel Walls, Madisonville, TX (US)

(72) Inventors: Paul James Wilson, Cypress, TX (US); Robert Bradley Cook, Mandeville, LA (US); Daniel Teen, Mandeville, LA (US); Glenn Mitchel Walls, Madisonville, TX (US)

( * ) Notice: Subject to any disclaimer, the term of this patent is extended or adjusted under 35 U.S.C. 154(b) by 0 days.

(21) Appl. No.: 16/744,485

(22) Filed: Jan. 16, 2020

Related U.S. Application Data

(63) Continuation-in-part of application No. 16/188,269, filed on Nov. 12, 2018, now Pat. No. 10,711,552.

(51) Int. Cl.
*E21B 33/12* (2006.01)
*E21B 34/10* (2006.01)

(52) U.S. Cl.
CPC ..... *E21B 33/12* (2013.01); *E21B 34/10* (2013.01); *E21B 2200/06* (2020.05)

(58) Field of Classification Search
CPC ..... E21B 27/04
See application file for complete search history.

(56) References Cited

U.S. PATENT DOCUMENTS 3,856,081 A * 12/1974 Canalizo ..... E21B 23/02 166/123
4,497,371 A * 2/1985 Lindsey, Jr. ..... E21B 17/06 166/208
6,012,527 A * 1/2000 Nitis ..... E21B 7/061 166/313

* cited by examiner

*Primary Examiner* — William D Hutton, Jr.
*Assistant Examiner* — Avi T Skaist
(74) *Attorney, Agent, or Firm* — Elliott Law PLLC; Douglas H. Elliott; Nathan Q. Huynh

(57) ABSTRACT

Disclosed herein are downhole landing assemblies including a downhole landing assembly for an oil or gas well, downhole landing assembly may include: an upper seat cylinder capable of being coupled to an upper portion of a tubular string; a lower seat cylinder capable of being coupled to a lower portion of the tubular string, wherein the lower seat cylinder may be coupled to the upper seat cylinder; a landing seat coupled to the lower seat cylinder, the landing seat may have two inner surfaces; and a landing mandrel having two outer surfaces, wherein one outer surface of the two outer surfaces may be capable of being abutted against one inner surface of the two inner surfaces.

22 Claims, 40 Drawing Sheets

DOWNHOLE LANDING ASSEMBLIES

CROSS REFERENCE TO RELATED APPLICATIONS

This application is a continuation-in-part of and claims benefit to U.S. Nonprovisional application Ser. No. 16/188,269, filed on Nov. 12, 2018; and this application hereby incorporates herein U.S. Nonprovisional application Ser. No. 16/188,269 as if set forth herein in its entirety.

BACKGROUND

1. Field of Inventions

The field of this application and any resulting patent is downhole landing assemblies.

2. DESCRIPTION OF RELATED ART

Various downhole landing assemblies and methods for positioning and coupling downhole tools to downhole tubular strings have been proposed and utilized, including some of the methods and structures disclosed in some of the references appearing on the face of this application. However, those methods and structures lack the combination of steps and/or features of the methods and/or structures disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder, the landing seat having two inner surfaces; and a landing mandrel having two outer surfaces, wherein one outer surface of the two outer surfaces may be capable of being abutted against one inner surface of the two inner surfaces.

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder; a protrusion protruding from the landing seat; and a landing mandrel for landing on the landing seat, the landing mandrel having a mandrel groove capable of receiving the protrusion.

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder, the landing seat having a seat groove; a landing mandrel for landing onto the landing seat; and a protrusion protruding from the landing mandrel and capable of being disposed in the seat groove.

DETAILED DESCRIPTION

1. Introduction

Figure 1A:
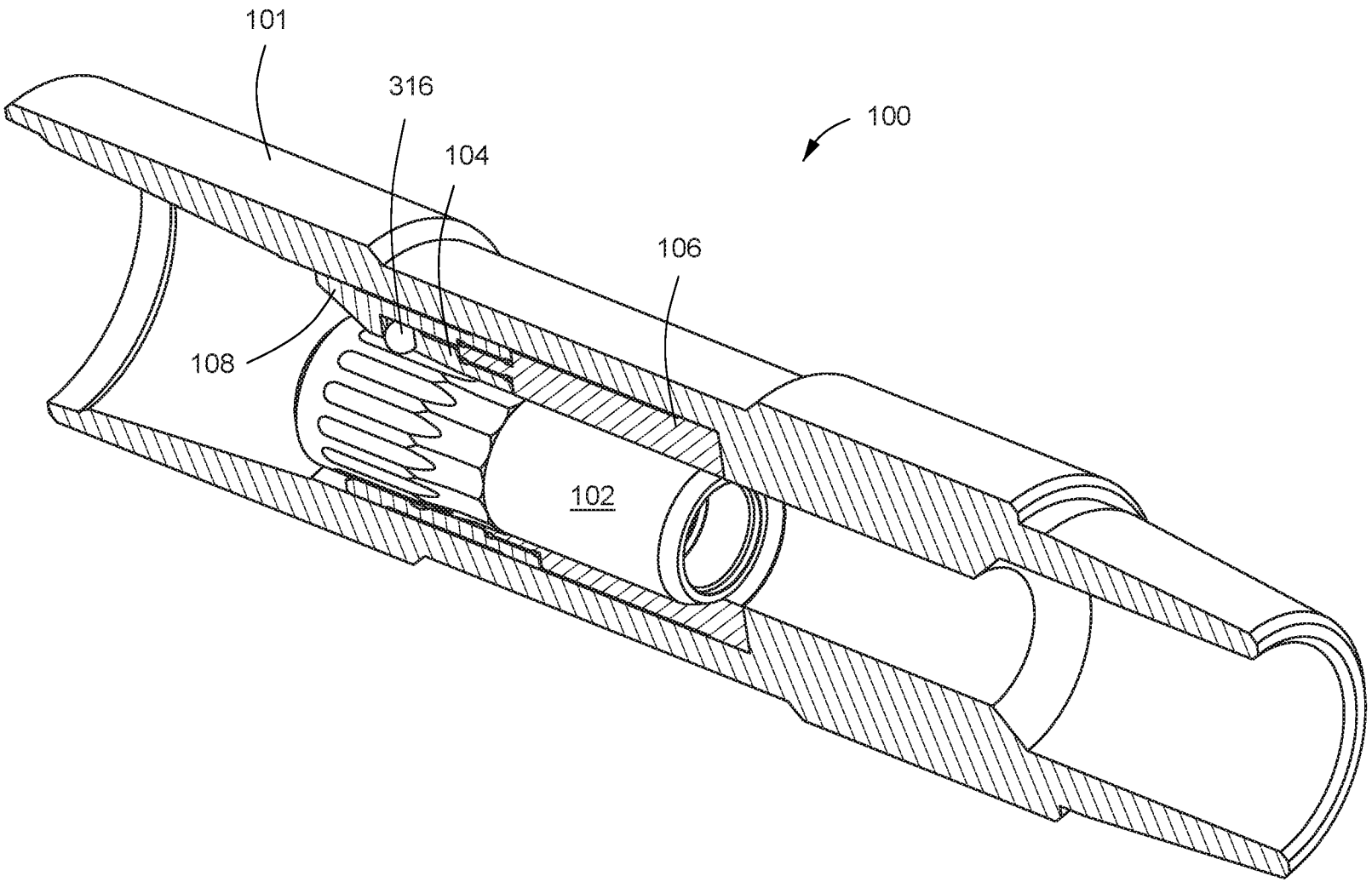
FIG. 1A illustrates a perspective view of a downhole landing assembly disposed in a tubular.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." For example, a first object may be abutted against a second object such that the second object is limited from moving in a direction of the first object. Thus, an outer socket of a landing mandrel may be abutted against an inner socket surface of a landing seat. A ball bearing may be abutted against a surface defining a seat groove. A knob may be abutted against a surface defining a seat groove. A spline surface may be abutted against a socket surface of a landing seat.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., seat, landing mandrel, lock sleeve, bypass sleeve, disconnect assembly, circulating valve assembly, check valve assembly, motor, cutter assembly, collar, piston, housing, or tubular. For example, an aperture may be an opening that begins on one side of a solid object and ends on the other side of the object. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., downhole cutting assembly, lock sleeve, blade, piston, or wiper plug. For example, a piston may be received in an aperture of a collar of a housing of a cutter assembly. Additionally, a seal portion of a landing mandrel may be received within an aperture of a landing seat.

The term "assembly" as used herein is defined as any set of components that have been fully or partially assembled together. A group of assemblies may be coupled to form a solid housing having an inner surface and an outer surface.

The term "bearing assembly" as used herein is defined as an assembly capable of supporting a rotor as it is rotated. A bearing assembly may be coupled to an inner surface of a stator. A rotor may have an upper portion rotatably coupled to a bearing assembly. A bearing assembly may be disposed concentrically around a rotor. A bearing assembly may include a bushing, e.g., sleeve. Examples of a bearing assembly may include an axial support bearing, a journal bearing, and/or a thrust bearing. A bearing assembly may be disposed at each end of a rotor.

The term "blade" as used herein is defined as a structure having a sharp end, edge or tip, e.g., for cutting a downhole tubular string. Cutting may include shearing, gouging, or scraping a downhole tubular string. A blade maybe disposed in a window of a housing of a cutter assembly. A blade may include an end pivotably coupled to a housing of a cutter assembly. A blade may have a portion capable of being abutted against a piston. A blade may include an end, edge, or tip having tungsten carbide. A blade may have and end, edge, or tip having material that include tungsten, molybdenum, chromium, vanadium, cobalt, and/or carbon.

The term "castellation" as used herein is defined as having a groove configured, sized, and/or shaped to receive a portion, e.g., protrusion, of another structure or object. A first "castellation wall" may have a groove configured, sized, and/or shaped to receive a protrusion of second castellation wall. A castellation wall may have a groove disposed therein. A castellation wall may have two protrusions that form a groove therebetween. Two castellation walls may be meshed, such that a protrusion of one castellation wall may disposed in a groove of the other castellation wall.

The term "check valve assembly" as used herein is defined as an assembly providing a flow path for fluid, e.g. mud, lubricant, cement, and/or cleaning agents, in one direction. A check valve assembly may include a first housing, a second housing, and one or more flapper assemblies. A check valve assembly may have a housing constructed from multiple housings. A check valve assembly may include a flapper biased in a closed position. A check valve assembly include a flapper that is capable of biased away from a collar to an open position. A dart may be passed through a check valve assembly.

The term "cutter assembly" as used herein is defined as an assembly for cutting a downhole tubular string. A cutter assembly may include a housing, a piston, a coil, and one or more blades. A cutter may include blades pivotably coupled to a housing.

The term "circulating valve assembly" as used herein is defined as an assembly providing alternate flow paths for fluid, e.g. mud, lubricant, cement, and/or cleaning agents.

The term "coupled" as used herein is defined as directly or indirectly connected or attached. A first object may be coupled to a second object such that the first object is positioned at a specific location and orientation with respect to the second object. For example, a landing assembly may be coupled to a cutter assembly. A first object may be either permanently, removably, slidably, shearably, threadably, pivotably, anti-rotatably, and/or fixedly coupled to a second object. Two objects are "permanently coupled," if once they are coupled, the two objects, in some cases, cannot be separated. Two objects may be "removably coupled" to each other via shear pins, threads, tape, latches, hooks, fasteners, locks, male and female connectors, clips, clamps, knots, and/or surface-to-surface contact. For example, a landing seat and a landing mandrel may be removably coupled to each other such that the landing mandrel may then be uncoupled and removed from the landing seat. Two objects may be "slidably coupled" where an inner aperture of one object is capable of receiving a second object. For example, a piston extended through a collar of a housing of a cutter assembly may be slidably coupled to the collar. Two objects may be "shearably coupled," e.g., where a pin is extended through the objects and force applied to one object may break or shear the pin. For example, a pin may be extended through a lock sleeve and a housing of a disconnect assembly, and force applied to the lock sleeve may be transferred from the lock sleeve to the pin to cause the pin to be sheared or broken. Additionally, two objects may be capable of being "threadably coupled" e.g., where a threaded outer surface of one object is capable of being engaged with or to a threaded inner surface of another object. Threadably coupled objects may be removably coupled. Accordingly, a motor may be threadably coupled to a landing mandrel where a threaded inner surface, e.g., box/female threads, of the landing mandrel may be engaged with a threaded outer surface, e.g., pin/male threads, of the motor. Two objects may be "anti-rotatably coupled" e.g., where the first object may be inhibited from being rotated relative to the second object. For example, a landing mandrel may be anti-rotatably coupled to a landing seat where the landing mandrel, in some cases, may not be rotated relative to the landing seat. Anti-rotatably coupled objects may still be moved axially relative to each other. Two objects may be "fixedly coupled" e.g., where the first object may be inhibited from being rotated and/or moved axially relative to the second object. For example, a landing mandrel may be fixedly coupled to a landing seat where the landing mandrel, in some cases, may neither be rotated nor moved axially relative to each other.

The term "cylindrical" as used herein is defined as shaped like a cylinder, e.g., having straight parallel sides and a circular or oval or elliptical cross-section. Examples of a cylindrical structure or object may include a landing seat, a landing mandrel, a lock sleeve, a bypass sleeve, a disconnect assembly, a circulating valve assembly, a check valve assembly, a motor, a cutter assembly, a collar, a piston, a housing, a mandrel, and a tubular. A cylindrical object may be completely or partially shaped like a cylinder. For example, a cylindrical object may have an aperture that is extended through the entire length of the housing to form a hollow cylinder capable of permitting another object, e.g., landing mandrel, housing, piston, wiper plug, or dart, to be extended or passed through. Alternatively, a solid cylindrical object may have an inner surface or outer surface having a diameter that changes abruptly. A cylindrical object may have and inner or outer surface having a diameter that changes abruptly to form a collar, e.g., radial face, rim, or lip. A cylindrical object may have a collar extending toward or away from the central axis line of the object. A cylindrical object may have a collar disposed on an inner surface. A cylindrical object may have a collar disposed on an outer surface. Additionally, a cylindrical object, may have a collar that is tapered or radiused.

The term "dart" as used herein is defined as a structure configured, sized, and/or shaped for landing onto another structure, preferably so that surfaces of the two structures are abutted against each other and/or form a seal. A dart may be landed on a landing seat, a lock sleeve, or a bypass sleeve. Examples of a dart may include a ball, a plug, and a wedge. A dart may have a tapered profile. A dart may be elongated. A dart may inhibit fluid flow.

The term "disconnect assembly" as used herein is defined as a structure having portions removably coupled to each other. A disconnect assembly may have an upper housing and a lower housing. An upper housing of a disconnect assembly may include a first castellation wall. A lower housing of a disconnect assembly may include a second castellation wall that is capable of meshing with a first castellation wall of an upper housing of the disconnect assembly.

The terms "first" and "second" as used herein merely differentiate two or more things or actions, and do not signify anything else, including order of importance, sequence, etc.

The term "flow path" as used herein is defined as a space through which fluid is capable of flowing, e.g., a conduit. A flow path may be disposed within an object, e.g., seat, landing mandrel, lock sleeve, bypass sleeve, disconnect assembly, circulating valve assembly, check valve assembly, motor, cutter assembly, bearing assembly, thrust assembly, collar, piston, housing, and/or tubular. A flow path may extend uninterrupted through ends of an object, e.g., a landing mandrel, a disconnect assembly, a circulating valve assembly, a motor, and/or a cutter assembly. A flow path may be formed by a groove disposed on an object. A flow path may be a groove disposed in an outer surface of an object. A flow path may be formed by the inner surface of an object. A flow path may be formed by the inner surface of a group of coupled objects, e.g., seat, landing mandrel, lock sleeve, bypass sleeve, disconnect assembly, circulating valve assembly, check valve assembly, motor, cutter assembly, bearing assembly, or thrust assembly, collar, piston, housing, and/or tubular. A flow path may be formed from two or more connected flow paths.

The term "downhole cutting assembly" as used herein is defined as an assembly configured, shaped, and/or sized for deployment within a tubular string, e.g., to cut the tubular string. A downhole cutting assembly may be coupled with a landing seat to form a downhole landing assembly. A downhole cutting assembly may include a landing mandrel, a motor, and a cutter assembly. A downhole cutting assembly may include a disconnect assembly, a check valve assembly, and/or a bypass valve. A downhole cutting assembly may be deployed via freefall, wireline, slickline, coiled tubing, or a column of fluid.

The term "flow rate" as used herein is defined as the volume of material or fluid that passes per unit of time. Volume may be measured in gallons or liters. Time may be measured in seconds, minutes, or hours. A flow rate of a pumped fluid may be measured at the surface. A flow rate of a pumped fluid may be measured before the fluid is pumped into a downhole tubular string. A flow rate of a pumped fluid may be measured at a station or a pump that pumped the fluid. A "pump down fluid flow rate" may range from as low as 30, 35, 40, 45, 50, 55 gallons per minute to as high as 60, 70, 80, 90, 120, 160 gallons per minute or higher. An "actuation fluid flow rate" may range from as low as 55, 60, 65 gallons per minute to as high as 120, 140, 160, 200, 250 gallons per minute or higher.

The term "fluid" as used herein is defined as material that is capable of flowing. A fluid may be a liquid or a gas. Examples of a fluid may include hydrocarbon, water, drilling fluid, drilling mud, cement, lubricant, cleaning fluid, and motor oil. A fluid may include material, e.g., hydrocarbon, water, compounds, and/or elements originating from underground rock formation. A fluid can be a mixture of two or more fluids. A fluid may absorb heat. A fluid may have properties such as viscosity, anti-foaming, thermal stability, thermal conductivity, and thermal capacity. Fluid in a downhole tubular string used in driving a motor, e.g., motor, may be call "mud." A fluid may be water-based, oil-based, synthetic, or a combination of viscous materials and solid materials.

The term "fluid port" as used herein is defined as an aperture in a structure for providing ingress and/or egress of fluid therethrough. A fluid port may be disposed in a landing seat, a landing mandrel, a lock sleeve, a bypass sleeve, a disconnect assembly, a circulating valve assembly, a check valve assembly, a motor, a cutter assembly, a bearing assembly, a thrust assembly, a collar, a piston, a housing, and/or a tubular. A fluid port may be disposed in a tubular, e.g., housing or sleeve of a disconnect assembly, circulating valve assembly, or cutter assembly. A fluid port may extend through a shaft assembly. A fluid port may extend in a direction perpendicular to the central axis of a tubular. Fluid ports may be disposed symmetrically around a tubular. In some cases, fluid ports may not necessarily be precisely the same circumferential distance apart. The preferable circumferential distance between each fluid port in a tubular may be approximately 360 degrees divided by the number of fluid ports.

The term "housing" as used herein is defined as a structure, preferably a cylindrical structure, configured to be filled with fluid, e.g., hydrocarbon, water, drilling fluid, cement, lubricant, and/or cleaning fluid. A housing may have a central aperture extending therethrough. A housing may have one or more threaded ends for coupling with another housing. Multiple housings may be coupled axially to form a longer housing. A housing, e.g., of a motor, may include a stator and one or more housings. A housing may receive another object or structure therein. A housing and an object or structured disposed therein may be concentric.

The term "knob" as used herein is defined as a protrusion configured, sized, and/or shaped to be abutted against another structure, e.g., landing mandrel or landing seat. A knob may protrude, e.g., extend, rise, and/or elevate, from a surface of an object, e.g. landing mandrel or landing seat. A knob may have a tapered portion. A knob may have a portion that is a spherical cap, e.g. dome. A knob may be obround. A knob may be an elongated structure, e.g., rib.

The term "landing mandrel" as used herein is defined as a fully solid or partially solid structure configured, sized, and/or shaped for landing on a landing seat. A landing mandrel may be cylindrical. A landing mandrel may be constructed from a hard material, e.g., copper or aluminum. A landing seat may be constructed from material having a Brinell hardness value of as low as 320, 321, 322, 324, 325, 330, or 335 to as high as 550, 560, 580, 610, 648, 658, or higher. A landing may have two outer surfaces that form an angle. An outer surface of a landing mandrel may have male socket surfaces disposed thereon. Male socket surfaces of a landing mandrel may be aligned with socket surfaces of an inner surface of a landing seat. A landing mandrel may be anti-rotatably or fixedly coupled to a landing seat. Thus, a landing mandrel, in some case, cannot be rotated relative to a landing seat.

The term "landing seat" as used herein is defined as a fully solid or partially solid structure for receiving an object, e.g., landing mandrel or a dart, thereon. A landing seat may receive a landing mandrel or a dart. A landing seat may have an inner surface that defines an aperture disposed therethrough. A landing seat may be constructed from a deformable material, e.g., copper or aluminum. A landing seat may be constructed from material having a Brinell hardness value of as low as 75, 76, 78, 79, 80, 85, or 90 to as high as 111, 112, 113, 114, 115, 120, 125, 130, or higher. A landing seat may have one or more socket surfaces disposed in an inner surface of the landing seat. A landing seat may have one or more socket surfaces capable being aligned with male socket surfaces of a landing mandrel. A landing seat may be anti-rotatably and/or fixedly coupled to a landing mandrel such that the landing mandrel, in some case, cannot be rotated relative to the landing seat. A landing seat may be threadably coupled to a downhole tubular or a tubular string, e.g., casing, drilling pipe, or liner hanger. A landing seat may be deployed on a tubular string downhole. A landing seat having a stationary and/or fixed location, e.g., no longer moving axially, downhole may be considered to be "set." A landing seat may include a seat cylinder. A landing seat may include a seat cylinder threadably coupled to a downhole tubular or a tubular string, e.g., casing, drilling pipe, or liner hanger. A landing seat coupled to a downhole tubular or a tubular string may be "tripped" into a well. Multiple landing seats may be coupled a downhole tubular or tubular string. Each landing seat disposed above a lower landing seat on a downhole tubular or tubular string may have an inner surface having a diameter larger than that of the lower landing seat.

The term "lock" as used herein is defined as a structure configured, sized, and/or shaped for coupling two or more objects together. For example, a lock may be used to couple a landing mandrel to a landing seat. Types of locks may include a lug, a steel ball, a slip, a dog, a collect, a ring, and a sleeve. A lock may inhibit movement of a first object in one or more directions, e.g., radially and/or axially. A lock may be disposed in grooves or apertures of one or more objects, e.g., landing mandrel and/or landing seat. A lock may be disposed circumferentially on an object, e.g., landing mandrel and/or landing seat. A lock may be a disposed on an outer surface of an object, e.g., landing mandrel. A lock may be a ring disposed on an inner surface of an object, e.g., landing seat. A lock may have a surface abutted against an object. A lock may have teeth. A lock may have teeth capable of being coupled to teeth or threads disposed on an object, e.g., landing seat. A lock may have a first portion abutted against a surface of a first object and a second portion abutted against a surface of a second object. For example, a lock may have a first portion abutted against a surface of a landing mandrel and a second portion abutted against a surface of a landing seat. A lock may have outer socket surfaces capable of being aligned with inner socket surfaces of a landing seat. A lock may have outer socket surfaces aligned with inner socket surfaces of a landing seat.

The term "motor" as used herein is defined as an assembly capable of driving movement, of an object, e.g., cutter assembly, a housing, a piston, and/or a blade. Movement of an object may include rotation of the object on a central axis. Additionally, movement may include radial displacement or axial displacement of an object relative to another object. Types of motor may include a mud motor or a turbine motor. A "mud motor" may be a progressive cavity positive displacement pump motor having a portion, e.g., drive shaft and/or rotor, capable of being rotated. A mud motor may include a stator, a rotor, and bearing assemblies. A mud motor may include a stator, a rotor, and a drive shaft assembly. A "turbine motor" may be a progressive cavity positive displacement pump motor having one or more rotatable portions, e.g., drive shaft and/or rotors, having fins or blades protruding from each rotatable portion. Fluid may flow across vanes, e.g., fins or blades, of a turbine motor. A motor may include a drive shaft assembly capable of being coupled to a cutter assembly. The inner surface of a motor may define an aperture extending through ends of a motor.

The term "orthogonal" as used herein is defined as at an angle ranging from 85° or 88 to 92° or 95°. Two structures that are orthogonal to each other may be perpendicular and/or tangential to each other.

The term "pressure" as used herein is defined as force per unit area. Pressure may be exerted against a surface of an object, e.g., rotor, piston head, seat, and/or dart, from the flow of fluid across the surface.

The term "protrusion" as used herein is defined as a structure extending from a surface of an object. A protrusion may be a knob. For example, a knob may protrude from a surface of landing mandrel or a landing seat. A protrusion may be a portion of a ball bearing. For example, a ball bearing may have a portion extending through a surface of a landing mandrel or a landing seat. A protrusion may be a spline. For example, a spline may have a portion protruding from a surface of a landing mandrel or a landing seat. A protrusion may directly transfer force to a structure, e.g., landing mandrel or landing seat. A knob and a structure, e.g., landing mandrel or landing seat, may be unitary. A protrusion may have a radiused portion, e.g., surface. A protrusion may be tapered. A protrusion may have a portion that is a spherical cap, e.g. dome. A knob may have a radiused portion and a tapered portion, e.g., shaped like a teardrop.

The term "providing" as used herein is defined as making available, furnishing, supplying, equipping, or causing to be placed in position.

The term "pin" as used herein is defined as structure capable of being received in an aperture or groove of another structure, e.g., for coupling two objects or inhibiting movement of an object. A pin may also be referred to as a lug. A pin may be cylindrical and may have a tapered end. A pin may be broken via dissolving or breaking, e.g., shearing or snapping. A pin may be capable of being broken upon application of threshold force against the pin. A pin may be used to shearably couple a lock sleeve to a housing of a disconnect assembly. A pin may be used to shearably couple a bypass sleeve to a housing of a circulating valve assembly. A pin be disposed in an inner wall of a housing of a cutter assembly to inhibit upward movement of a piston.

The term "piston" as used herein is defined as a structure capable of being moved by fluid pressure applied thereto when positioned within a chamber or a housing. A piston may have a head and a stem. A piston may have an aperture disposed therethrough. A piston may be solid. A piston may be slid relative to a housing by application of fluid pressure against a surface of the piston. A piston may have an insert disposed within a piston head of the piston.

The term "pressure" as used herein is defined as force per unit area. Pressure may be exerted against a surface of an object, e.g., rotor or piston head, from the flow of fluid across the surface.

The term "rotor" as used herein is defined as a cylindrical structure capable of rotating, e.g., rotating relative to a stator in response to fluid pressure. A rotor may have a helical portion. A rotor may have an outer surface having lobes thereon. A rotor may be coupled to a drive shaft assembly. A rotor may be coupled to one or more bearing assemblies.

The term "seat cylinder" as used herein is defined as a fully solid or partially solid structure for coupling to a landing seat. Fluid may pass through a seat cylinder. A dart may pass through a seat cylinder. A seat cylinder may have a landing seat disposed therein. A seat cylinder may be coupled to a downhole tubular. A seat cylinder may extend from a landing seat. Accordingly, a seat cylinder and a landing seat may be unitary. A seat cylinder may be coupled to a landing seat. A seat cylinder may be abutted against a landing seat. A landing seat may be disposed between a lower seat cylinder and an upper seat cylinder.

The term "socket surfaces" as used herein is defined as connected surfaces having a polygonal cross-section. An example of a polygonal cross-section may be triangular, square, rectangular, pentagonal, hexagonal, or octagonal. Socket surfaces may have surfaces connected to form a polygonal shape, e.g., triangular, square, rectangular, pentagonal, hexagonal, or octagonal. Males socket surfaces may be disposed on an outer surface of a cylindrical structure, e.g., landing mandrel, sleeve, housing, cap, rod, or bolt. Female socket surfaces may be disposed on an inner surface of a cylindrical structure, e.g., landing seat, sleeve, housing, cap, rod, or bolt. Female socket surfaces of a landing seat are capable of being aligned with male socket surfaces of a landing mandrel. Female socket surfaces of a landing seat are capable of being abutted against male socket surfaces of a landing mandrel.

The term "spline" as used herein is defined as a structure configured, sized, and/or shaped to be abutted against another structure or surface. Types of splines may include ribs, slats, fingers, projections, and protrusions. A spline may have two intersecting surfaces. A spline may have two surfaces that form an angle. A spline may have surfaces protruding from a structure, e.g., landing mandrel or landing seat. Two adjacent splines may form a shape of a chevron. A spline surface of a spline may be abutted against a socket wall.

The term "stator" as used herein is defined as a housing of a rotor of a motor. A stator may be part of a motor. Preferably, a stator is a portion of a motor that remains fixed with respect to rotating parts, e.g., shaft, rotor, bearing assembly, and/or drive shaft assembly. A stator may have a central aperture. A stator may be coupled to a housing. A stator may have a helical portion. A stator may have an inner surface having lobes thereon.

The term "surface" as used herein is defined as any face and/or boundary of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a landing seat, a landing mandrel, a lock sleeve, a bypass sleeve, a disconnect assembly, a circulating valve assembly, a check valve assembly, a motor, a cutter assembly, a collar, a piston, a housing, a mandrel, and/or a tubular. A surface may have irregular contours. A surface may be formed from coupled components, e.g. landing seat, a landing mandrel, lock sleeve, bypass sleeve, disconnect assembly, circulating valve assembly, check valve assembly, motor, cutter assembly, collar, piston, housing, mandrel, and/or tubular. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal. Socket surfaces may have curved walls connected to form a substantially polygonal shape, e.g., triangular, square, rectangular, pentagonal, hexagonal, or octagonal.

The term "tapered" as used herein is defined as becoming progressively smaller, e.g., in diameter, from a first end towards a second end. Structures that are tapered may have a profile that is beveled, frustoconical, and/or conical.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a landing seat, a landing mandrel, a lock sleeve, a bypass sleeve, a disconnect assembly, a circulating valve assembly, a check valve assembly, a motor, a cutter assembly, a collar, a piston, a housing, a mandrel, and a tubular. Threads formed on an inner surface of an object may be referred to as "box threads". Threads formed on an outer surface of an object, e.g., seat, sleeve, housing, seal, or tubular, may be referred to as "pin threads." A threaded assembly may include a "threaded portion" wherein a section of the threaded assembly includes threads, e.g., pin threads or box threads. A threaded portion may have a diameter sized to extend through an aperture of a sleeve, a housing, or a collar. In certain cases, a threaded portion of a first object may be removably coupled to a threaded portion of a second object.

The term "tubular" as used herein is defined as a structure having an inner surface and an outer surface and a length greater than its width or height. A tubular may have an aperture disposed therethrough. Preferably, a tubular is cylindrical. Examples of a tubular may include a landing seat, a seat cylinder, a landing mandrel, a lock sleeve, a bypass sleeve, a disconnect assembly, a circulating valve assembly, a check valve assembly, a motor, a cutter assembly, a collar, a piston, a housing, and a mandrel. However, any or all tubulars of an assembly may have polygonal cross-sections, e.g., triangular, rectangular, pentagonal, hexagonal, or octagonal.

The term "unitary" as used herein defined as having the form of a single unit. For example, a landing seat, a lower seat cylinder, and an upper seat cylinder may be unitary if they formed into a single piece of material, e.g., metal, plastic, carbon fiber, or ceramic. Also, a piston head and a piston stem that are individual parts of a piston may be unitary if they are formed into a single piece of material, e.g., plastic, carbon fiber, ceramic, or metal. Additionally, socket surfaces that are individual parts of a landing seat or a landing mandrel may be unitary if they are formed into a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a landing mandrel, a disconnect assembly, a circulating valve assembly, motor, cutter assembly, housing, sleeve, and/or seat may each have an upper end and a lower end. Additionally, a cylindrical object, e.g., a landing mandrel, a disconnect assembly, a circulating valve assembly, motor, cutter assembly, housing, sleeve, and/or seat, may have an upper portion and a lower portion. The term "top" as used herein means in the highest position, e.g., farthest from the ground. The term "bottom" as used herein means in the lowest position, e.g., closest the ground. For example, a cylindrical object, e.g., a landing mandrel, a disconnect assembly, a circulating valve assembly, motor, cutter assembly, housing, sleeve, and/or seat, may have a top portion and a bottom portion.

The term "wall" as used herein is defined as any fully solid or partially solid structure having a planar surface. A wall may have two opposing sides. A wall may be a flat plate, e.g., disc. A wall may be cylindrical. A wall may be continuous. A wall may have curved planar sides that may or, in some cases, may not be parallel to one another. A wall may be rigid. A wall may be flexible. A wall may be planar. A wall may be curved. A landing seat may have a wall. A landing mandrel may have a wall. A wall of a landing seat or a landing mandrel may have a socket surface. A wall having a socket surface is said to be a socket wall. A wall may have one or more grooves. A wall may have one or more apertures disposed therethrough. A wall may have an aperture configured, sized, and/or shaped to receive a protrusion, e.g., ball bearing portion, of a landing mandrel or landing seat.

3. Certain Specific Embodiments

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder, the landing seat having two inner surfaces; and a landing mandrel having two outer surfaces, wherein one outer surface of the two outer surfaces may be capable of being abutted against one inner surface of the two inner surfaces.

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder; a protrusion protruding from the landing seat; and a landing mandrel for landing on the landing seat, the landing mandrel having a mandrel groove capable of receiving the protrusion.

The disclosure herein includes a downhole landing assembly for an oil or gas well, which downhole landing assembly may include: an upper seat cylinder capable of being coupled to an upper portion of a tubular string; a lower seat cylinder capable of being coupled to a lower portion of the tubular string, wherein the lower seat cylinder is coupled to the upper seat cylinder; a landing seat coupled to the lower seat cylinder, the landing seat having a seat groove; a landing mandrel for landing onto the landing seat; and a protrusion protruding from the landing mandrel and capable of being disposed in the seat groove.

The disclosure herein includes a tubular cutting assembly, which tubular cutting assembly may include: a landing mandrel having a landing portion for coupling to a landing seat; a motor disposed below the landing mandrel; a housing rotatably coupled to the motor; and a blade pivotably coupled to the housing, the blade having a portion capable of being abutted against the downhole tubular string.

The disclosure herein includes a tubular cutting assembly, which tubular cutting assembly may include: a stator; a rotor disposed in the stator; and a drive shaft assembly coupled to the rotor and coupled to the cutter assembly, the drive shaft assembly may include: an inlet fluid port; and a central aperture in fluid communication with the inlet fluid port.

The disclosure herein includes a tubular cutting assembly, which tubular cutting assembly may include: a landing seat; a landing mandrel coupled to the landing seat; a motor disposed below the landing mandrel; a housing rotatably coupled to the motor; and a blade pivotably coupled to the housing, the blade having a portion abutted against the downhole tubular string.

The disclosure herein includes a method of cutting a downhole tubular string, which method may include: providing a downhole cutting assembly that may include: a landing mandrel; a motor disposed below the landing mandrel; a housing rotatably coupled to the motor; and a blade pivotably coupled to the housing, the blade having a portion capable of being abutted against the downhole tubular string; deploying the tubular cutting assembly in the downhole tubular string; coupling the landing mandrel to a landing seat disposed on the downhole tubular string; pumping fluid into the downhole tubular string at an actuation flow rate; pushing a piston against a portion of a blade; abutting a cutting end of the blade against an inner surface of the downhole tubular string; and rotating the blade around a central axis of the downhole tubular string.

The downhole landing assembly of claim 1, wherein the landing mandrel is capable of being deployed in the tubular string after the seat has been set in the oil or gas well.

The downhole landing assembly of claim 1, wherein the landing mandrel is capable of landing on the seat after the seat has been set in the oil or gas well.

In any one of the methods or structures disclosed herein, the two inner surfaces may be planar.

In any one of the methods or structures disclosed herein, the two outer surfaces may be planar.

In any one of the methods or structures disclosed herein, the two outer surfaces may form an angle.

In any one of the methods or structures disclosed herein, the two outer surfaces may be tapered.

In any one of the methods or structures disclosed herein, the two outer surfaces may be capable of being aligned with the two inner surfaces of the landing seat.

In any one of the methods or structures disclosed herein, the two inner surfaces of the landing seat may be capable of inhibiting rotation of the landing mandrel.

In any one of the methods or structures disclosed herein, the two inner surfaces of the landing seat may be capable of anti-rotatable coupling to the landing mandrel.

Any one of the methods or structures disclosed herein may further include a lock disposed on the landing mandrel and capable of being coupled to the landing seat.

Any one of the methods or structures disclosed herein may further include a lock disposed on the landing seat and capable of being coupled to the landing mandrel.

In any one of the methods or structures disclosed herein, the protrusion may be a portion of a ball bearing extending through a portion of the landing seat.

In any one of the methods or structures disclosed herein, the protrusion may be capable of being abutted against a surface of the landing mandrel.

In any one of the methods or structures disclosed herein, the landing mandrel may have an outer socket surface that is tapered.

In any one of the methods or structures disclosed herein, the landing mandrel may be capable of being deployed down the tubular string to land on the landing seat after the landing seat has been deployed down the oil or gas well.

In any one of the methods or structures disclosed herein, the landing mandrel may have a tapered outer socket surface capable of being abutted against a tapered inner socket surface of the landing seat.

In any one of the methods or structures disclosed herein, fluid in the tubular string may be capable of ingress or egress, or both, through the upper seat cylinder, the lower seat cylinder, the landing seat, and the landing mandrel.

In any one of the methods or structures disclosed herein, a portion of the lower seat cylinder may be disposed between a portion of the upper seat and a portion of the landing seat.

In any one of the methods or structures disclosed herein, the protrusion may be a portion of a ball bearing extending through a portion of the landing mandrel.

In any one of the methods or structures disclosed herein, the protrusion may be capable of being abutted against a surface of the landing seat.

In any one of the methods or structures disclosed herein, the landing seat may have inner socket surfaces aligned with outer socket surfaces disposed on the landing mandrel.

In any one of the methods or structures disclosed herein, the landing mandrel is capable of being fixedly coupled to the landing seat, after the landing seat has been deployed downhole with the tubular string.

In any one of the methods or structures disclosed herein, the motor may be coupled to the landing mandrel.

In any one of the methods or structures disclosed herein, the tubular cutting assembly may further include a disconnect assembly that may be coupled to the landing mandrel.

In any one of the methods or structures disclosed herein, the tubular cutting assembly may further include a disconnect assembly including: a first housing having an aperture; a second housing removably coupled to the first housing, the second housing having a lock groove disposed in an inner surface the second housing; a locking sleeve slidably coupled to the first housing, the lock sleeve having a release groove; and a lug abutted against the lock sleeve and extended through the aperture of the first housing and into the lock groove of the second housing.

In any one of the methods or structures disclosed herein, the lug is capable of egress from the lock groove of the second housing and ingress into the release groove of the lock sleeve.

In any one of the methods or structures disclosed herein, the locking sleeve is capable of receiving a dart.

In any one of the methods or structures disclosed herein, the first housing further include a bypass aperture, wherein the locking sleeve may obstruct the bypass aperture.

In any one of the methods or structures disclosed herein, the first housing further include a bypass aperture, wherein the locking sleeve is capable of being slid away from the bypass aperture.

In any one of the methods or structures disclosed herein, the tubular cutting assembly may further include a circulating valve assembly may be coupled to the landing mandrel.

In any one of the methods or structures disclosed herein, the tubular cutting assembly may further include a circulating valve assembly coupled to the motor.

In any one of the methods or structures disclosed herein, the tubular cutting assembly may further include a circulating valve assembly that includes: a housing having a bypass aperture disposed therein; a bypass sleeve slidably coupled to the housing.

In any one of the methods or structures disclosed herein, the bypass sleeve is capable of seating a dart.

In any one of the methods or structures disclosed herein, the bypass sleeve may obstruct the bypass aperture.

In any one of the methods or structures disclosed herein, the bypass sleeve is capable of being slid away from the bypass aperture.

In any one of the methods or structures disclosed herein, fluid in the tubular string may be capable of ingress or egress, or both, through the landing mandrel, the motor, and the cutter assembly.

In any one of the methods or structures disclosed herein, the landing seat may further include inner socket surfaces capable of being aligned with outer socket surfaces disposed on the landing mandrel.

In any one of the methods or structures disclosed herein, the landing mandrel may include: an outer surface; outer socket surfaces disposed on the outer surface, wherein the outer socket surfaces are capable of being aligned with inner socket surfaces disposed on the landing seat; and a seal disposed circumferentially on the outer surface.

In any one of the methods or structures disclosed herein, a seal may be disposed circumferentially on an outer surface of the landing mandrel, wherein the seal is capable of being sealingly abutted against an inner surface of the landing seat.

In any one of the methods or structures disclosed herein, a lock may be disposed on the landing mandrel.

In any one of the methods or structures disclosed herein, the lock has teeth that may be capable of being coupled to teeth disposed on the landing seat.

In any one of the methods or structures disclosed herein, the motor may further include: a stator; a rotor disposed in the stator; and a drive shaft assembly coupled to the rotor and coupled to the cutter assembly, the drive shaft assembly including: inlet fluid ports; and a central aperture in fluid communication with the inlet fluid ports.

Any one of the methods or structures disclosed herein the tubular cutting assembly may further include a wiper plug.

Any one of the methods or structures disclosed herein the tubular cutting assembly may further include a wiper plug coupled to the cutter assembly.

Any one of the methods or structures disclosed herein the tubular cutting assembly may further include a wiper plug may be coupled to the cutter assembly.

In any one of the methods or structures disclosed herein, the rotor may be rotatably coupled to the housing.

In any one of the methods or structures disclosed herein, the rotor may further include a universal coupling adapter.

In any one of the methods or structures disclosed herein, the rotor may further include a universal coupling adapter having U-joint.

In any one of the methods or structures disclosed herein, the drive shaft assembly may further include: inlet fluid ports; and a central aperture in fluid communication with the inlet fluid ports.

In any one of the methods or structures disclosed herein, the cutter assembly may further include: a housing including; a collar disposed therein; and a window disposed therethrough; a piston extended through the collar; a coil abutted against the piston and the collar of the housing; a pin coupled to the housing above the piston and abutted against the piston; and a blade pivotably coupled to the housing, the blade having a portion capable of being abutted against the piston.

In any one of the methods or structures disclosed herein, the cutter assembly may further include: a housing including; a collar disposed therein; and a window disposed therethrough; a coil abutted against an upper surface of the collar of the housing; and a piston disposed within the housing, the piston including; a piston head abutted against the coil; a stem protruding from the piston head and extended through coil and the collar; and a pin coupled to the housing and abutted against the piston head; a blade disposed in the window, the blade including: a first portion coupled to the housing; and a cutting edge capable of being biased away from the housing.

In any one of the methods or structures disclosed herein, the first portion the blade may be pivotably coupled to the housing.

In any one of the methods or structures disclosed herein, fluid in the tubular string is capable of ingress, egress, or both, through the piston and window of the housing.

In any one of the methods or structures disclosed herein, the cutter assembly may further include an insert disposed in a piston head of the piston, wherein fluid in the tubular string is capable of ingress, egress, or both, through the insert.

In any one of the methods or structures disclosed herein, a check valve assembly may be coupled to the motor.

In any one of the methods or structures disclosed herein, the tubular cutting assembly may further include a check valve assembly coupled to the landing mandrel.

In any one of the methods or structures disclosed herein, the tubular cutting assembly may further include a check valve assembly including: a housing; and a flapper valve assembly disposed in the housing, the flapper valve assembly including: a collar; and a flapper against the collar in a closed position, wherein the flapper is capable of being biased away from the collar in an open position.

In any one of the methods or structures disclosed herein, the piston may have an aperture through which fluid is capable of ingress, egress, or both.

In any one of the methods or structures disclosed herein, the piston may be solid.

In any one of the methods or structures disclosed herein, the piston may be hollow.

Any one of the methods disclosed herein may further include passing fluid through a window disposed through a housing of the tubular cutting assembly towards the blade.

Any one of the methods disclosed herein may further include passing fluid through a relief fluid port disposed through a housing of the tubular cutting assembly towards the blade.

Any one of the methods disclosed herein may further include lifting the downhole tubular string.

Any one of the methods disclosed herein may further include stretching the downhole tubular string.

Any one of the methods disclosed herein may further include rotating the downhole tubular string.

Any one of the methods disclosed herein may further include applying torque to the downhole tubular string.

Any one of the methods disclosed herein may further include abutting a dart against a bypass sleeve disposed in a housing of a circulating valve assembly of the downhole cutting assembly; and sliding the bypass sleeve away from a bypass aperture disposed through the housing.

Any one of the methods disclosed herein may further include abutting a dart against a lock sleeve disposed in a disconnect assembly of the downhole cutting assembly; sliding the lock sleeve relative to a first housing and a second housing of the disconnect assembly, wherein the lock sleeve has a release groove disposed therein; pushing a lug out of a locking groove disposed in the second housing into the release groove; and decoupling the first housing from the second housing.

Any one of the methods disclosed herein may further include coupling a lock disposed on a landing mandrel with the landing seat.

Any one of the methods disclosed herein may further include coupling teeth of a lock disposed on landing mandrel of the tubular cutting assembly with teeth of the landing seat.

Any one of the methods disclosed herein may further include coupling teeth of a lock with teeth of the landing seat.

Any one of the methods disclosed herein may further include biasing a flapper of a check valve assembly to an open position with fluid flowed downward from above the check valve assembly.

Any one of the methods disclosed herein may further include sliding the lock sleeve away from a bypass aperture disposed in the first housing of the disconnect assembly.

Any one of the methods disclosed herein may further include inhibiting fluid below a check valve assembly from egress therethrough, wherein a flapper of the check valve assembly may be disposed in a closed position.

Any one of the methods disclosed herein may further include pumping fluid above a check valve assembly from egress therethrough, wherein the fluid causes a flapper of the check valve assembly to be biased in an open position.

Any one of the methods disclosed herein may further include inhibiting upward fluid flow below a check valve assembly from egress therethrough, wherein a flapper of the check valve assembly is disposed in a closed position.

Any one of the methods disclosed herein may further include biasing a flapper of a check valve assembly to an open position with fluid flowed downward from above the check valve assembly.

Any one of the methods disclosed herein may further include pumping cement through the disconnect assembly.

Any one of the methods disclosed herein may further include pumping cement through the circulating valve.

Any one of the methods disclosed herein may further include retracting the blade away from the downhole tubular string.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of downhole landing assemblies shown in the drawings, which relate to assemblies, elements and parts that can be part of a downhole landing assembly, and methods for methods for landing tools, e.g., including landing mandrels, onto landing seats coupled to downhole tubular strings. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventors that variations and equivalents of the inventions are within the scope of the claims, while the description, abstract and drawings are not to be used to limit the scope of the inventions. The inventions are specifically intended to be as broad as the claims below and their equivalents.

Figure 1B:
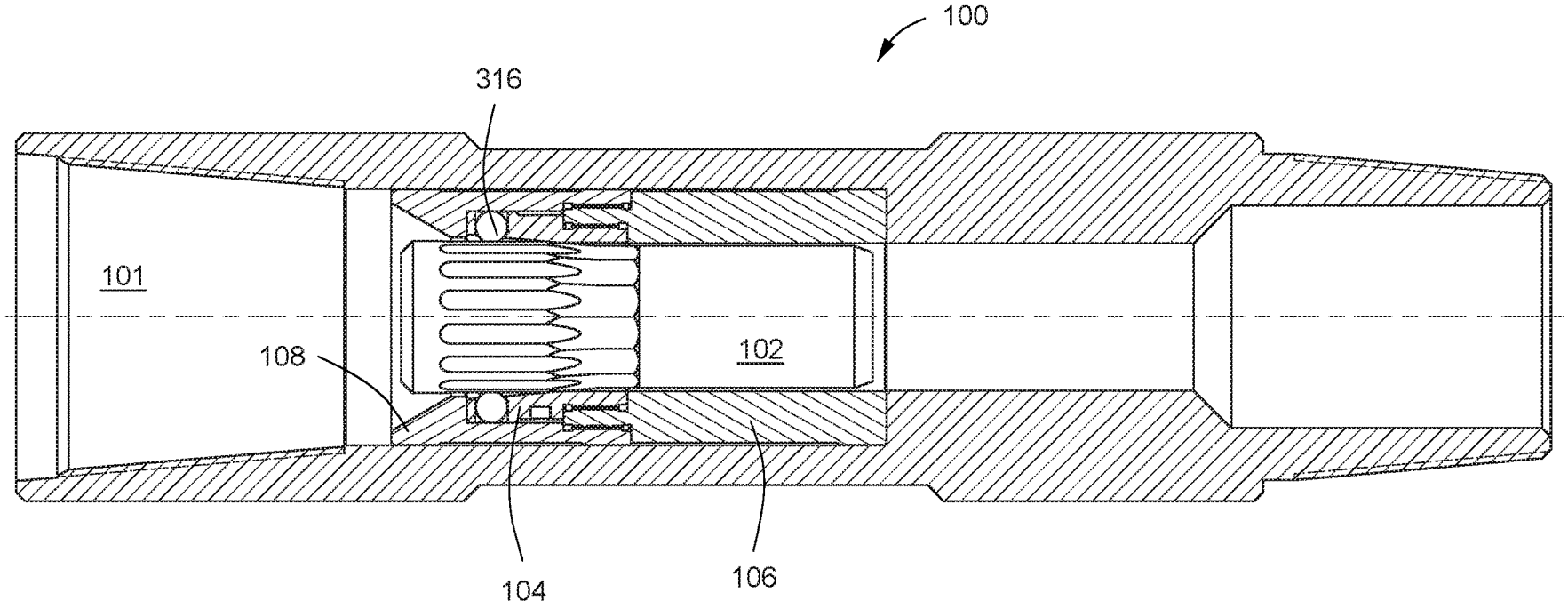
FIG. 1B illustrates a cross-sectional side view of a downhole landing assembly disposed in a tubular.

FIG. 1A illustrates a perspective view of a downhole landing assembly 100 disposed in a tubular 101. FIG. 1B illustrates a cross-sectional side view of a downhole landing assembly 100 disposed in a tubular 101. A tubular 101 may be a portion of a pipe or string of pipes configured for placement underground in a tubular or tubular string, e.g. drill string, casing string, liner hanger, running tool, and/or fishing tool.

Referring to FIGS. 1A-B, a downhole landing assembly 100 may include a landing mandrel 102, a landing seat 104, a lower seat cylinder 106, and an upper seat cylinder 108. The landing mandrel 102 may be disposed concentrically in the landing seat 104, the lower seat cylinder 106, and the upper seat cylinder 108. The landing seat 104 may be coupled to the lower seat cylinder 106 and the upper seat cylinder 108. The landing seat 104, the lower seat cylinder 106, and the upper seat cylinder 108 may be disposed in a tubular 101. The lower seat cylinder 106 and the upper seat cylinder 108 may each be coupled, e.g., via threads or welding, to the tubular 101.

Figure 1C:
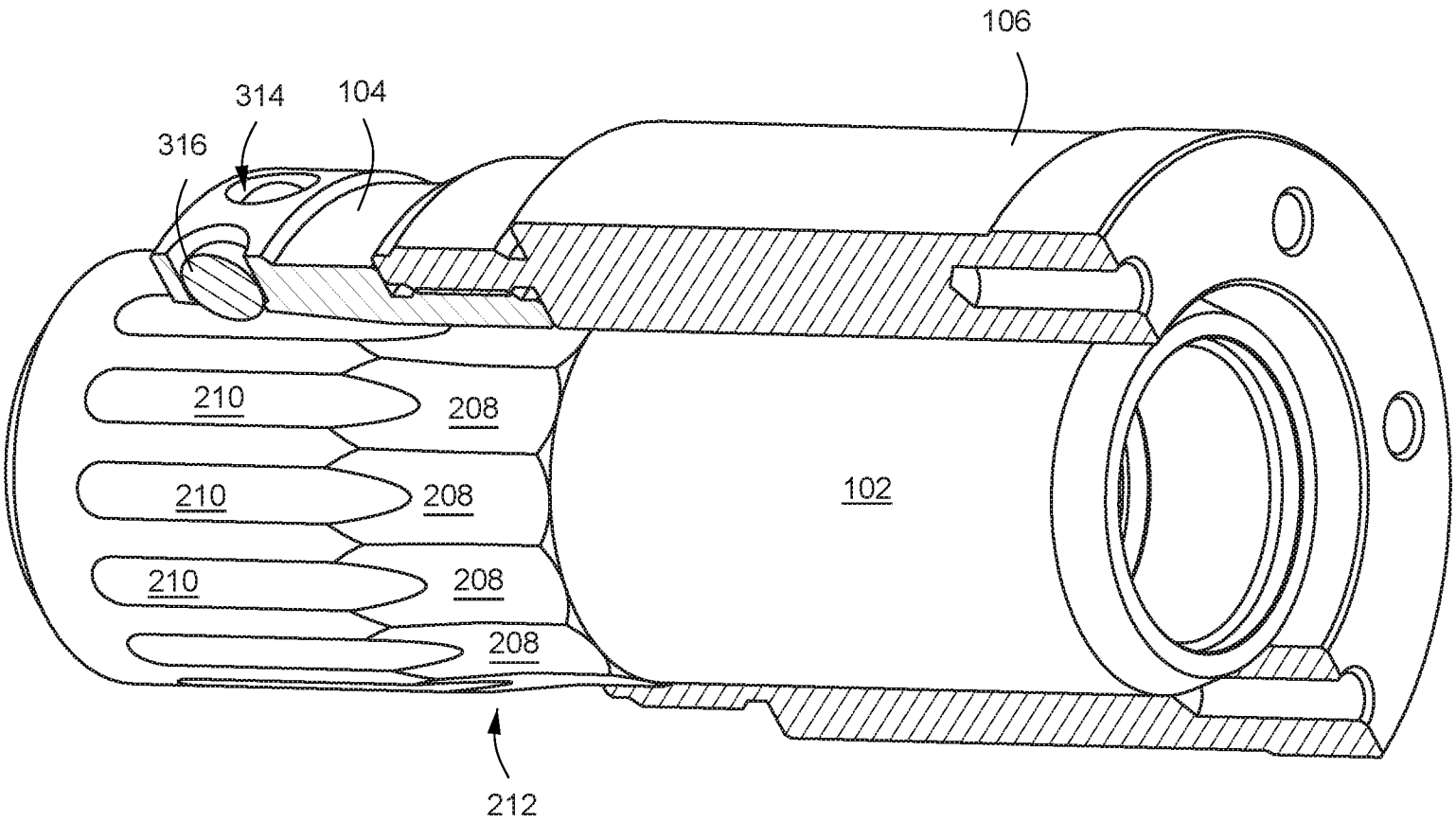
FIG. 1C illustrates a perspective cross-sectional view of a landing mandrel disposed in a landing seat and a lower seat cylinder.
Figure 1D:
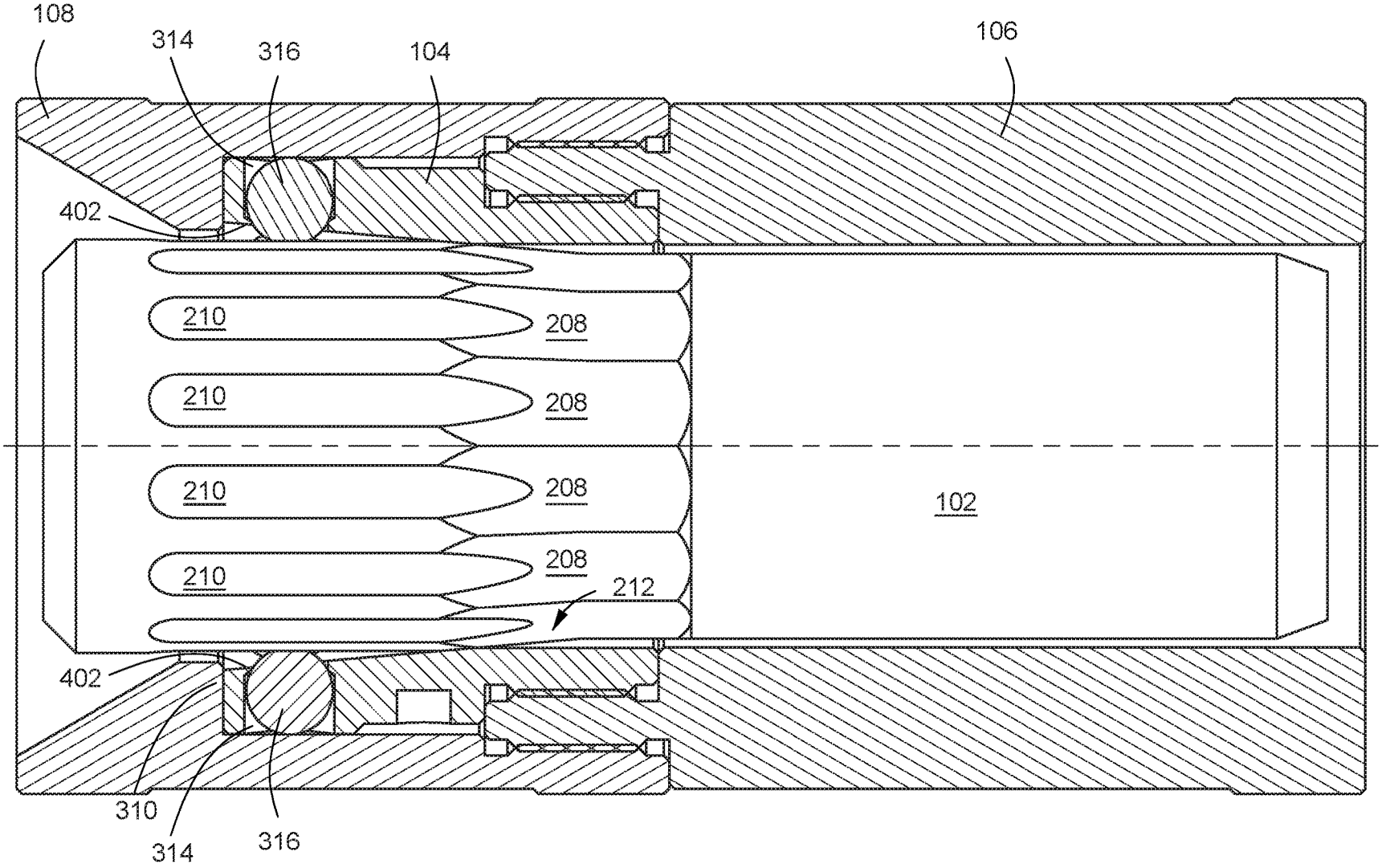
FIG. 1D illustrates a cross-sectional side view of a landing mandrel disposed in a landing seat, upper seat cylinder, and a lower seat cylinder.

FIG. 1C illustrates a perspective cross-sectional view of a landing mandrel 102 disposed in a landing seat 104 and a lower seat cylinder 106. FIG. 1D illustrates a cross-sectional side view of a landing mandrel 102 disposed in a landing seat 104, a lower seat cylinder 106, and an upper seat cylinder 108.

Referring to FIGS. 1C-D, a downhole landing assembly 100 may include a landing mandrel 102 disposed concentrically in a landing seat 104, a lower seat cylinder 106, and an upper seat cylinder 108. The landing seat 104 may have a lower end threadably coupled to an upper end of the lower seat cylinder 106. Additionally, the upper end of the lower seat cylinder 106 may be threadably coupled to a lower end of the upper seat cylinder 108. When the lower seat cylinder 106 and the upper seat cylinder 108 are screwed together, the lower seat cylinder 106 may cause an upper end of the landing seat 104 to be abutted against an upper collar 310. Accordingly, the landing seat 104 may be retained between the lower seat cylinder 106 and the upper seat cylinder 108. Moreover, in some cases, the landing seat 104 may not be moved relative to either the lower seat cylinder 106 or the upper seat cylinder 108.

The landing seat 104 may have a portion disposed concentrically within the upper seat cylinder 108. Accordingly, the landing seat 104 may have a portion disposed concentrically within the lower seat cylinder 106. In some cases, the landing seat 104 may be completely disposed concentrically within the upper seat cylinder 108.

The landing mandrel 102 may have portions, e.g., outer socket surfaces, tapered surfaces, and grooves, disposed within respective central bores of the landing seat 104, the lower seat cylinder 106, and the upper seat cylinder 108. The landing mandrel 102, the landing seat 104, the lower seat cylinder 106, and the upper seat cylinder 108 may share a central axis.

Additionally, in some cases, the landing mandrel 102 may be constructed from a hard material, e.g., stainless steel 304 or 316. The hard material may have a Brinell hardness value of at least 322 and/or Vickers hardness value of at least 335. The landing mandrel may have outer socket surfaces 208 (see FIG. 2). The landing seat 104, on the other hand, may be constructed from a deformable material, e.g., copper or aluminum. The landing seat 104 may have a hardness value, e.g., Brinell value of 76 and/or Vickers value 80, less than that of the landing mandrel 102. The landing seat 104 may have and inner tapered surface. The inner tapered surface may be smooth. Thus, when the landing mandrel 102 is deployed downhole and lands on the inner tapered surface, the harder outer socket surfaces 208 of the landing mandrel 102 would deform the softer inner tapered surface. The inner tapered surface would then have inner socket surfaces corresponding to the outer socket surfaces. The outer socket surfaces 208 of the landing mandrel 102 may be abutted against corresponding inner socket surfaces of the landing seat 104. Hence, in some cases, the landing mandrel 102 may be inhibited from being rotated relative the landing seat 104.

Figure 2:
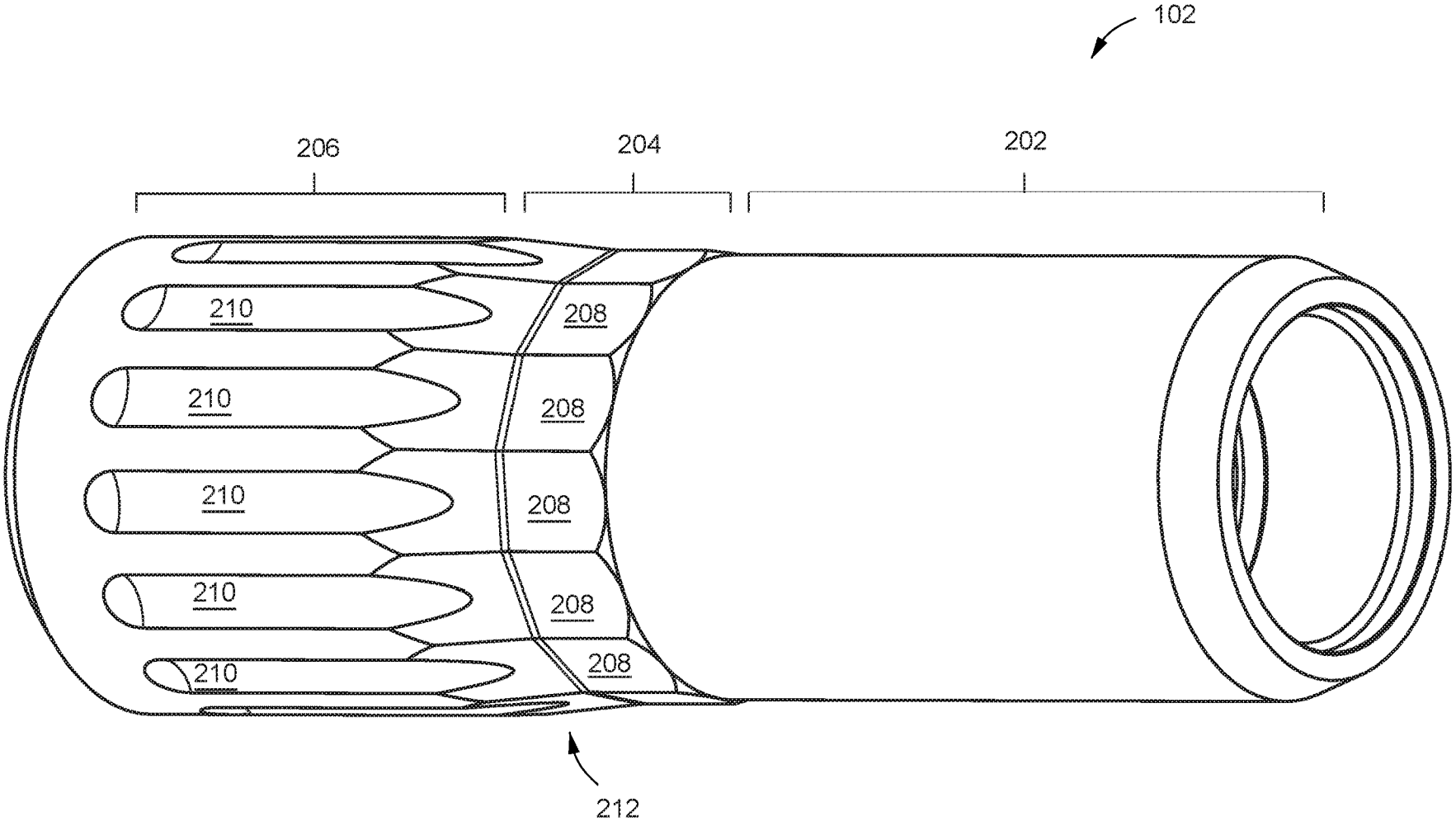
FIG. 2 illustrates a perspective view of a landing mandrel.

FIG. 2 illustrates a perspective view of a landing mandrel 102. The landing mandrel 102 may be cylindrical. The landing mandrel 102 may have an outer surface and an inner surface. The inner surface may define an inner bore. In addition, the landing mandrel 102 may have a lower portion 202, a middle portion 204, and an upper portion 206. The lower portion 202, the middle portion 204, and the upper portion 206 may be unitary. The lower portion 202 may have a first diameter smaller than a second diameter of the middle portion 204. The middle portion 204 may have a second diameter smaller than a third diameter of the upper portion 206.

The middle portion 204 may have outer socket surfaces 208 disposed thereon. The outer socket surfaces 208 may be disposed radially on the middle portion 204. The outer socket surfaces 208 may be planar. The outer socket surfaces 208 may be connected radially to have a polygonal cross-section, e.g., triangular, square, rectangular, pentagonal, hexagonal, heptagonal, octagonal, nonagonal, or decagonal.

Additionally, the outer socket surfaces 208 may extend from the lower portion 202 to the upper portion 206 of the landing mandrel 102. A lower diameter of the middle portion 204 (near the lower portion 202) may be smaller than an upper diameter of the middle portion 204 (near the upper portion 206). Accordingly, the middle portion 204 may have a tapered portion 212 (also see FIG. 1D).

The upper portion 206 of the landing mandrel 102 may have mandrel grooves 210. The mandrel grooves 210 may be disposed in the outer surface of the upper portion 206. The mandrel grooves 210 may extend axially along the upper portion 206. In addition, a portion of each of the mandrel grooves 210 may be disposed in the middle portion 204. Moreover, a portion of each of the mandrel grooves 210 may be disposed in a respective outer socket surface 208 of the landing mandrel 102. Each of the mandrel grooves 210 may receive a ball bearing 316 (see FIG. 4A).

Figure 3A:
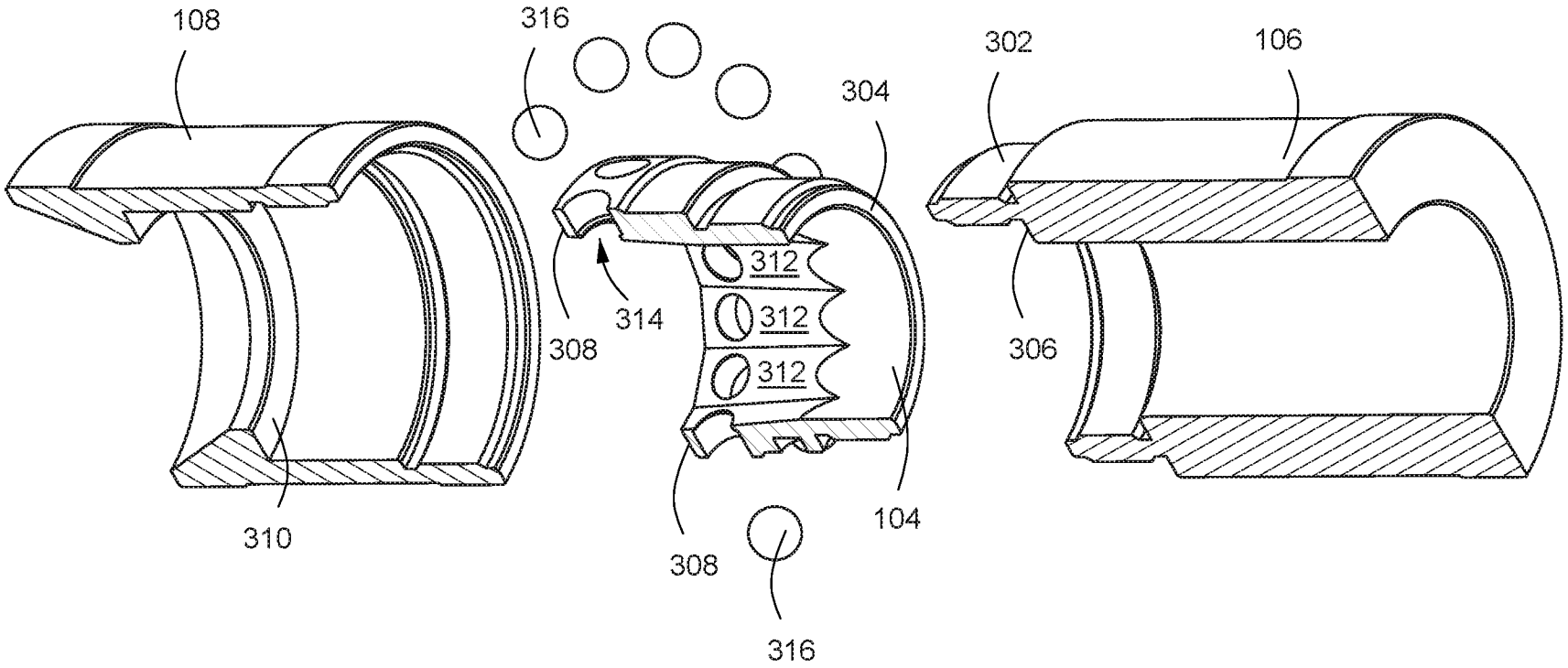
FIG. 3A illustrates a cross-sectional exploded view of a landing seat, a lower seat cylinder, and an upper seat cylinder.
Figure 3B:
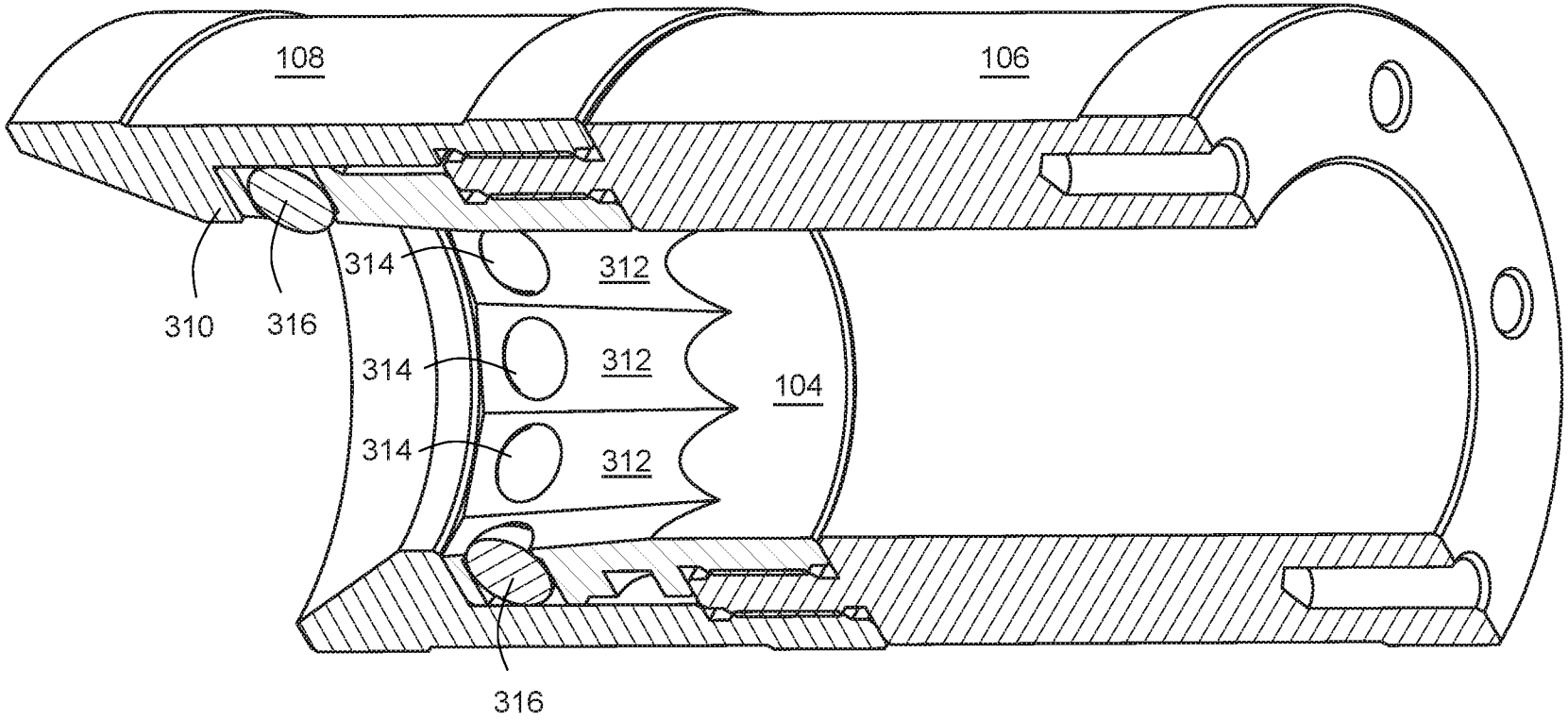
FIG. 3B illustrates a cross-sectional perspective view of a landing seat, a lower seat cylinder, and an upper seat cylinder that are assembled.

FIG. 3A illustrates a cross-sectional exploded view of a landing seat 104, a lower seat cylinder 106, and an upper seat cylinder 108. FIG. 3B illustrates a cross-sectional perspective view of a landing seat 104, a lower seat cylinder 106, and an upper seat cylinder 108 that are assembled.

Referring to FIGS. 3A-B, a lower seat cylinder 106 may have an upper end 302. The upper end 302 may have an inner surface and an outer surface. Box threads of the lower cylinder 106 may be disposed on the inner surface. Pin threads may be disposed on the outer surface. The box threads may be threadably coupled to pin threads disposed on the landing seat 104. The pin threads of the lower cylinder 106 may be threadably coupled to box threads of the upper seat cylinder 108. The box threads of the upper seat cylinder 108 may be disposed at a lower end of the upper seat cylinder 108.

The landing seat 104 may be disposed concentrically within the upper seat cylinder 108. The landing seat 104 may have a lower radial face 304 abutted against a lower inner collar 306 of the lower seat cylinder 106. The landing seat 104 may have an upper radial face 308 abutted against an inner collar 310 of the upper seat cylinder 108. Accordingly, the landing seat 104 may be disposed, e.g., wedged, axially between the lower seat cylinder 106 and the upper seat cylinder 108. Moreover, the landing seat 104 may be fixedly coupled to the lower seat cylinder 106 and the upper seat cylinder 108.

The landing seat 104 may have inner socket surfaces 312 disposed thereon. The inner socket surfaces 312 may be disposed radially on an inner surface of the landing seat 104. The inner socket surfaces 312 may be planar. The inner socket surfaces 312 may be connected radially to have a polygonal cross-section, e.g., triangular, square, rectangular, pentagonal, hexagonal, heptagonal, octagonal, nonagonal, or decagonal.

In addition, the inner socket surfaces 312 may be tapered. From the upper end of the landing seat 104, the inner socket surfaces 312 may extend towards the lower end and the central axis of the landing seat 104. The tapered inner socket surfaces 312 may have portions abutted against portions of outer socket surfaces 208 of a landing mandrel 102 (see FIGS. 1C and 6).

The landing seat 104 may have ball bearing apertures 314 disposed therethrough. The ball bearing apertures 314 may extend through the inner socket surfaces 312, respectively. Thus, the inner socket surfaces 312 may have openings to respective ball bearing apertures 314.

The ball bearing apertures 314 may each have a ball bearing 316 disposed therein. In addition, the openings in the inner sockets surfaces 312 may have widths smaller than diameters of the respective ball bearings 316 disposed therein. Thus, the ball bearings 314 may be retained between the landing seat 104 and an inner surface of the upper seat cylinder 108.

Figure 4A:
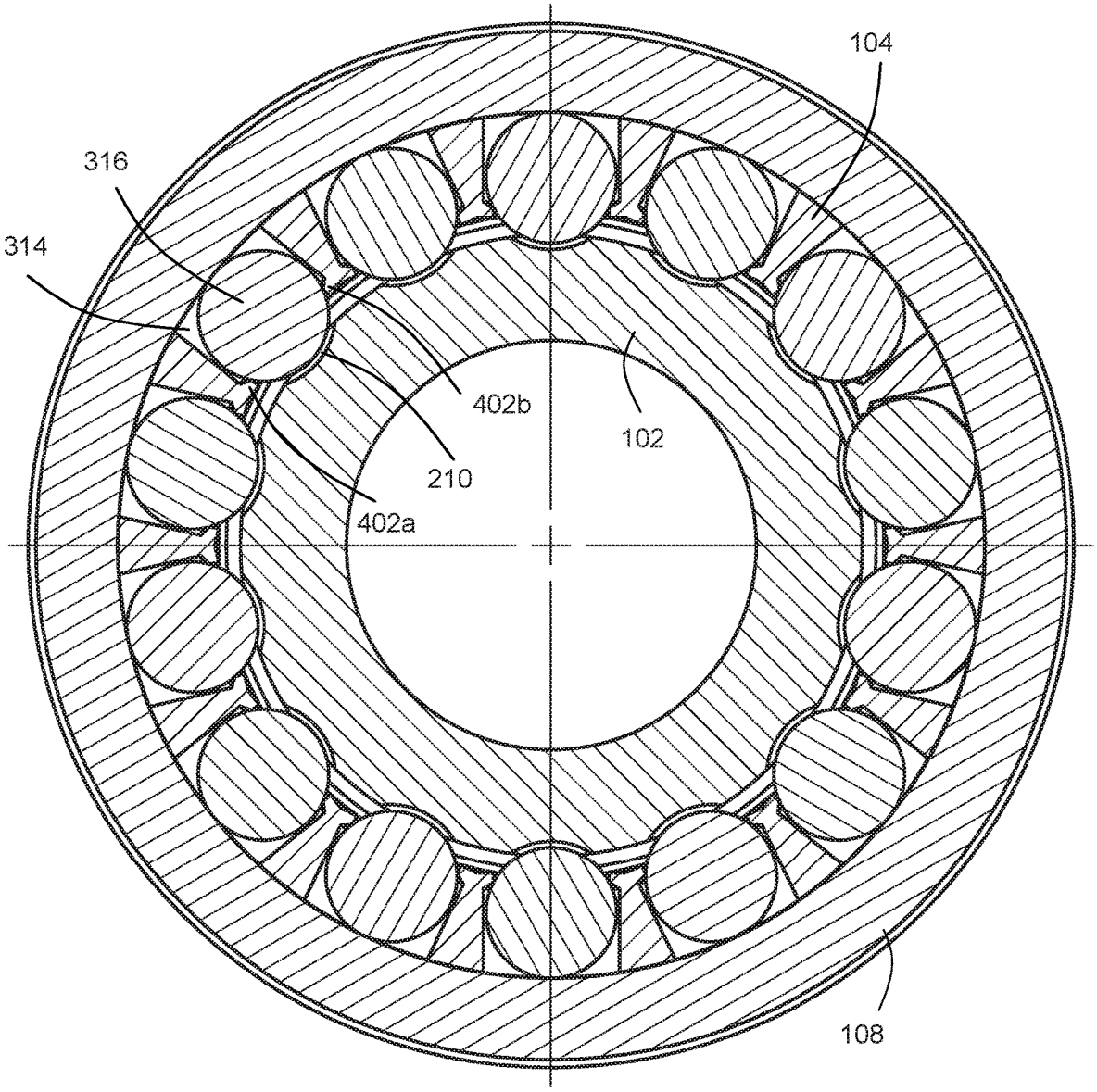
FIG. 4A illustrates a cross-cut view of a downhole landing assembly having a landing mandrel disposed within a landing seat.

FIG. 4A illustrates a cross-cut view of a downhole landing assembly 100 having a landing mandrel 102 disposed within a landing seat 104. The landing seat 104 may be fixedly coupled to an upper seat cylinder 108. The landing seat 104 may have ball bearing apertures 314. The ball bearing apertures 314 may extend through an outer surface and an inner surface of the landing seat 104.

Ball bearings 316 may be disposed in respective ball bearing apertures 314. The ball bearings 316 may be retained between the landing seat 104 and the upper seat cylinder 108. The balling bearings may be rolled freely within their respective ball bearing apertures 314.

Additionally, the landing seat 104 may have shoulders 402*a*, 402*b*. The distance between the shoulders 402*a*, 402*b* may be less than the diameter of a ball bearing 316. Thus, the ball bearing 316 may be abutted against the shoulders 402*a*, 402*b*. Accordingly, in some cases, pairs of shoulders 402*a*, 402*b* may retain the respective ball bearings 316 within their respective ball bearing apertures 314. However, the balling bearings 316 are free to roll in-place while retained between the landing seat 104 and the upper seat cylinder 108.

The landing mandrel 102 may have an outer surface and an inner surface. Mandrel grooves 210 may be disposed in the outer surface. The ball bearings 316 may have portions disposed in respective mandrel grooves 210. Additionally, the ball bearings 316 may each be capable of being abutted against a surface defining each of the mandrel grooves 210. When the landing mandrel 102 is abutted against one or more of the ball bearings 316, the landing mandrel 102 would, in some cases, be inhibited from being rotated relative to the landing seat 104.

Figure 4B:
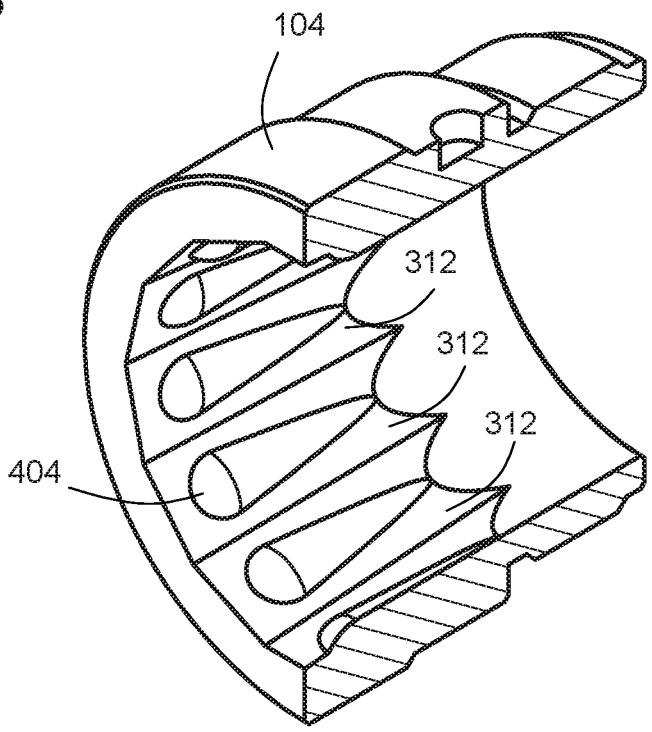
FIG. 4B illustrates a cross-sectional perspective view of a landing seat having knobs.
Figure 4C:
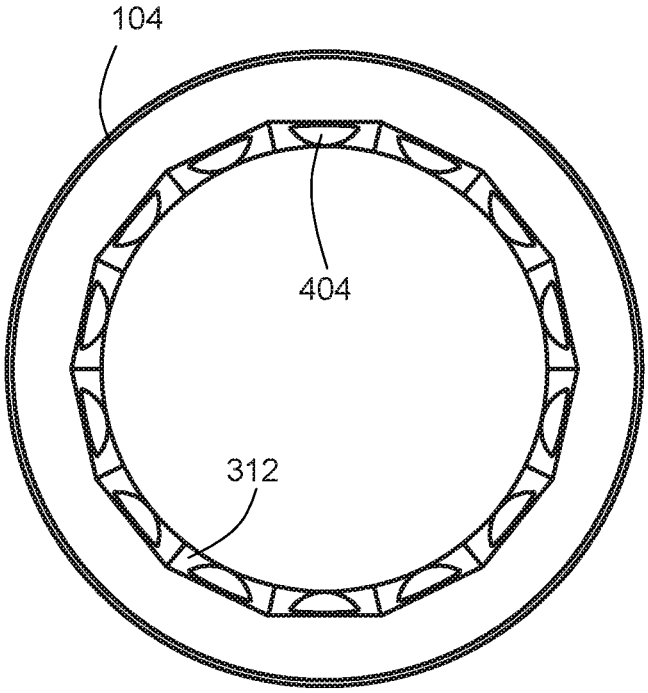
FIG. 4C illustrates a cross-cut view of a landing seat having knobs.

FIG. 4B illustrates a cross-sectional perspective view of a landing seat having knobs. FIG. 4C illustrates a cross-cut view of a landing seat having knobs.

Referring to FIGS. 4B-C, the landing seat 104 may have an inner surface and an outer surface. The inner surface may have knobs 404 extending therefrom. The knobs 404 may extend toward the central axis of the landing seat 104. The knobs 404 may be radiused. The knobs 404 may have spherical cap or teardrop profiles. The knobs 404 may be received in respective mandrel grooves 210 of a landing mandrel 102 (see FIG. 2).

Figure 5:
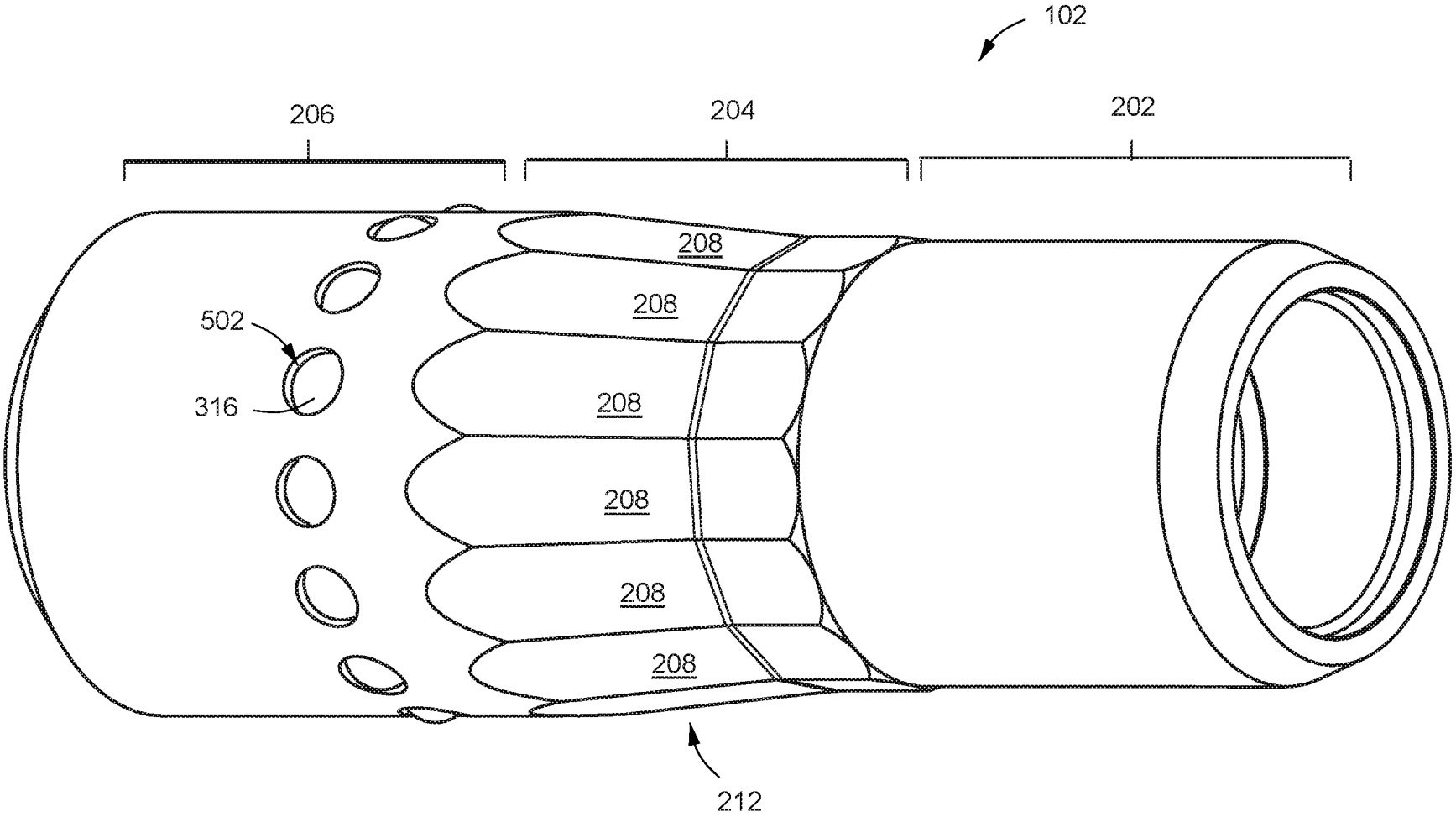
FIG. 5 illustrates a perspective view of a landing mandrel having ball bearings disposed therein.
Figure 6A:
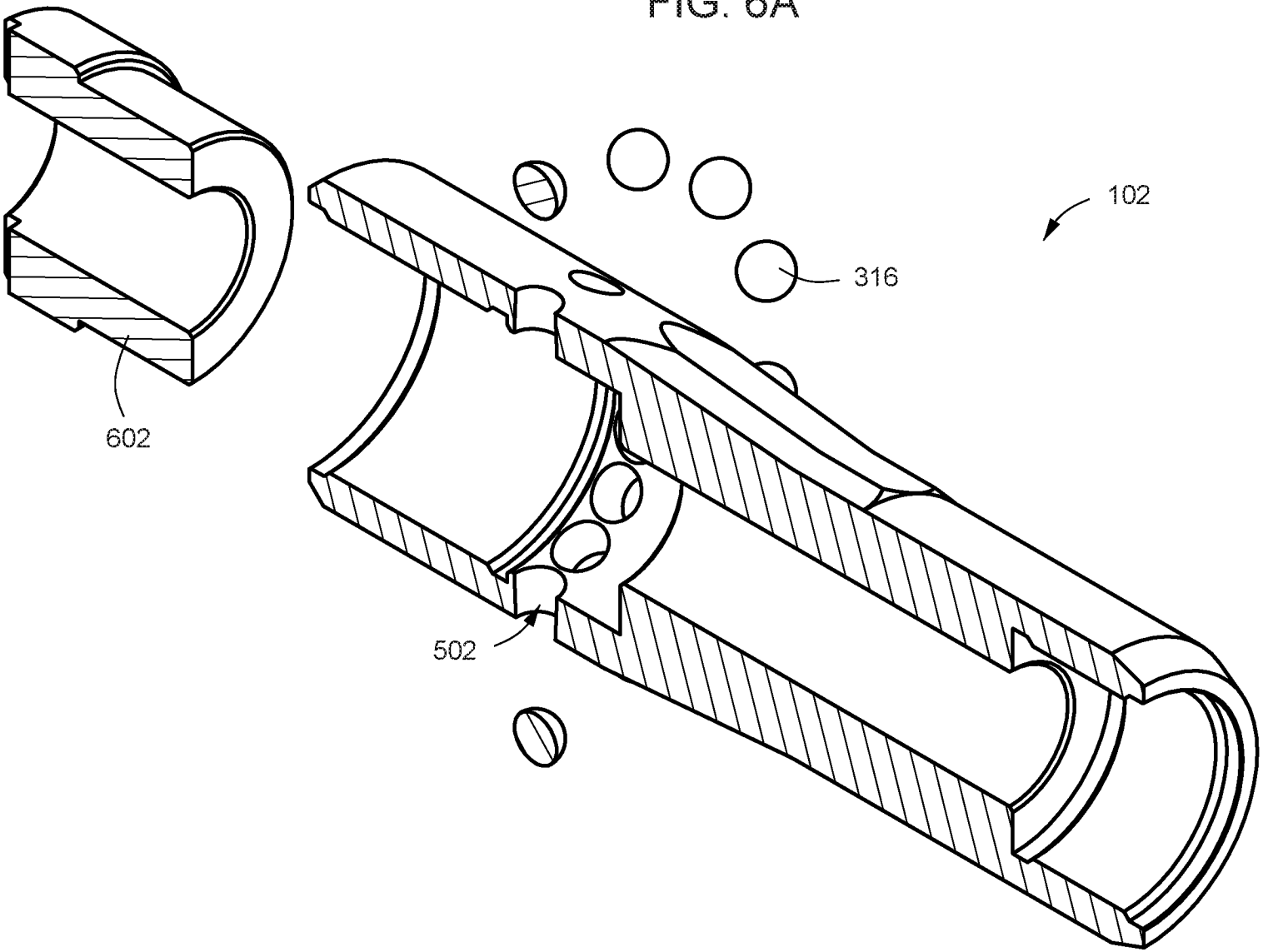
FIG. 6A illustrates a cross-sectional exploded view of a landing mandrel having ball bearings and an inner sleeve.
Figure 6B:
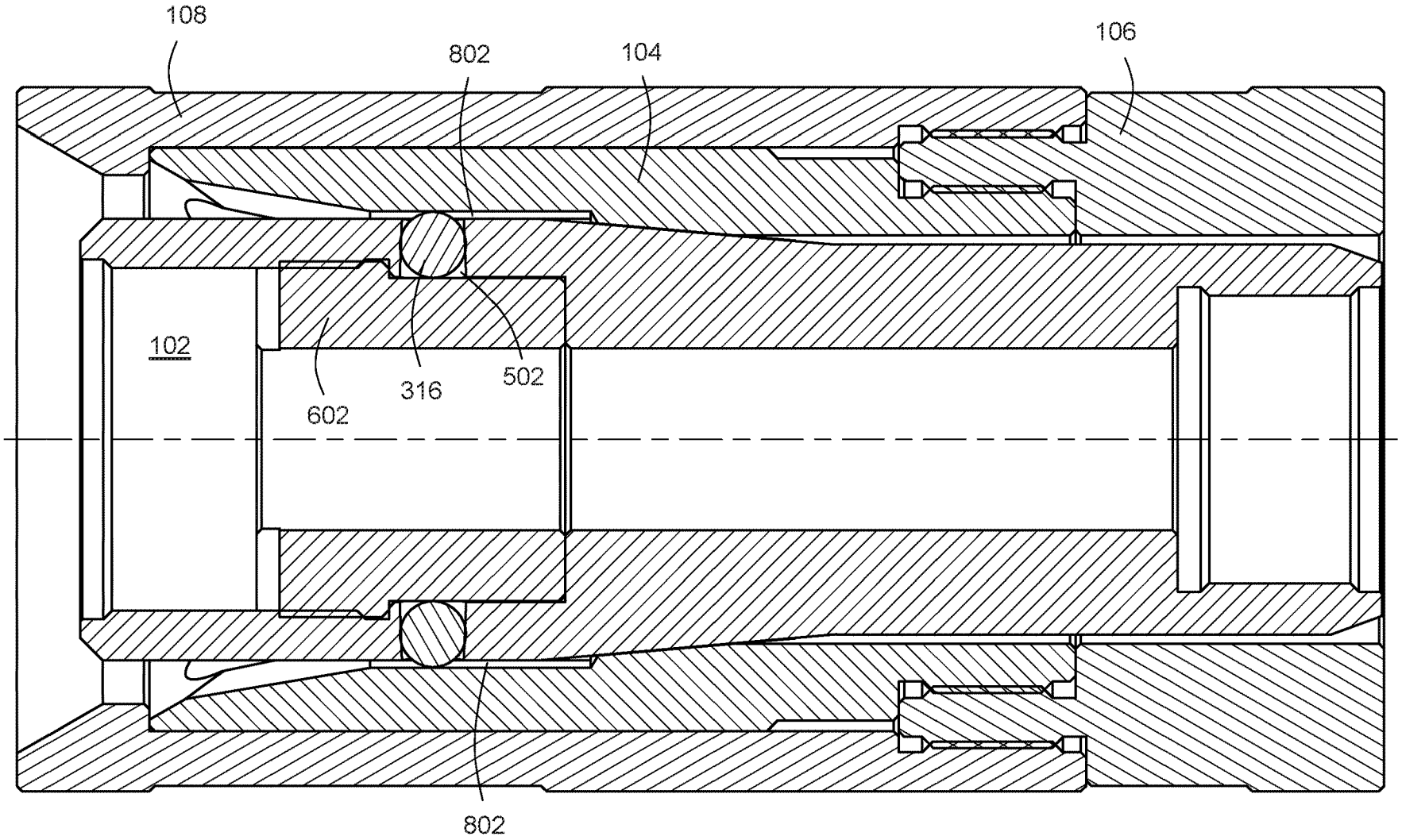
FIG. 6B illustrates a cross-sectional side view of a downhole landing assembly having a landing mandrel disposed in a landing seat, and the landing mandrel having portions of ball bearings disposed in respective ball bearing grooves of the landing seat.

FIG. 5 illustrates a perspective view of a landing mandrel 102 having ball bearings 316 disposed therein. FIG. 6A illustrates a cross-sectional exploded view of a landing mandrel 102 having ball bearing grooves 502 and an inner sleeve 602. FIG. 6B illustrates a cross-sectional side view of a downhole landing assembly 100 having a landing mandrel 102 disposed in a landing seat 104, and the landing mandrel 102 having ball bearings 316 disposed in respective seat grooves 802 of the landing seat 104. The landing seat 104 may be fixedly coupled to an upper seat cylinder 108.

Referring to FIG. 5 and FIGS. 6A-B, a landing mandrel 102 may have an inner surface and an outer surface. The landing mandrel 102 may have a lower portion 202, a middle portion 204, and an upper portion 206. The lower portion 202, the middle portion 204, and the upper portion 206 may be unitary. The lower portion 202 may have a first outer diameter smaller than a second outer diameter of the middle portion 204. The second diameter of the middle portion 204 may be smaller than a third diameter of the upper portion 206. Accordingly, the middle portion 204 may have a tapered portion 212.

Outer socket surfaces 208 may be disposed on the tapered portion 212. Therefore, the outer socket surfaces 208 may be tapered. The outer socket surfaces 208 may extend axially on the middle portion 204 of the landing mandrel 102. Accordingly, the outer socket surfaces 208 may be tapered axially, relative to the central axis of the landing mandrel 102.

Additionally, the outer socket surfaces 208 may be planar. The outer socket surfaces 208 may be arranged, e.g., connected, radially on the tapered portion 212. Thus, the outer socket surfaces 208 may have a polygonal cross-section, e.g., triangular, square, rectangular, pentagonal, hexagonal, heptagonal, octagonal, nonagonal, or decagonal.

Ball bearing apertures 502 may be disposed above the tapered portion 212 of the landing mandrel 102. The ball bearing apertures 502 may extend through the inner surface and the outer socket surface. The ball bearing apertures 502 may receive ball bearings 316, respectively. Portions of the ball bearings 316 may respectively extend through portions of the ball bearing apertures 502 past the outer surface of the landing mandrel 102. The ball bearing apertures 502 may have openings having widths smaller than diameters of the respective balling bearing 316 disposed therein. Thus, in some cases, the ball bearings 316 may be inhibited from egress through the outer surface of the landing mandrel 102.

An inner sleeve 602 may be disposed within the landing mandrel 102. The inner sleeve 602 may be threadably coupled to the landing mandrel 102. The inner sleeve 602 may be concentric with the landing mandrel 102. An outer surface of the inner sleeve 602 may be disposed adjacent the ball bearing apertures 502. Portions of the outer surface of the inner sleeve 602 may be abutted against the ball bearings 316. Thus, in some cases, the ball bearings 316 may be inhibited from egress through the inner surface of the landing mandrel 102. Accordingly, the ball bearing 316 may be retained in the ball bearing apertures 502 between the inner sleeve 602 and the landing mandrel 102. However, the ball bearings 316 may be capable of rolling within the respective ball bearing apertures 502.

Figure 6C:
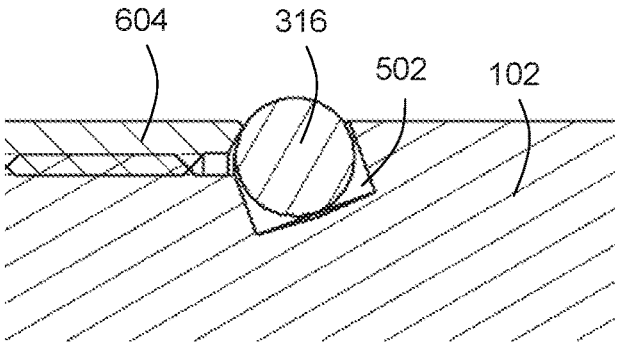
FIGS. 6C-E illustrate cross-sectional and perspective views of ball bearings retained in an outer surface of a landing mandrel.
Figure 6D:
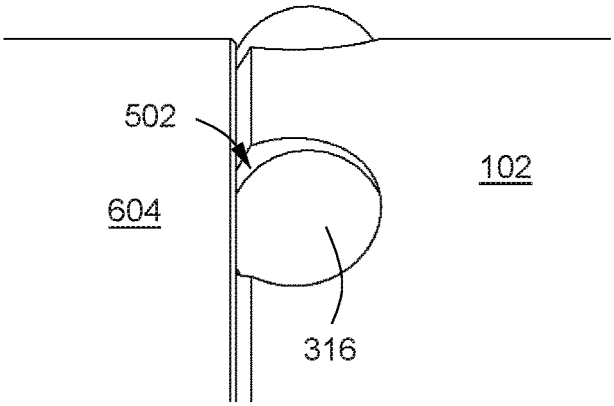
Figure 6E:
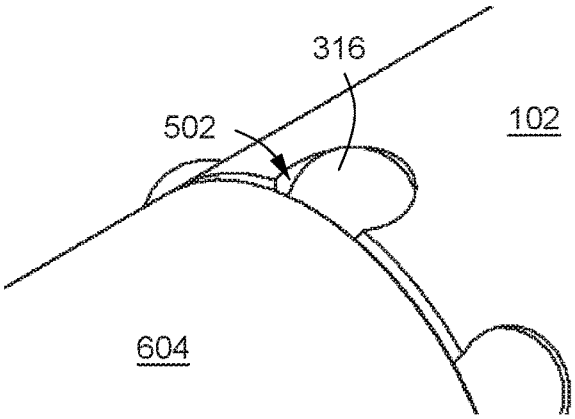

FIGS. 6C-E illustrate cross-sectional and perspective views of one or more ball bearings 316 retained in ball bearing apertures 502 of landing mandrels 102. The ball bearing apertures 502 may extend at an angle, e.g., right-angle or obtuse angle, relative to the central axis of the landing mandrel 102. The ball bearing apertures 502 may extend through an outer surface of the landing mandrel 102.

An outer sleeve 604 may be disposed around a portion of the landing mandrel 102. The outer sleeve 604 may be disposed adjacent the ball bearing apertures 502. Portions of the outer sleeve 604 may partially cover the ball bearing apertures 502. Accordingly, widths of openings in the outer surface of the landing mandrel 102 leading into the ball bearing apertures 502 may be smaller than diameters of the ball bearings 316.

Portions of the outer sleeve 604 may be abutted against the ball bearings 316. Thus, in some cases, the ball bearings 316 may be inhibited from egress through the outer surface of the landing mandrel 102. The ball bearings 316 may be retained in the ball bearing apertures 502 between the outer sleeve 604 and the landing mandrel 102. However, the ball bearings 316 may be capable of rolling within the respective ball bearing apertures 502.

Figure 7A:
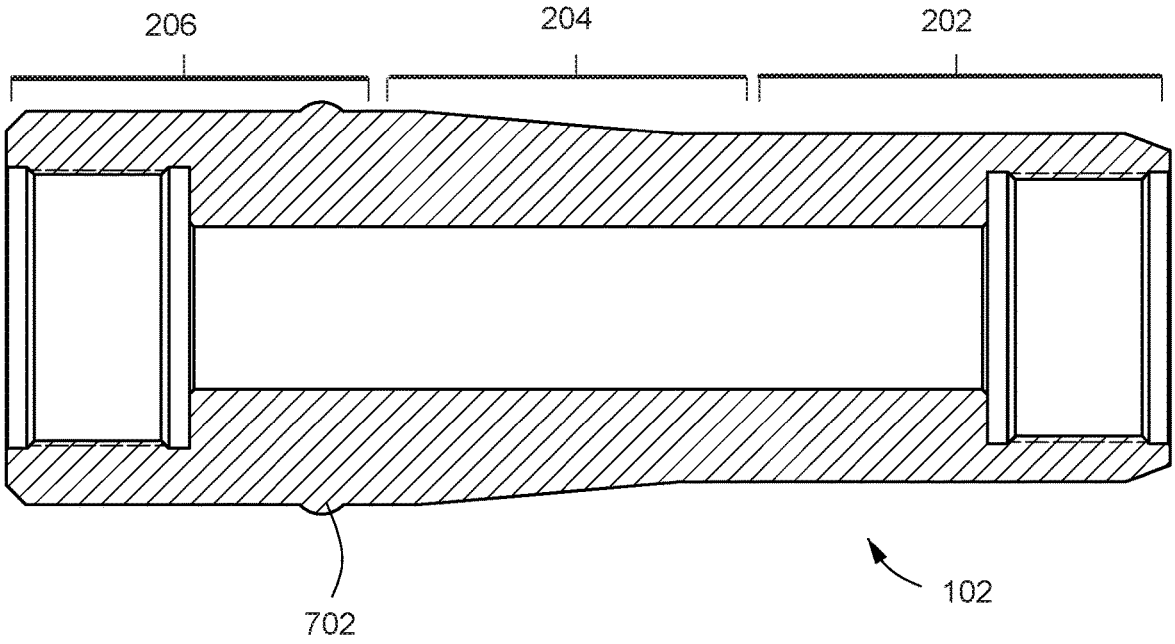
FIG. 7A illustrates a cross-sectional view of a landing mandrel having knobs disposed thereon.
Figure 7B:
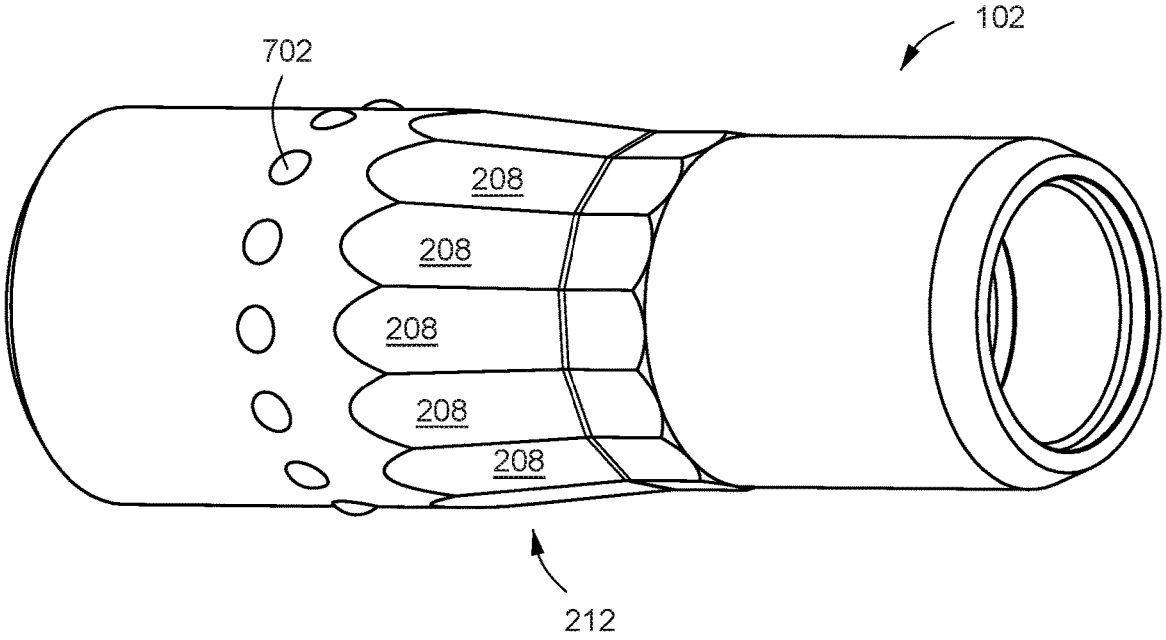
FIG. 7B illustrates a perspective view of a landing mandrel having knobs disposed thereon.

FIG. 7A illustrates a cross-sectional view of a landing mandrel having knobs 702 disposed thereon. FIG. 7B illustrates a perspective view of a landing mandrel having knobs 702 disposed thereon.

Referring to FIGS. 7A-B, a landing mandrel 102 may have an inner surface and an outer surface. The landing mandrel 102 may have a lower portion 202, a middle portion 204, and an upper portion 206. The lower portion 202, the middle portion 204, and the upper portion 206 may be unitary. The lower portion 202 may have a first outer diameter smaller than a second outer diameter of the middle portion 204. The second diameter of the middle portion 204 may be less than a third diameter of the upper portion 206. Accordingly, the middle portion 204 may have a tapered portion 212.

Outer socket surfaces 208 may be disposed on the tapered portion 212. Therefore, the outer socket surfaces 208 may be tapered. The outer socket surfaces 208 may extend axially on the middle portion 204 of the landing mandrel 102. Accordingly, the outer socket surfaces 208 may be tapered axially, relative to the central axis of the landing mandrel 102.

Additionally, the outer socket surfaces 208 may be planar. The outer socket surfaces 208 may be arranged, e.g., connected, radially on the tapered portion 212. Thus, the outer socket surfaces 208 may have a polygonal cross-section, e.g., triangular, square, rectangular, pentagonal, hexagonal, heptagonal, octagonal, nonagonal, or decagonal.

Knobs 702 may extend from the upper portion 206 of the landing mandrel 102. The knobs 702 may extend from the outer surface of the landing mandrel 102. Thus, in some cases, the ball bearings 316 may be inhibited from egress through the outer surface of the landing mandrel 102.

Figure 8A:
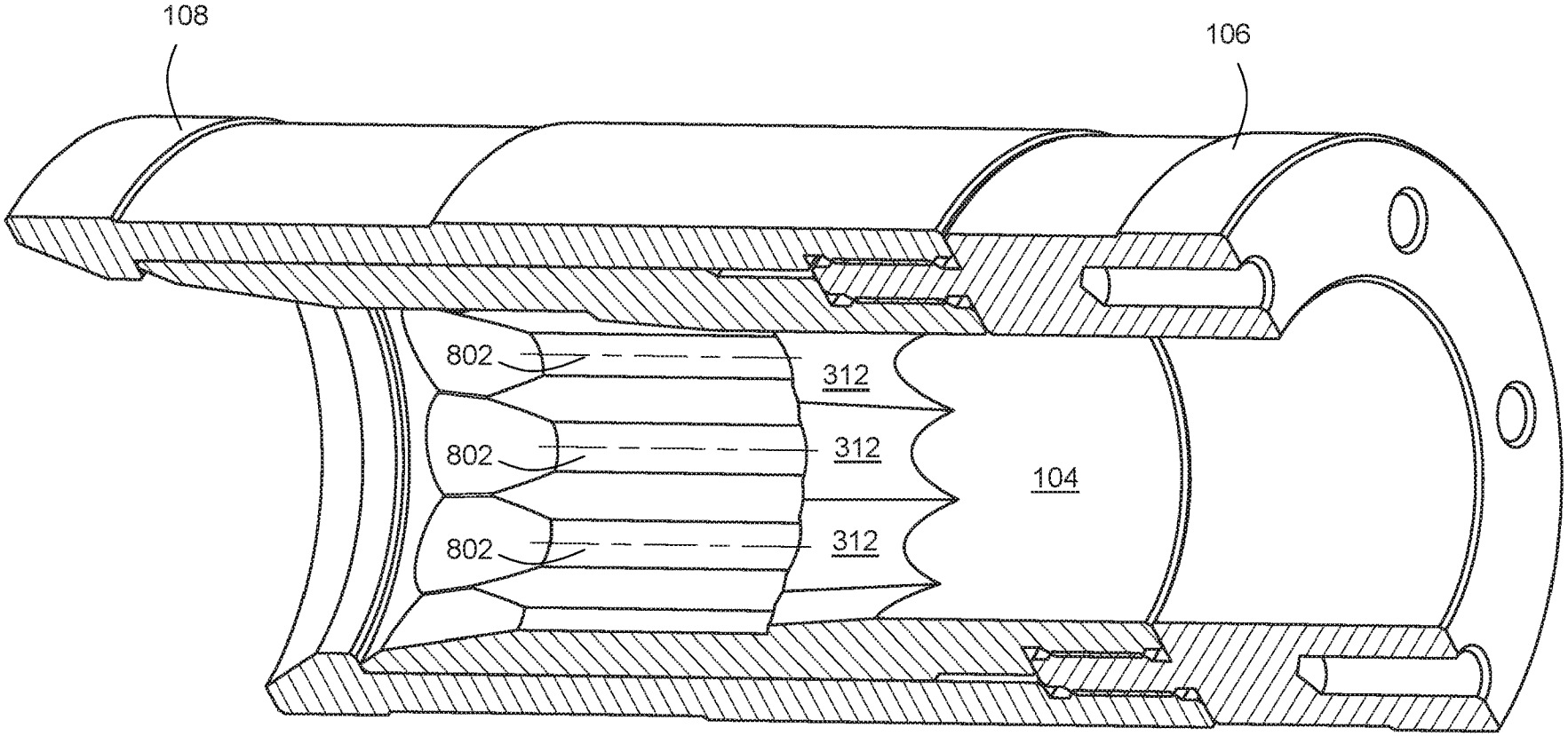
FIG. 8A illustrates a cross-sectional exploded view of a lower seat cylinder, an upper seat cylinder, and a seat that are assembled.
Figure 8B:
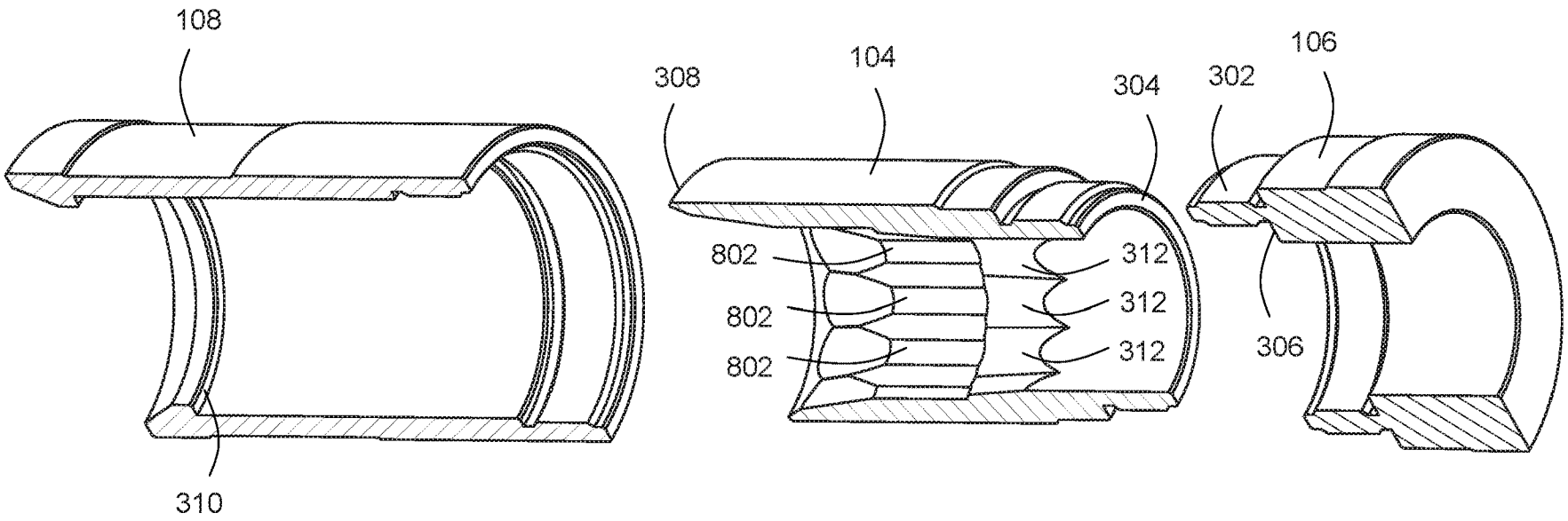
FIG. 8B illustrates a cross-sectional perspective view of a lower seat cylinder, an upper seat cylinder, and a seat assembled.

FIG. 8A illustrates a cross-sectional exploded view of a landing seat 104 having seat grooves 802, a lower seat cylinder 106, and an upper seat cylinder 108. FIG. 8A illustrates a cross-sectional perspective view of a landing seat 104 having seat grooves 802, a lower seat cylinder 106, and an upper seat cylinder 108 assembled. Referring to FIGS. 8A-B, a lower seat cylinder 106 may have an upper end 302. The upper end 302 may have an inner surface and an outer surface. Box threads may be disposed on the inner surface. Pin threads may be of the outer surface. The box threads may be threadably coupled to pin threads of the landing seat 104. The pin threads may be threadably coupled to box threads disposed on an upper seat cylinder 108.

The landing seat 104 may be disposed concentrically within the upper seat cylinder 108. The landing seat 104 may have a lower radial face 304 abutted against a lower inner collar 306 of a lower seat cylinder 106. The landing seat 104 may have an upper radial face 308 abutted against the upper inner collar 310 of the upper seat cylinder 108. Accordingly, the landing seat 104 may be disposed, e.g., wedged, axially between the lower seat cylinder 106 and the upper seat cylinder 108. Moreover, the landing seat 104 may be fixedly coupled to the lower seat cylinder 106 and the upper seat cylinder 108.

The landing seat 104 may have inner socket surfaces 312 disposed thereon. The inner socket surfaces 312 may be disposed radially on the landing seat 104. The inner socket surfaces 312 may be planar. The inner socket surfaces 312 may be connected radially to have a polygonal cross-section, e.g., triangular, square, rectangular, pentagonal, hexagonal, heptagonal, octagonal, nonagonal, or decagonal.

In addition, the inner socket surfaces 312 may have a tapered portion. From the upper end of the landing seat 104, the inner socket surfaces 312 extends towards the lower end and the central axis of the landing seat 104. The tapered inner socket surfaces 312 may have portions abutted against portions of outer socket surfaces 208 of a landing mandrel 102 (see FIG. 6B).

Seat grooves 802 may be disposed in an inner surface of the landing seat 104. The grooves 802 may be aligned, e.g., axially, with the inner socket surfaces 312. Accordingly, the number of grooves 802 may equal the number of inner socket surfaces 312.

Figure 9:
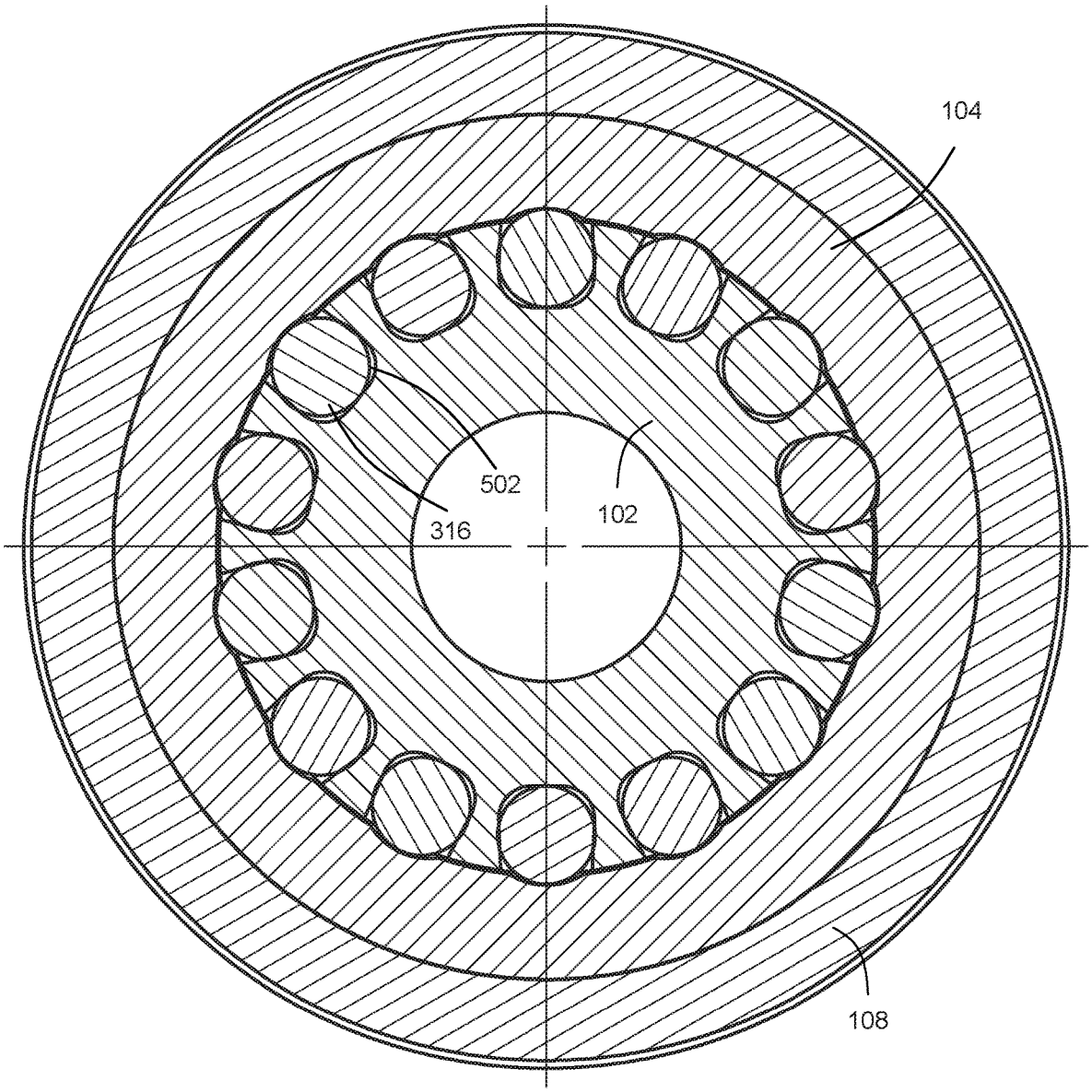
FIG. 9 illustrates a cross-cut view of a downhole landing assembly having a landing mandrel having ball bearings disposed in respective grooves of a landing seat.

FIG. 9 illustrates a cross-cut view of a downhole landing assembly 100 having a landing mandrel 102 having ball bearings 316 disposed in respective seat grooves 802 of a landing seat 104. The landing seat 104 may be fixedly coupled to an upper seat cylinder 108.

The landing mandrel 102 may have an outer surface and an inner surface. The landing mandrel 102 may have ball bearing apertures 502 disposed through the outer surface. The ball bearings 316 may be disposed in the ball bearing apertures 502, respectively. The ball bearings 316 may be retained between the landing seat 104 and the upper seat cylinder 108 by an inner sleeve 602 (see FIG. 6) and/or an outer sleeve 604 (see FIGS. 6C-D). The balling bearings may be rolled in-place while retained between the landing seat 104 and the upper seat cylinder 108.

The landing seat 104 may have an outer surface and an inner surface. Seat grooves 802 may be disposed in the inner surface. The ball bearings 316 disposed in the landing mandrel 102 may have portions disposed in the respective seat grooves 802. Additionally, the ball bearings 316 may be capable of being abutted against respective surfaces defining the seat grooves 802 on the landing seat 104. When one or more of the ball bearings 316 are abutted against one or more inner surfaces of the landing seat 104, the landing mandrel 102 would, in some cases, be inhibited from rotation relative to the landing seat 104.

Figure 10:
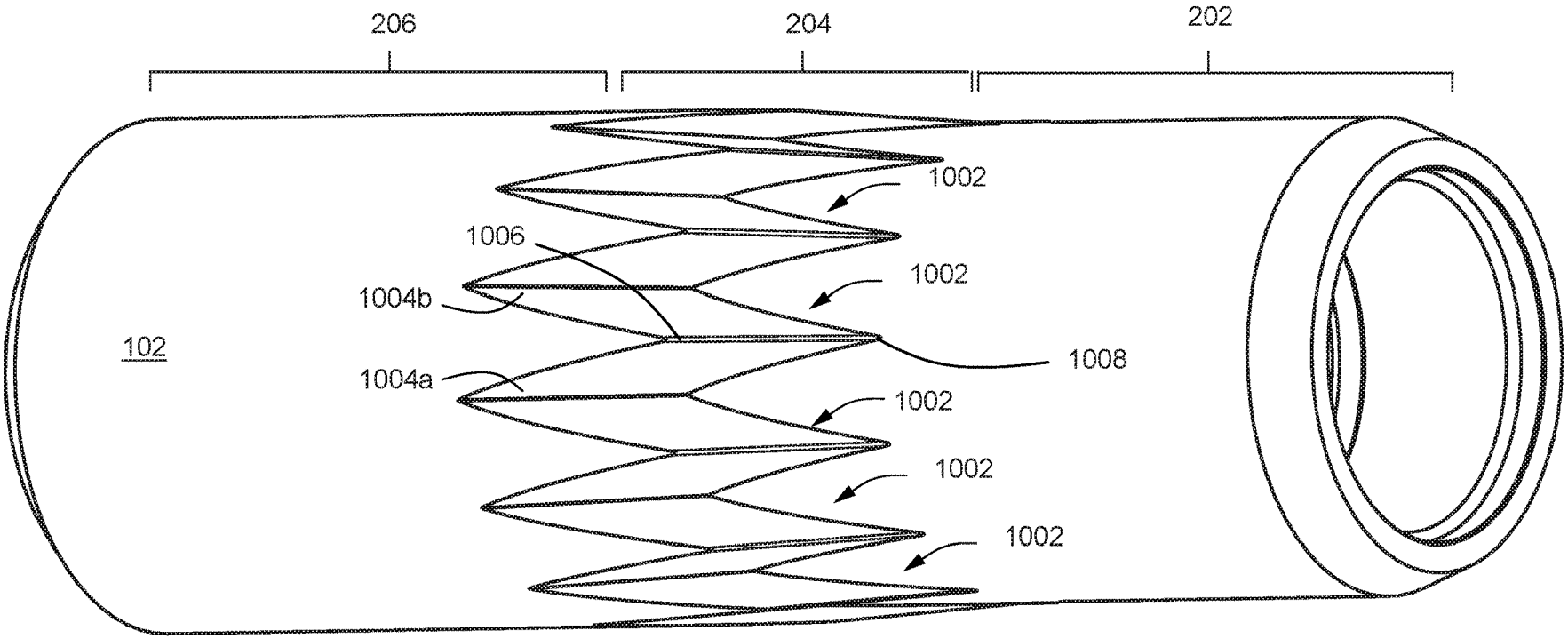
FIG. 10 illustrates a perspective view of a landing mandrel having splines.

FIG. 10 illustrates a perspective view of a landing mandrel 102 having outer splines 1002. The landing mandrel 102 may be cylindrical. The landing mandrel 102 may have an outer surface and an inner surface. The inner surface may define an inner bore therethrough.

The landing mandrel 102 may have a lower portion 202, a middle portion 204, and an upper portion 206. The lower portion 202, the middle portion 204, and the upper portion 206 may be unitary. The lower portion 202 may have a first diameter smaller than a second diameter of the middle portion 204. The middle portion 204 may have a second diameter smaller than a third diameter of the upper portion 206.

The middle portion 204 may have outer splines 1002. The outer splines 1002 may be disposed and/or connected radially around the central axis of the landing mandrel 102.

Each outer spline 1002 may have two spline surfaces 1004*a*, 1004*b*. Each spline surface 1004 may be polygonal, e.g., triangular, square, rectangular, rhomboidal, or trapezoidal. Each spline surface 1004 may be planer. The spline surface 1004*a* may extend from the outer surface of the landing mandrel 102 at a first obtuse angle. The spline surface 1004*b* may extend from the outer surface of the landing mandrel 102 at an opposing second obtuse angle. Thus, on each outer spline 1002, the two spline surfaces 1004*a*, 1004*b* may intersect. Accordingly, the two spline surfaces 1004*a*, 1004*b* may share a spline edge 1006. The spline edge 1006 may be straight or curved. The spline edge 1006 may be directed towards the central axis of the landing mandrel 102. Additionally, the two spline surfaces 1004*a*, 1004*b* may share a point 1008. Thus, as shown in FIG. 10, the two spline surfaces 1004*a*, 1004*b* may form a chevron.

The outer splines 1002 may be aligned radially around the central axis of the landing mandrel 102 to have a polygonal cross-section, e.g., square, rectangular, pentagonal, hexagonal, heptagonal, octagonal, nonagonal, or decagonal.

Additionally, the outer splines 1002 may extend from the lower portion 202 to the upper portion 206 of the landing mandrel 102. A lower diameter of the middle portion 204 (near the points 1008 of outer splines 1002) may be less than an upper diameter of the middle portion 204 (near the upper portion 206). Accordingly, the middle portion 204 may be tapered.

Figure 11A:
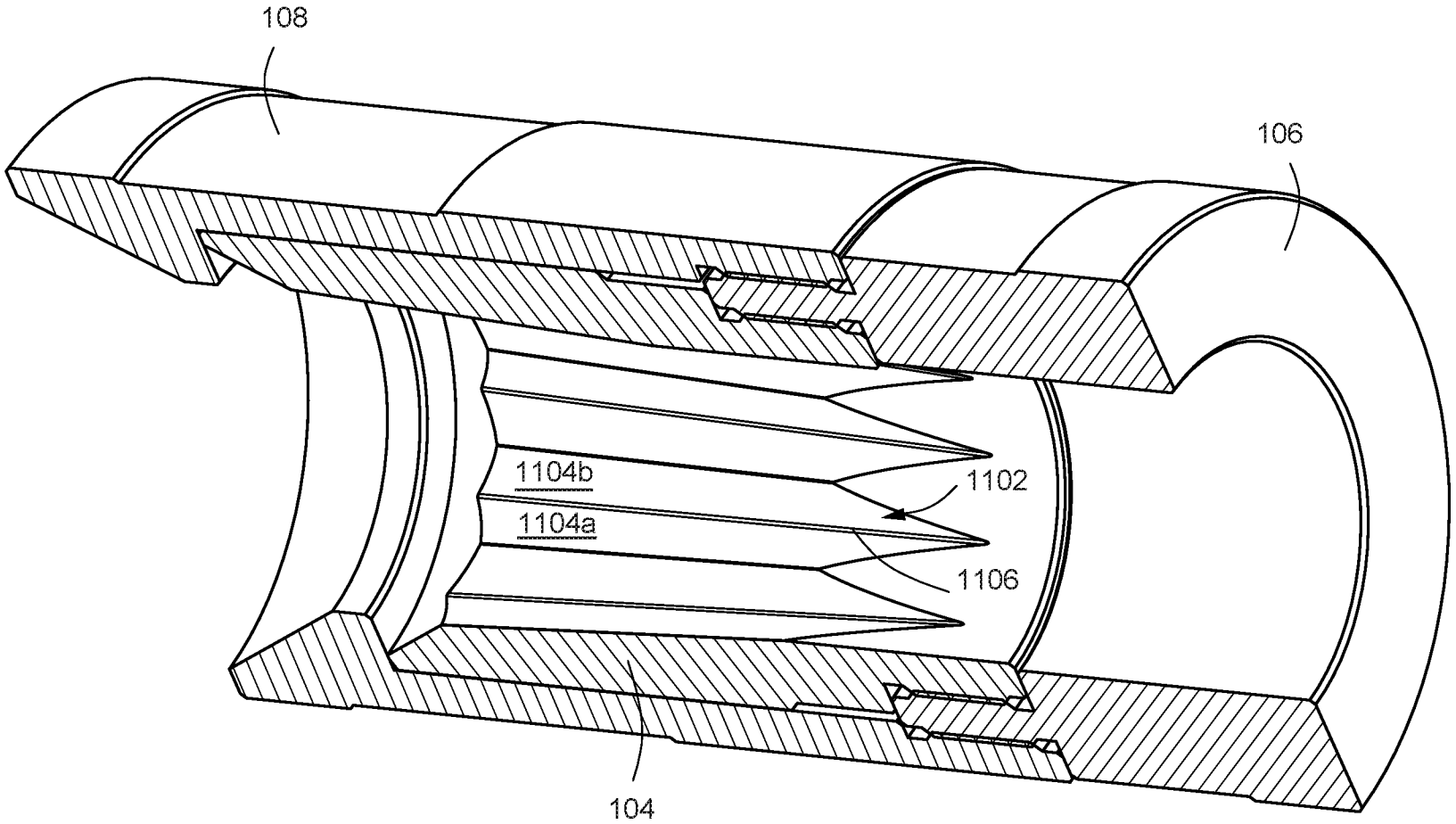
FIG. 11A illustrates an exploded cross-sectional view of a landing seat having socket walls, a lower seat cylinder, and an upper seat cylinder.
Figure 11B:
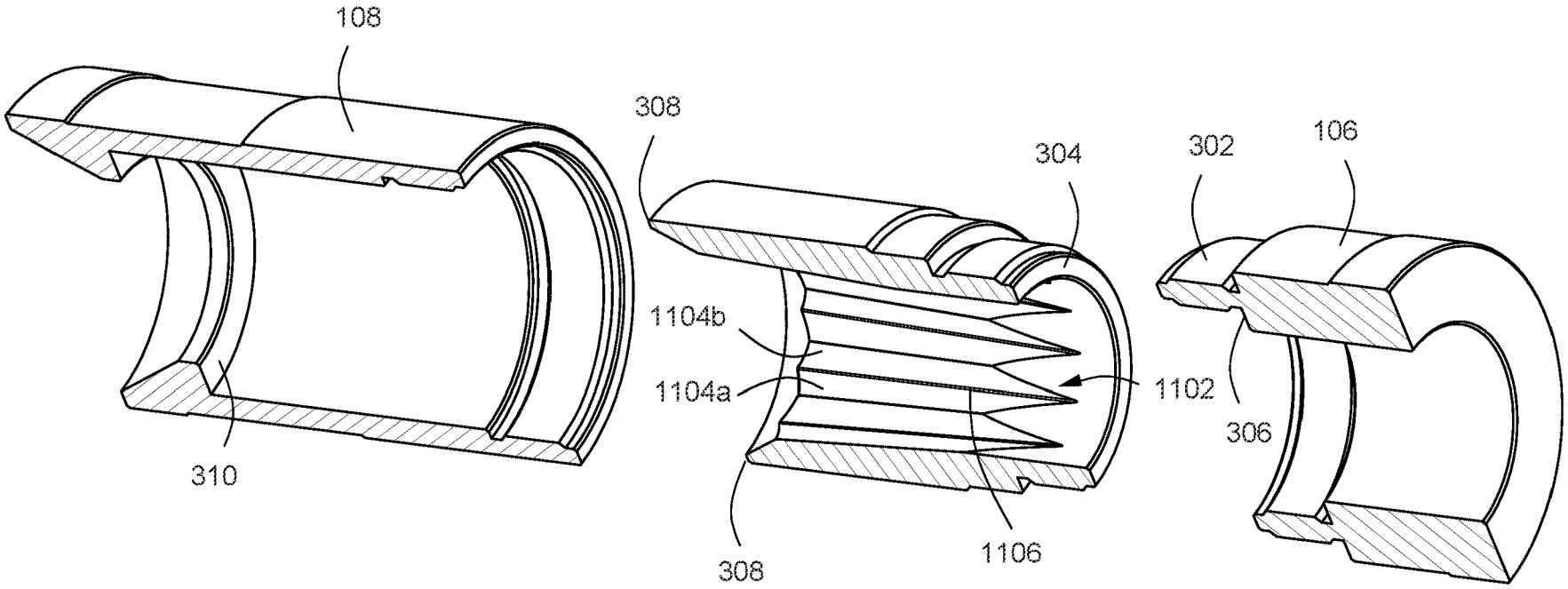
FIG. 11B illustrates a cross-sectional perspective view of a landing seat having socket walls, a lower seat cylinder, and an upper seat cylinder that are assembled.

FIG. 11A illustrates an exploded perspective view of a landing seat 104 having inner socket walls 1102, a lower seat cylinder 106, and an upper seat cylinder 108. FIG. 11B illustrates a cross-sectional perspective view of a landing seat 104, a lower seat cylinder 106, and an upper seat cylinder 108 that are assembled. Referring to FIGS. 11A-B, the lower seat cylinder 106 may have an upper end 302. The upper end 302 may have an inner surface and an outer surface. Box threads may be disposed on the inner surface. Pin threads may be disposed on the outer surface. The box threads may be threadably coupled to pin threads disposed on the landing seat 104. The pin threads may be threadably coupled to box threads disposed on the upper seat cylinder 108.

The landing seat 104 may be disposed concentrically within the upper seat cylinder 108. The landing seat 104 may have a lower radial face 304 abutted against a lower inner collar 306 of the lower seat cylinder 106. The landing seat 104 may have an upper radial face 308 abutted against the upper inner collar 310 of the upper seat cylinder 108. Accordingly, the landing seat 104 may be disposed, e.g., wedged, axially between the lower seat cylinder 106 and the upper seat cylinder 108. Moreover, the landing seat 104 may be fixedly coupled to the lower seat cylinder 106 and the upper seat cylinder 108.

Each inner socket wall 1102 on the inner surface of the landing seat 104 may have two socket surfaces 1104*a*, 1104*b*. Each inner socket surface 1104 may be planar. In addition, the two socket surfaces 1104*a*, 1104*b* may intersect. Accordingly, the two socket surfaces 1104*a*, 1104*b* may share an edge 1106.

Figure 12:
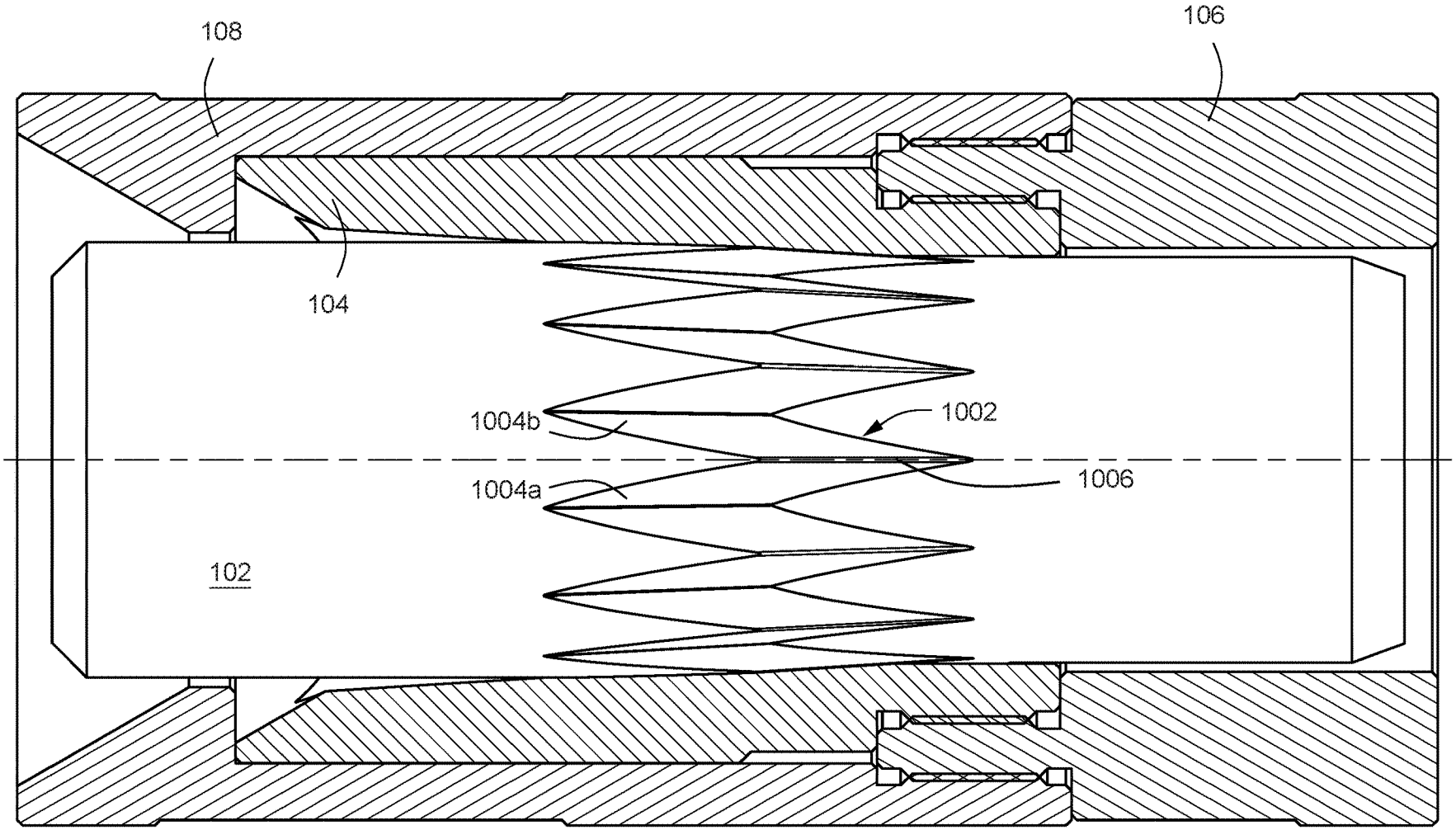
FIG. 12 illustrates a cross-sectional side view of a downhole landing assembly that includes a landing mandrel having portions disposed in a landing seat, a lower seat cylinder, and an upper seat cylinder, on which the landing mandrel has outer splines.
Figure 13:
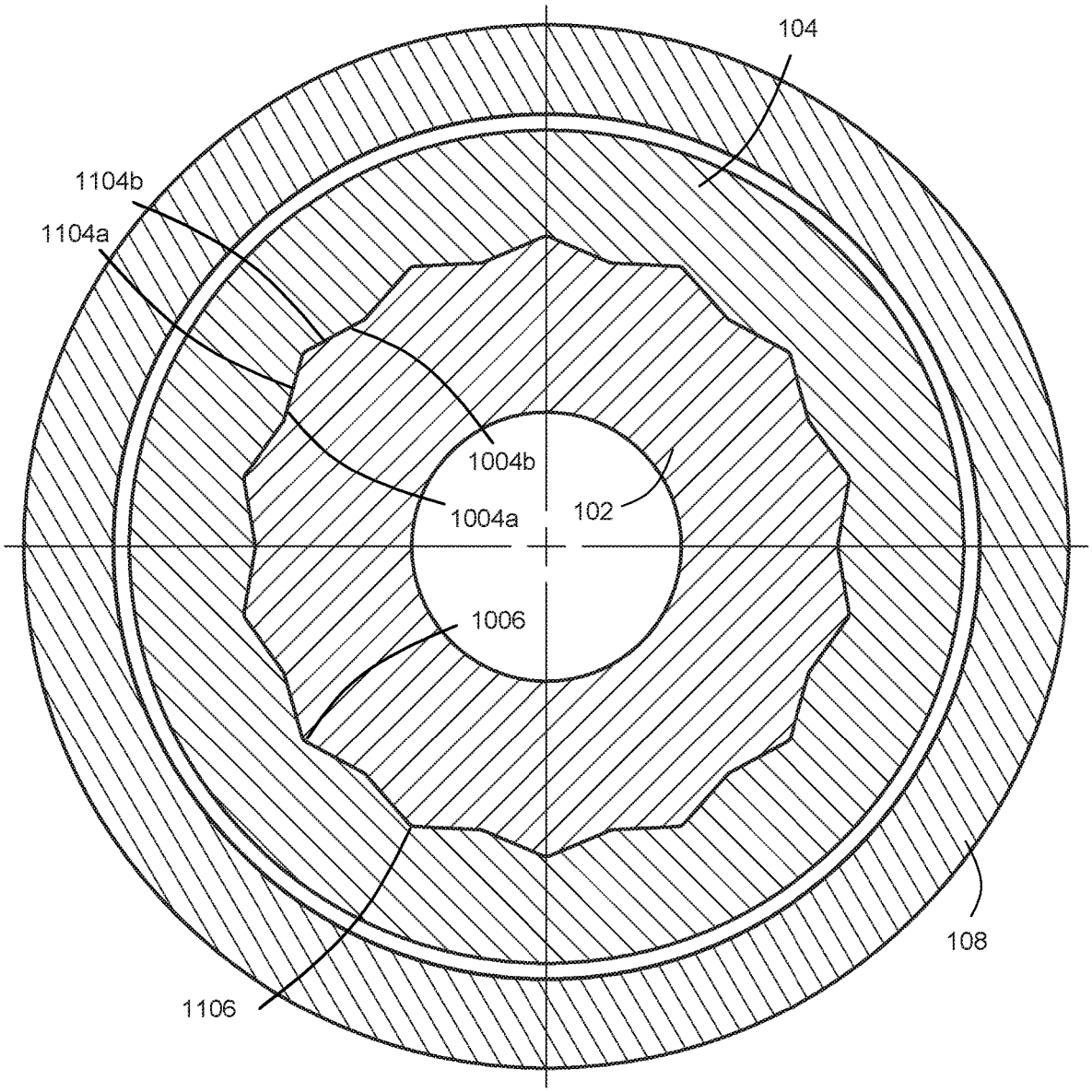
FIG. 13 illustrates a cross-sectional side view of a downhole landing assembly that includes a landing mandrel having portions disposed adjacent inner socket walls of a landing seat, in which the landing mandrel has outer splines.

FIG. 12 illustrates a cross-sectional side view of a downhole landing assembly 100 that includes a landing mandrel 102 having portions disposed in a landing seat 104, a lower seat cylinder 106, and an upper seat cylinder 108, in which the landing mandrel 102 has outer splines 1002. FIG. 13 illustrates a cross-sectional side view of a downhole landing assembly that includes a landing mandrel 102 having portions, e.g., splines, disposed adjacent inner socket walls 1102 of a landing seat 104. Referring to FIG. 12 and FIG. 13, a landing mandrel 102 may have outer splines 1002. Each of the outer splines 1004 may have two spline surfaces 1004*a*, 1004*b*. The two spline surfaces 1004*a*, 1004*b* may be abutted against respective inner socket surfaces 1104*a*, 1104*b* (see FIGS. 11A-B) of an inner socket wall 1102 of a landing seat 104. In some cases, the inner socket surfaces 1104*a*, 1104*b* may inhibit the landing mandrel 102 from rotating relative to the landing seat 104.

To perform certain operations downhole, operators may deploy and/or position certain tools, e.g., frac tools, cutting tools, perforators, and "fishing" tools, in downhole tubular strings. Various versions of downhole landing assemblies 100 discussed herein may be useful in downhole operations. The tools may be coupled to landing mandrels 102 of the landing assemblies 100. The downhole tubular string may have landing seats 104 of the landing assemblies coupled thereto.

Referring to the views of FIGS. 1-13, an operator may couple landing mandrels 102 to landing seats 104 in various ways based on the various configurations described above. The landing seats 104, lower seat cylinders 106, and upper seat cylinders 108 may be coupled to downhole tubular strings. The downhole tubular strings may be "tripped" underground along with the landing seats 104, the lower seat cylinders 106, and the upper seat cylinders 108.

Subsequently, downhole operations may require deploying certain tools from surface down the downhole tubular strings. The tools may include landing mandrels 102 coupled thereto. The operator may place the tools into an opening of the downhole tubular string at the surface. The operator may release the tools without pumping any fluid. Gravity may cause the tools to fall down the downhole tubular string. Preferably, the operator may pump the tools along with fluid down the downhole tubular string at a pump down fluid flow rate. The pump down fluid flow rate may range from as low as 5, 10, 20, 30, 40 gallons per minute to as high as 45, 50, 55 gallons per minute or higher. The tools may be pushed (via the fluid) down the downhole until the landing mandrels 102 on the tool is landed on landing seats 104. The tools may be positioned within the downhole tubular strings based on coupling between the landing mandrels 102 and the landing seats 104. Various methods for coupling the landing mandrels 102 and the landing seats 104 are discussed below.

Referring to the views of FIGS. 1-4, a landing mandrel 102 may be coupled to a landing seat 104 having ball bearings 316 as follow. After deployment of the landing mandrel 102 as similarly discussed above, portions of the landing mandrel 102 may be slid into the landing seat 104, a lower seat cylinder 106, and an upper cylinder 108. In some cases, ball bearings disposed on the landing seat 104 may not be aligned with respective mandrel grooves 210 on the landing mandrels 102. The downward-moving landing mandrel 102 may have outer socket surfaces 208 of a middle portion 204 of the landing mandrel slid and/or abutted against the ball bearings 316. The ball bearings 316 would roll, e.g., in-place, when the outer socket surfaces 208 are slid against them. Accordingly, the landing mandrel 102 may continue traveling downward until mandrel grooves 210 receive respective portions of the ball bearings 316. Furthermore, the landing mandrel may rotate relative to the ball bearing 316. Accordingly, the ball bearing 316 and the mandrel grooves 210 may become aligned. Moreover, outer socket surfaces 208 of the landing mandrel may be aligned with inner socket surfaces 312 of the landing seat 104.

The landing mandrel 102 may continue moving downward until outer tapered portions of a middle portion 204 of the landing mandrel 102 are abutted against inner tapered portions of the landing seat 104. In some cases, the inner tapered portions may inhibit further downward movement of the landing mandrel 102. Thus, the landing mandrel 102 may be said to be in a landed position on the landing seat 104. In the landed position, the landing mandrel 102 may have 1) a lower portion 202 disposed concentrically in the lower seat cylinder 106, 2) the middle portion 204 disposed concentrically in the seat 104, 3) mandrel grooves 210 receive respective ball bearings 316, and 4) outer socket surfaces 208 aligned and/or abutted against inner socket surfaces 312.

It should be understood that a landing seat 104 having knobs 404 (see FIG. 4B-C) may be substituted for the landing seat 104 having ball bearings 316. The knobs 404, similar to the ball bearings 316, would be received in the mandrel grooves 210. The knobs 404 may be abutted against surfaces that define the mandrel grooves 210 of the of the landing mandrel 102 and, in some cases, may inhibit rotation of the landing mandrel 102 relative to the landing seat 104.

Referring to the views of FIGS. 5-9, an operator may perform the following steps to couple a landing mandrel 102 having ball bearings 316 to a landing seat 104 disposed in a wellbore as follow. After deployment of the landing mandrel 102 as similarly discussed above, portions of the landing mandrel 102 may be slid into the landing seat 104, a lower seat cylinder 106, and an upper cylinder 108. In some cases, ball bearings disposed on the landing mandrel 102 may not be aligned with respective seat grooves 802 on the landing seat 104. The ball bearings 316 may roll, e.g., in-place, when the outer socket surfaces 208 are slid against them. Accordingly, the landing mandrel 102 may continue traveling downward until seat grooves 802 receive respective portions of the ball bearings 316. Furthermore, the ball bearings 316 may rotate relative to the landing mandrel 102. Accordingly, the ball bearing 316 and the seat grooves 802 may become aligned. In turn, outer socket surfaces 208 of the landing mandrel may be aligned with inner socket surfaces 312 of the landing seat 104.

The landing mandrel 102 may continue moving downward until outer tapered portions of a middle portion 204 of the landing mandrel 102 are abutted against inner tapered portions of the landing seat 104. In some cases, the inner tapered portions may inhibit further downward movement of the landing mandrel 102. Thus, the landing mandrel 102 may be said to be in a landed position on the landing seat 104. In the landed position, the landing mandrel 102 may have 1) a lower portion 202 disposed concentrically in the lower seat cylinder 106, 2) the middle portion 204 disposed concentrically in the seat 104, 3) ball bearings 316 received in respective seat grooves 802 of the landing seat 104, and 4) outer socket surfaces 208 aligned and/or abutted against inner socket surfaces 312.

The ball bearings 316 may be abutted against surfaces that define the seat grooves 802 of the of the landing seat 104 and, in some cases, may inhibit rotation of the landing mandrel 102 relative to the landing seat 104. The outer socket surfaces 208 abutted against inner socket surfaces 312 of the landing seat 104 may, in some cases, also inhibit rotation of the landing mandrel 102 relative to the landing seat 104.

It should be understood that a landing mandrel 102 having knobs 702 (see FIGS. 7A-B) may be substituted for the landing mandrel 102 having ball bearings 316. The knobs 702, similar to the ball bearings 316, would be received in the seat grooves 802 of the landing seat 104. Additionally, the knobs 702 may be abutted against surfaces that define the seat grooves 802 of the of the landing seat 104 and, in some cases, may inhibit rotation of the landing mandrel 102 relative to the landing seat 104.

Referring to the views of FIGS. 10-13, an operator may perform the following steps to couple a landing mandrel 102 having outer spline 1002 to a landing seat 104 disposed in a wellbore as follow. After deployment of the landing mandrel 102 as similarly discussed above, portions of the landing mandrel 102 may be slid into the landing seat 104, a lower seat cylinder 106, and an upper cylinder 108. In some cases, the outer splines 1002 of the landing mandrel 102 may not be aligned with respective inner socket walls 1102 of the landing seat 104. The downward-moving landing mandrel 102 may cause the outer splines 1002 to be slid and/or abutted against the respective inner socket walls 1102. Downward force on the landing mandrel and the abutted outer spline surfaces 1004 of the outer splines 1002 may cause the landing the mandrel 102 to rotate correspondingly. Accordingly, the landing mandrel 102 may continue traveling downward until friction between outer spline surfaces 1004 and the inner socket walls 1102 overcomes the downward force acting on the landing mandrel 102, causing it to stop moving.

In some cases, the outer spline surfaces 1004 abutted against the inner socket walls 1104 may inhibit rotation of the landing mandrel 102 relative to the landing seat 104.

The landing mandrel 102 may continue moving downward until outer tapered portions of the middle portion 204 of the landing mandrel 102 are abutted against inner tapered portions of the landing seat 104. In some cases, the inner tapered portions may inhibit further downward movement of the landing mandrel 102. Thus, the landing mandrel 102 may be said to be in a landed position on the landing seat 104. In the landed position, the landing mandrel 102 may have 1) a lower portion 202 disposed concentrically in the lower seat cylinder 106, 2) the middle portion 204 disposed concentrically in the seat 104, and 3) outer socket surfaces 208 aligned and/or abutted against inner socket surfaces 312.

It should be understood that a landing mandrel 102 having knobs 702 (see FIGS. 7A-B) may be substituted for the landing mandrel 102 having outer splines 1002. The knobs 702, similar to the ball bearings 316, would be received in the seat grooves 802 of the landing seat 104. Additionally, the knobs 702 may be abutted against surfaces that define the seat grooves 802 of the of the landing seat 104 and, in some cases, may inhibit rotation of the landing mandrel 102 relative to the landing seat 104.

In some versions, deploying a landing mandrel 102 downhole and abutting it against a landing seat 104 may create inner socket surfaces 312 on the landing seat 104. The landing mandrel 102 may be constructed from a material harder than that of a landing seat 104. The landing mandrel 102 may be constructed from a hard material, e.g., having at least a Brinell hardness value of 322 and/or Vickers hardness value of 335. The landing seat 104 may be constructed from a deformable material, e.g., having at least a Brinell hardness value of 76 and/or Vickers hardness value of 80. Accordingly, after deployment of the landing mandrel 102 as similarly discussed above, portions of the landing mandrel 102 may be slid into the landing seat 104, a lower seat cylinder 106, and an upper cylinder 108. Downward force on the landing mandrel 102 may cause outer socket surfaces 208 of the landing mandrel 102 to be abutted against a smooth inner tapered surface of the landing seat 104. The downward force may cause the outer socket surfaces 208 to deform the inner tapered surface. Accordingly, the inner tapered surface may be deformed to have inner socket surfaces aligned with the outer socket surfaces 208. Portions of the outer sockets surfaces 208 and the newly formed inner socket surfaces may be abutted against each other, respectively. Thus, in some cases, the inner socket surfaces may inhibit rotation of the landing mandrel 102 relative to the landing seat 104.

Figure 14A:
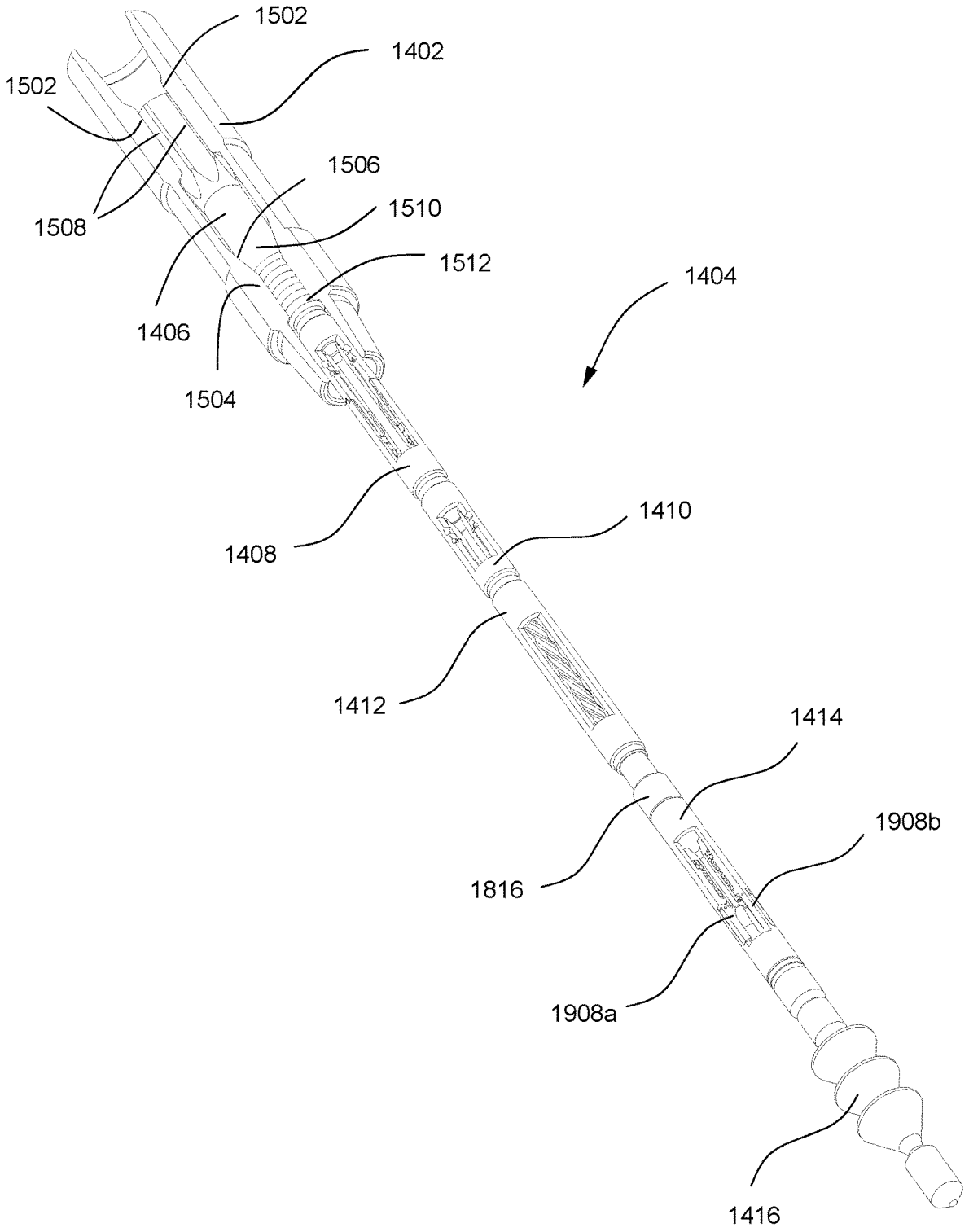
FIG. 14A illustrates a perspective view of a tubular cutting assembly including a landing seat and a tubular cutting assembly coupled to the landing seat and having blades retracted.
Figure 14B:
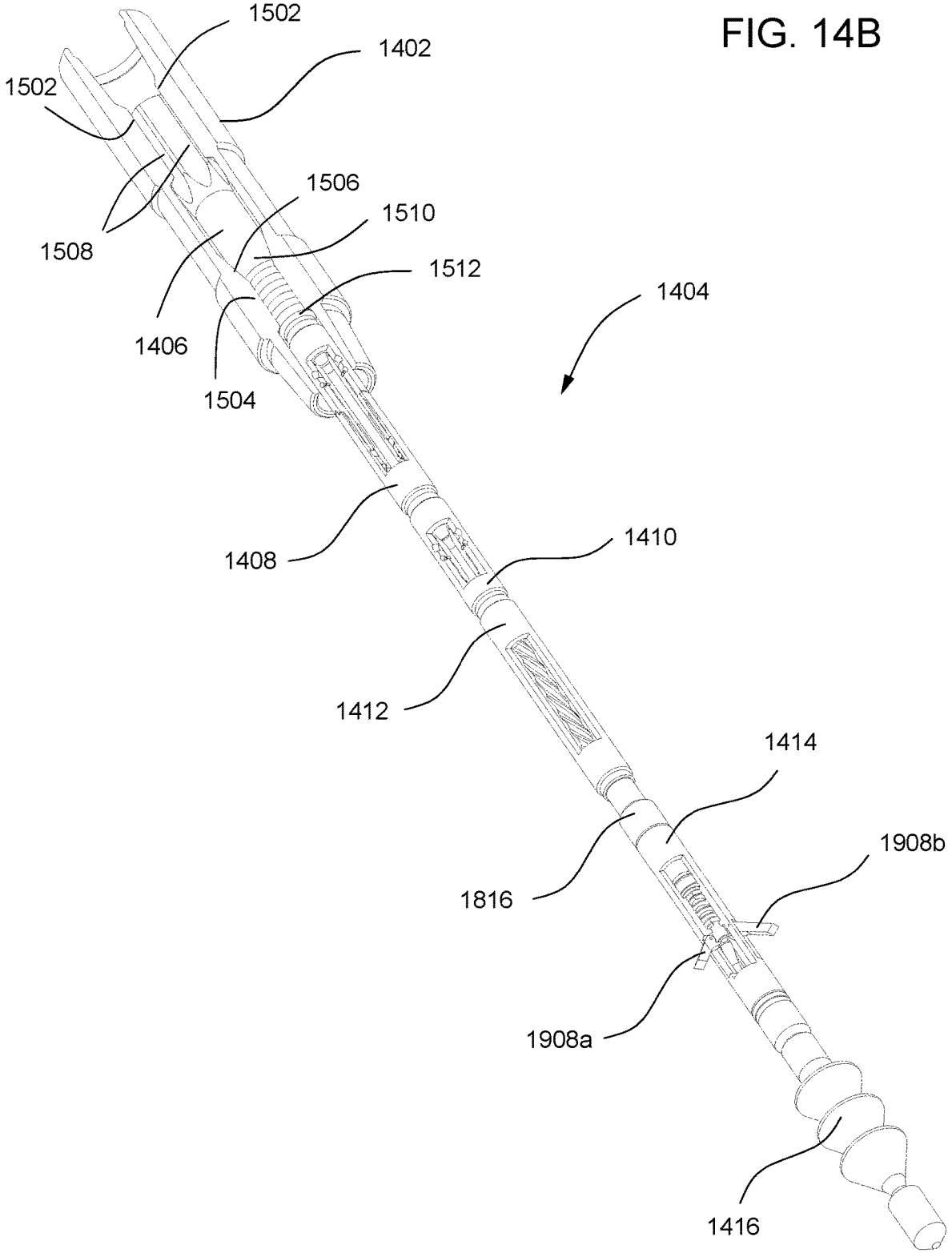
FIG. 14B illustrates a perspective view of a tubular cutting assembly including a landing seat and a tubular cutting assembly coupled to the landing seat and having blades extended.

The views of FIG. 14 illustrate perspective views of tubular cutting assemblies including landing seats 1402 and tubular cutting assemblies 1404. FIG. 14A illustrates a perspective view of a landing seat 1402 anti-rotatably coupled to a tubular cutting assembly 1404 having blades 1908 retracted. FIG. 14B illustrates a perspective view of a landing seat 1402 anti-rotatably coupled to a tubular cutting assembly 1404 having blades 1908 extended.

Referring to the views of FIG. 14, a tubular cutting assembly 1404 may include a landing mandrel 1406, a disconnect assembly 1408, a circulating valve assembly 1410, a check valve assembly (not shown), a motor 1412, a cutter assembly 1414, and a wiper plug 1416. The landing mandrel 1406 may be coupled to the disconnect assembly 1408. The disconnect assembly 1406 may be coupled to the circulating valve assembly 1410. The circulating valve assembly 1410 may be coupled to the motor 1412. The motor 1412 may be coupled to the cutter assembly 1414.

In some versions, neither a disconnect assembly nor circulating valve assembly is present. The motor 1412 may be coupled to the landing mandrel 1406. Alternatively, a check valve assembly may be coupled to landing mandrel 1406 and the motor 1412.

In other versions, a circulating valve assembly may be omitted. The disconnect assembly 1408 may be coupled to the landing mandrel 1406. The motor 1412 may be coupled to the disconnect assembly 1408.

In yet other versions, a disconnect assembly may be omitted. The circulating valve assembly 1410 may be coupled to the landing mandrel 1406. The motor 1412 may be coupled to the circulating valve assembly 1410.

Figure 15A:
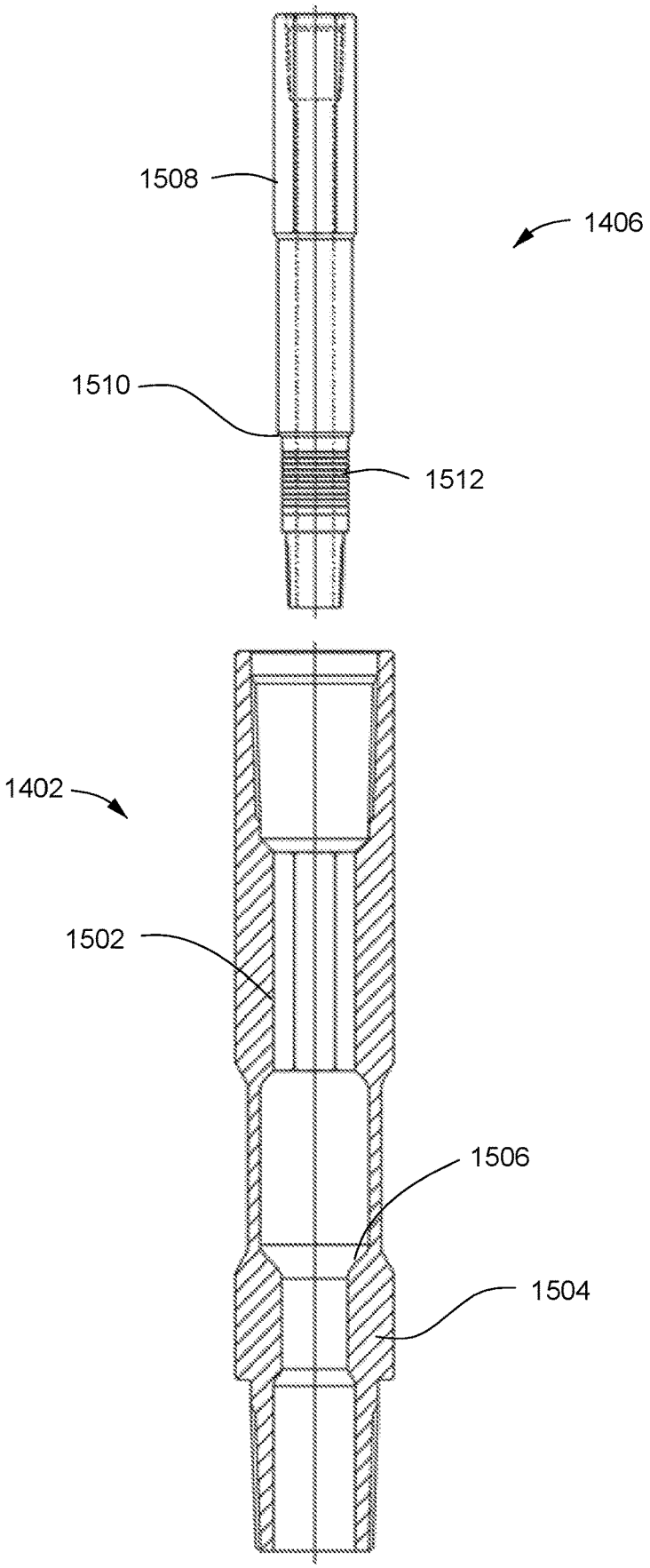
FIG. 15A illustrates a cross-sectional side view of a landing seat and a landing mandrel.
Figure 15B:
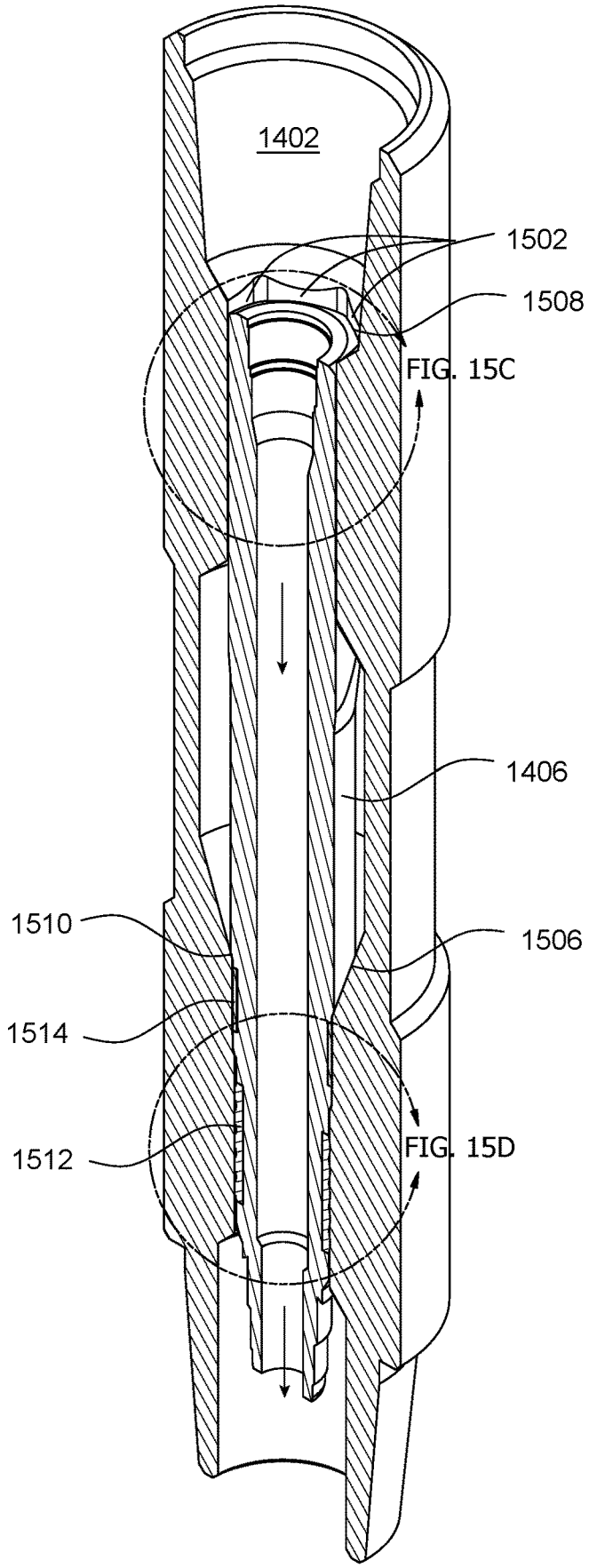
FIG. 15B illustrates a perspective cross-sectional view of a landing mandrel coupled to a landing seat.
Figure 15C:
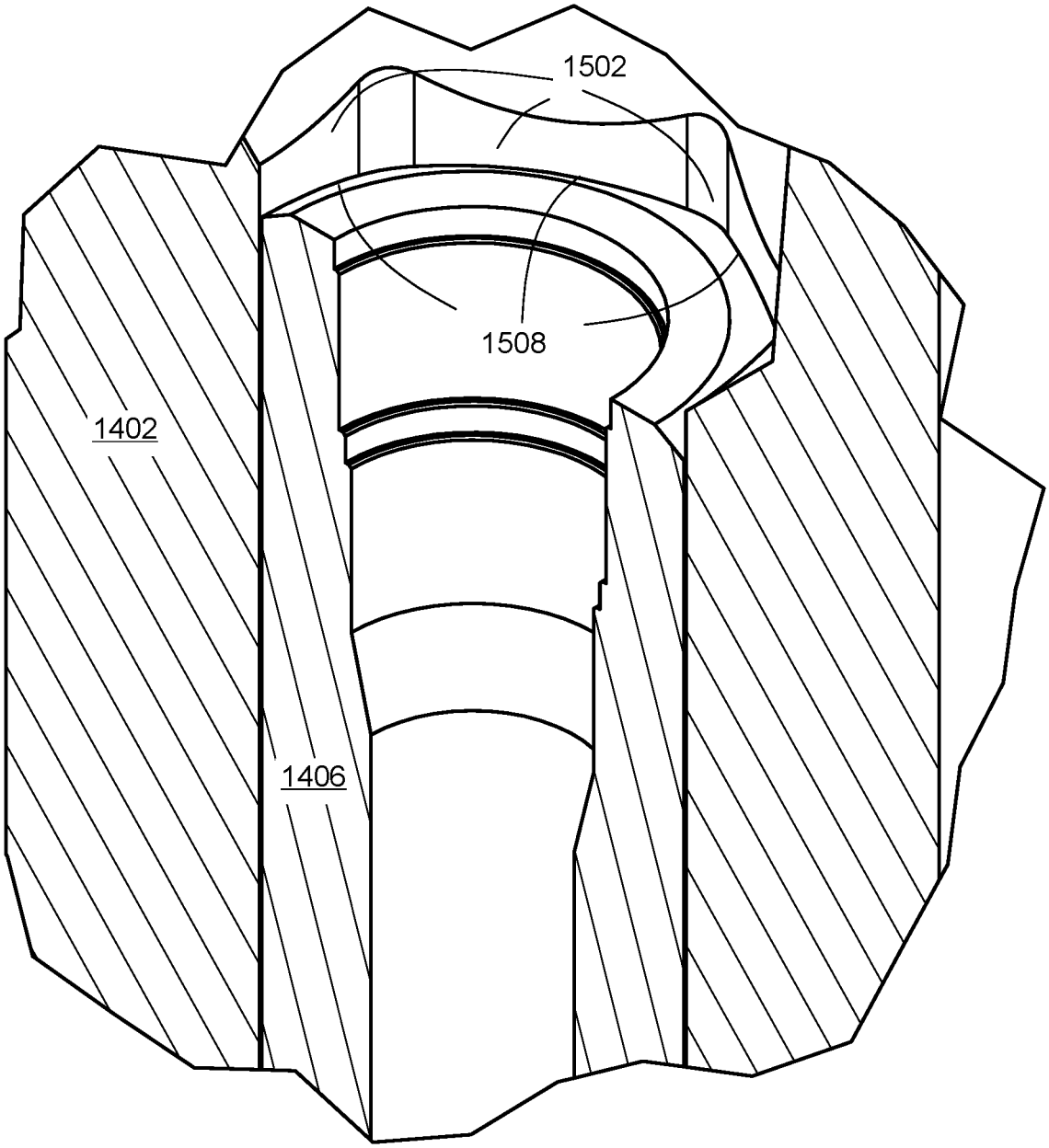
FIG. 15C illustrates a close-up perspective view of socket surfaces of the landing mandrel coupled to the landing seat in FIG. 15B.
Figure 15D:
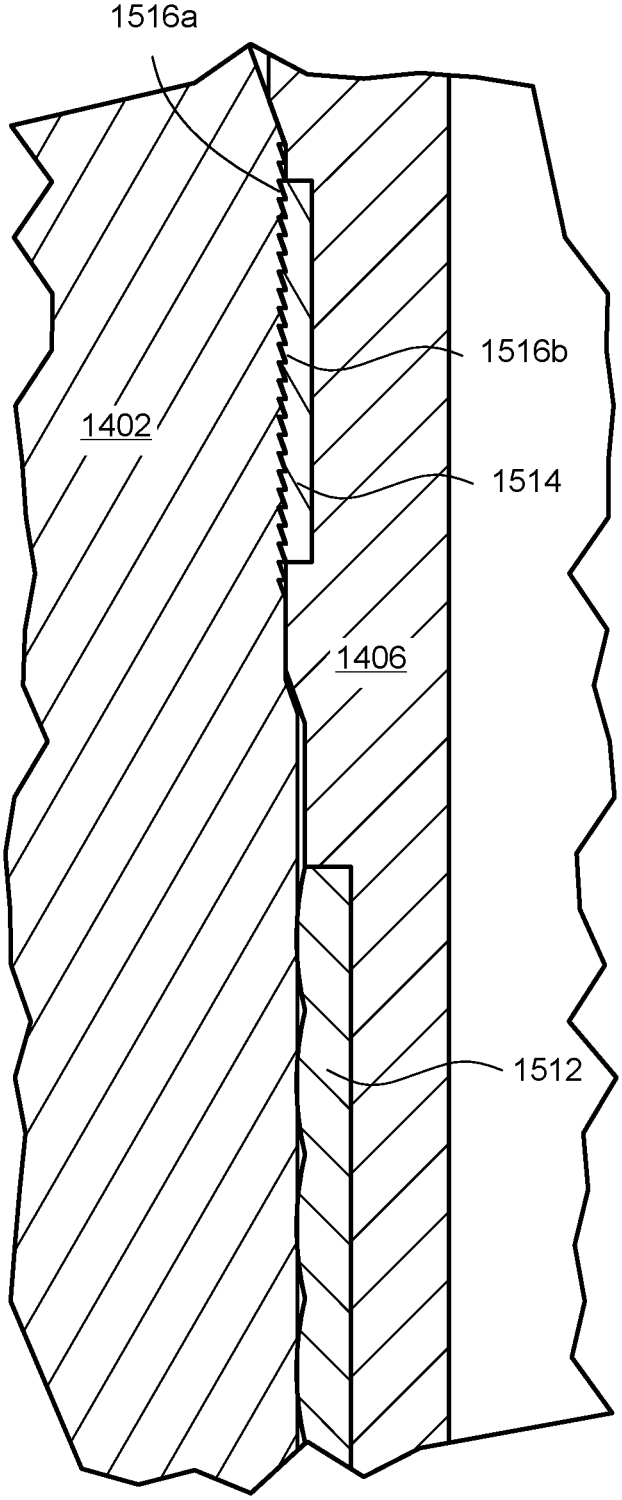
FIG. 15D illustrates a close-up perspective view of a lock coupled to the landing seat in FIG. 15B.

FIGS. 15A-B illustrate cross-sectional side views of seats 1402 and landing mandrels 1406. FIG. 15A illustrates a cross-sectional side view of a landing seat 1402 uncoupled from a landing mandrel 1406. FIG. 15B illustrates a cross-sectional side view of a landing mandrel 1406 coupled to a landing seat 1402. FIG. 15C illustrates a close-up view of male socket surfaces of the landing mandrel aligned with female socket surfaces of the landing seat in FIG. 15B. FIG. 15D illustrates a close-up view of a lock coupled to the landing seat in FIG. 15B.

Referring to the views of FIGS. 15A-D, a landing seat 1402 may have an inner surface and an outer surface. The inner surface may define an aperture extending through the landing seat 1402. An anti-rotation portion of the inner surface of the landing seat 1402 may have one or more socket surfaces 1502. The socket surfaces 1502 may be disposed at an upper end of the landing seat 1402. A landing collar 1504 may extend inwardly from the inner surface towards the central axis line of the landing seat 1402. The landing collar 1504 may have an inner tapered surface 1506. The inner tapered surface 1506 may have a beveled, conical, and/or frustoconical shape.

A landing mandrel 1406 may have an inner surface and an outer surface. A landing portion of the outer surface of the landing mandrel 1406 may have an outer tapered surface 1510 having a tapered profile. The outer tapered surface 1510 may have a beveled, conical, and/or frustoconical shape. The outer tapered surface 1510 of the landing mandrel 1406 may be abutted against the inner tapered surface 1506 of the landing collar 1504.

An anti-rotation portion of the outer surface may have one or more male socket surfaces 1508 (FIG. 15C). Each male socket surface 1508 may be aligned with a female socket surface 1502 of the landing seat 1402. Portions of the male socket surfaces 1508 may be abutted against portions of the socket surfaces 1502 of the landing seat. Accordingly, when portions of the socket surfaces 1502, 1508 are abutted against each other, they would inhibit rotation of the landing mandrel 1406 relative to the landing seat 1402. Therefore, the landing mandrel 1406 may be anti-rotatably coupled to the landing seat 1402.

A seal portion of the outer surface of the landing mandrel 1406 may have seals 1512 disposed thereon. The seals 1512 may be sealably abutted against the collar 1506. Each seal 1512 may be made from elastomeric material, e.g., silicone, fluorocarbon rubber (FKM), nitrile rubber (NBR), hydrogenated nitrile (HNBR), or acrylonitrile butadiene rubber. Each seal 1512 may be made from plastic material, e.g., PEEK, PTFE, or PE-UHMW. Each seal 1512 may be made from metallic material.

A lock 1514 may be disposed circumferentially on the outer surface of the landing mandrel 1406. A spring (not shown) be disposed between the lock and the outer surface of the landing mandrel 1406. The spring may bias the lock 1514 away from the outer surface of the landing mandrel 1406. Thus, a portion of the lock 1514 may protrude from the mandrel 1406. In addition, the lock 1514 may have teeth 1516*a* (FIG. 15D). The teeth 1516*a* may be coupled to teeth 1516*b* disposed in the inner surface of the landing seat 1402. Once the teeth 1516*a*, 1516*b* are coupled, the landing mandrel 1406, in some cases, is inhibited from being uncoupled from the landing seat 1402. Therefore, the landing mandrel 1406 may further be fixedly coupled to the landing seat 1402.

In addition, pin threads may be disposed at a lower end of the landing mandrel 1406. The pin threads may be coupled to box threads (not shown) of a disconnect assembly 1408 (FIGS. 1A-B).

Figure 16A:
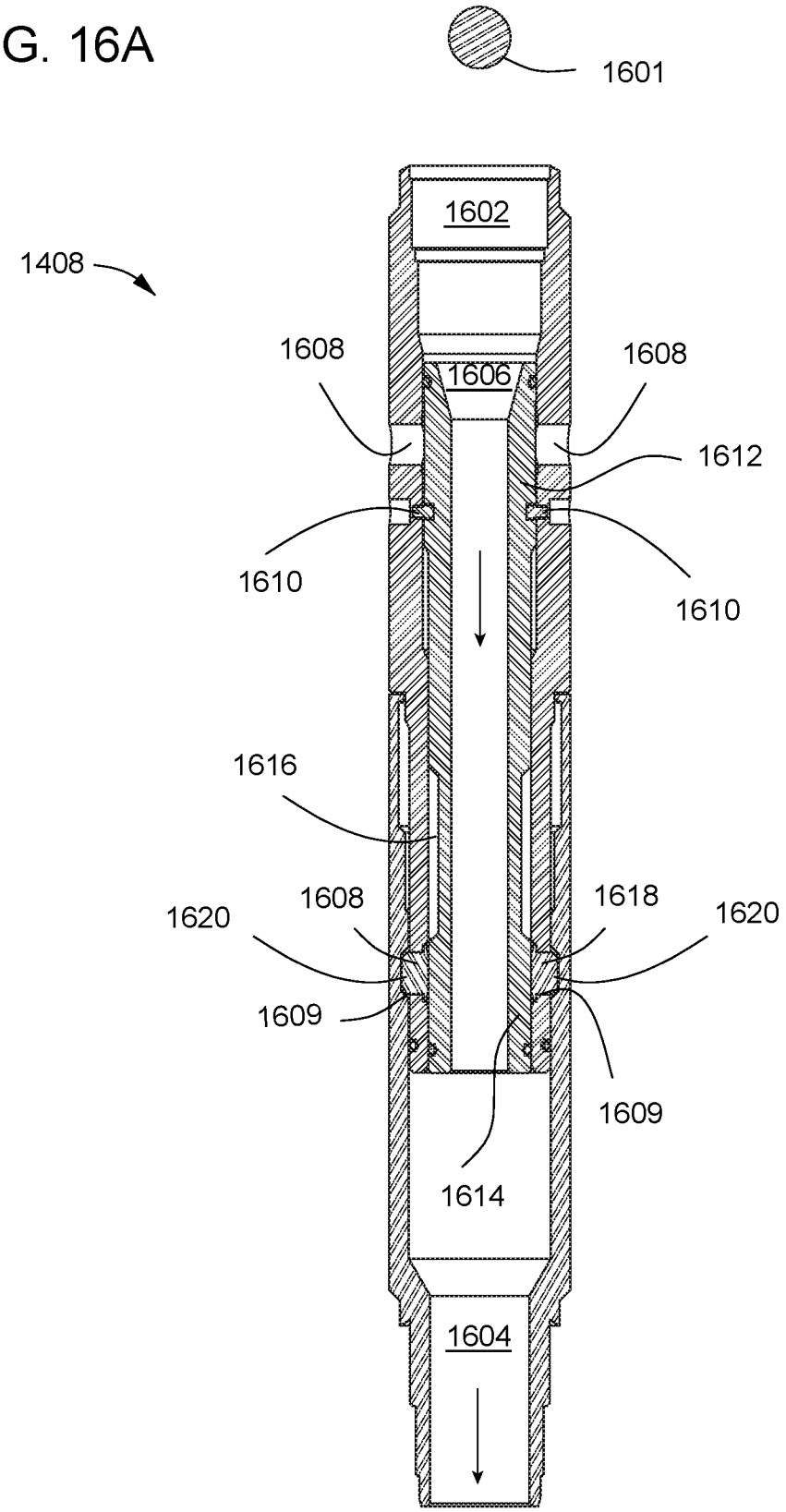
FIG. 16A illustrates a cross-sectional side view of a disconnect assembly and a dart.

FIG. 16A illustrates a cross-sectional side view of a disconnect assembly 1408 including an upper housing 1602, a lower housing 1604, and a lock sleeve 1606 coupled together in a locked position. A dart 1601 may be pumped from the surface and landed on the lock sleeve 1606. The upper housing 1602 may have an inner surface and an outer surface. The outer surface may have box threads disposed at an upper end of the upper housing 1602. The box threads may be coupled to pin threads of the landing mandrel (not shown). Bypass fluid ports 1608 may be disposed through the upper housing 1602. One or more retaining apertures 1609 may be disposed through the upper housing 1602. Furthermore, a lower portion of the upper housing 1602 may be disposed within the lower housing 1604.

The lower housing 1604 may have an inner surface and an outer surface. The inner surface may define an aperture extending through ends of the lower housing 1604.

The lock sleeve 1606 may have an upper portion disposed concentrically in the upper housing 1602 and a lower portion disposed concentrically in the lower housing 1604. The lock sleeve 1606 may be shearably coupled to the upper housing 1602 via shear pins 1610. The lock sleeve 1606 may have an inner surface and an outer surface. The inner surface of the lock sleeve 1606 may define an aperture extending through ends of the lock sleeve 1606.

The lock sleeve 1606 may have a bypass obstruction portion 1612. The bypass obstruction portion 1612 may have an outer surface capable of obstructing the bypass fluid ports 1608 disposed through the upper housing 1602. Accordingly, the bypass obstruction portion 1612 may inhibit fluid egress from within the disconnect assembly 1408 through the bypass fluid port 1608.

In addition, the lock sleeve 1606 may have a locking portion 1614 and a release groove 1616. The release groove 1616 may be disposed in the outer surface of the lock sleeve 1606. The release groove 1616 may be disposed above the locking portion 1614.

Also, the lock sleeve 1606 may be shearably coupled to the upper housing 1602 via pins 1610.

The upper housing 1602 and the lower housing 1604 may be removably coupled. The lower housing 1604 may have a locking groove 1622 disposed in its inner surface. Lugs 1618 may be extended through each retaining aperture 1609. Each lug 1618 may have a tapered end 1620 disposed in a locking groove 1622. The lugs 1618 may be "free floating" in the retainer aperture 1609 and locking groove 1622. However, an outer surface of the locking portion 1614 of the lock sleeve 1606 may be abutted against each lug 1618. Accordingly, the locking portion 1614 may inhibit each lug 1618 from egress from the locking groove 1622. Thus, the upper housing 1602 and the lower housing 1604 may remain coupled via lugs 1618.

In various versions, other types of lock may be used instead of lugs. For instance, in some versions, steel balls may be used. In other versions, a lug 1618 may be coupled to collet fingers of an upper housing 1602. The collet fingers may extend from an end of the upper housing 1602. The collect fingers are capable of being biased inward toward a central axis of the upper housing 1602.

Figure 16B:
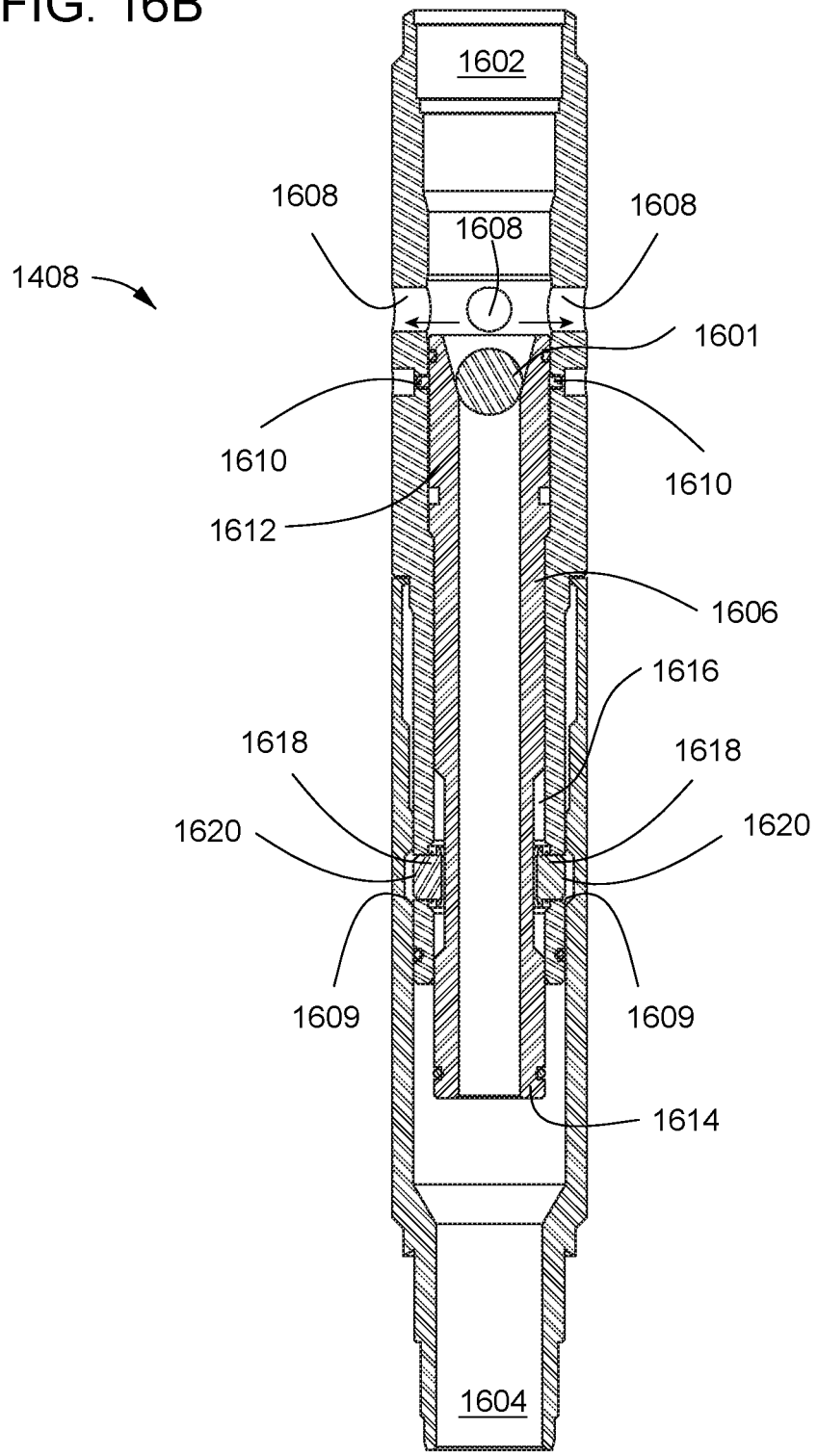
FIG. 16B illustrates a cross-sectional side view of a disconnect assembly having received a dart.

FIG. 16B illustrates a cross-sectional side view of a disconnect assembly 1408 including an upper housing 1602 and a lower housing 1604, and a lock sleeve 1606 in an unlocked position, and a dart 1601 seated on the lock sleeve 1606. The lock sleeve 1606 may have an inner surface having a release groove 1616 disposed circumferentially therein. The release groove 1616 may be aligned with lugs 1618. Additionally, the lock sleeve 1606 may be slid below the bypass fluid port 1608. In some cases, a bypass obstruction portion 1612 of the lock sleeve 1606, may not obstruct the bypass fluid ports 1608 in the upper housing 1602.

Figure 16C:
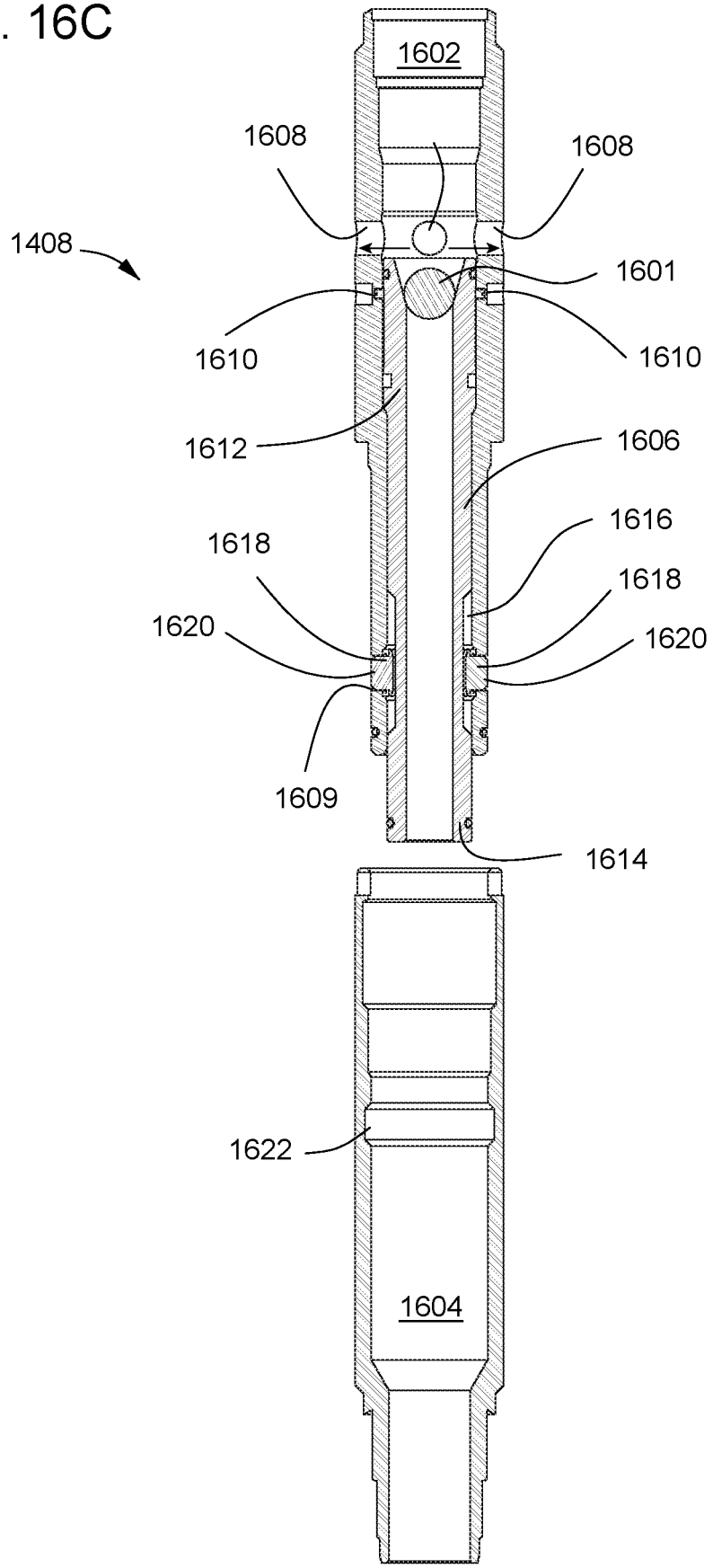
FIG. 16C illustrates a cross-sectional side view of a disconnect assembly having an upper housing uncoupled from a lower housing.

FIG. 16C illustrates a cross-sectional side view of a disconnect assembly 1408 having an upper housing 1602 and a lower housing 1604 uncoupled. Lugs 1618 may be slid through the upper housing towards the central axis of the disconnect assembly 1408. The lugs 1618, in some cases, may each have a tapered end 1620 that are not disposed in a locking groove 1622. In the unlocked position, the lugs 1618 may each have a portion disposed in the release groove 1616 and a tapered end 1620 dispose away from the locking grooves 1622. Thus, the upper housing 1602 may be slid away from the lower housing 1604 unobstructed.

Figure 16D:
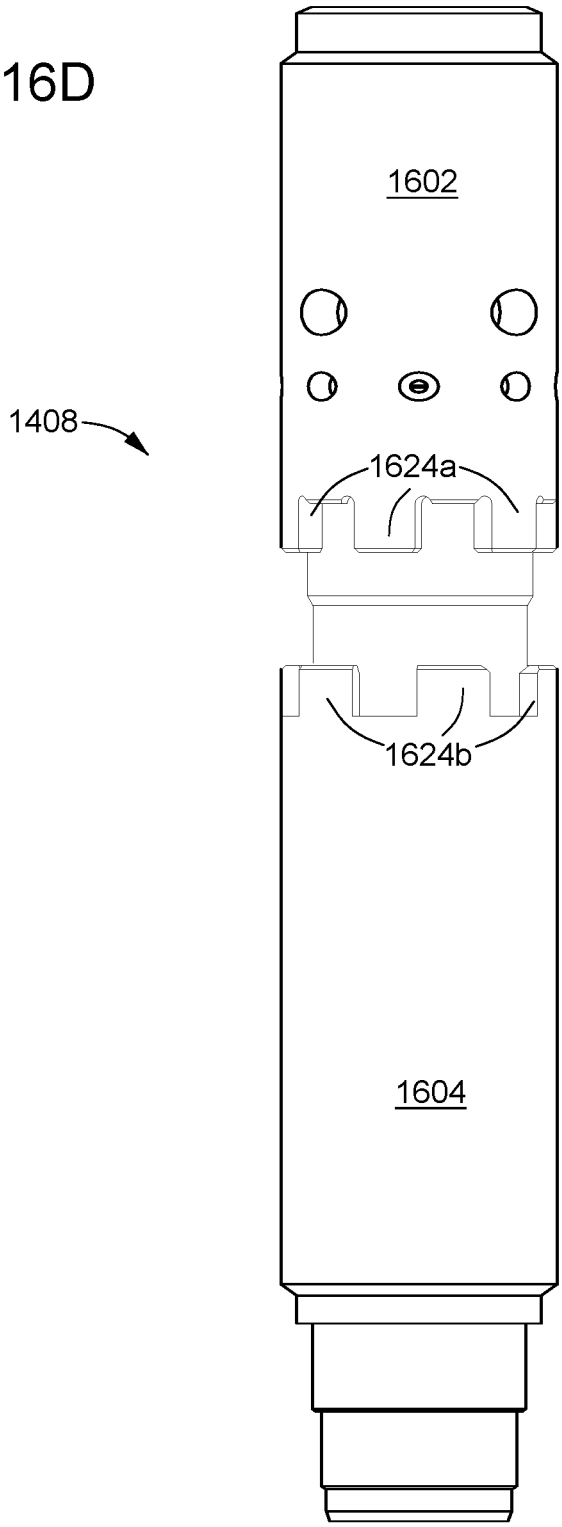
FIG. 16D illustrates a profile view of a disconnect assembly having an upper housing and a lower housing uncoupled.

FIG. 16D illustrates a profile view of the disconnect assembly 1408 having an upper housing 1602 and a lower housing 1604 uncoupled. The upper housing 1602 may include a first castellation wall 1624*a*. The lower housing 1604 may include a second castellation wall 1624*b*. The first castellation wall 1624*a* of the upper housing may be capable of meshing with the second castellation wall 1624*b* of the lower housing of the disconnect assembly. Thus, when the first castellation wall 1624*a* is meshed with the second castellation wall 1624*b*, the upper housing 1602 and the lower housing 1604, in some cases, would be inhibited from being rotated relative to each other.

Figure 17A:
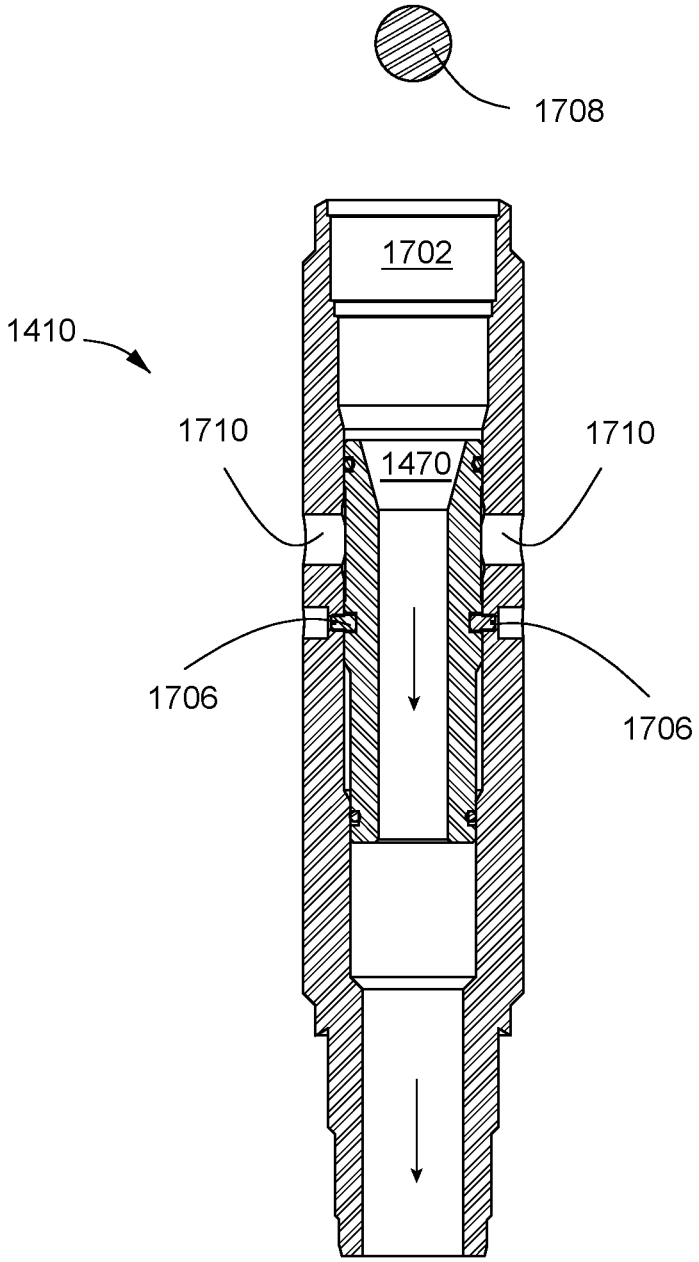
FIG. 17A illustrates a cross-sectional side view of a circulating valve assembly including a housing and a bypass sleeve disposed in a closed position in the housing.

FIG. 17A illustrates a cross-sectional side view of a circulating valve assembly 1410 including a housing 102 and a bypass sleeve 1704 disposed in the housing 1702 in a closed position. A dart 1708 may be pumped from the surface and landed on the bypass sleeve 1704. The housing 1702 may have an inner surface and an outer surface. The outer surface may have box threads disposed at an upper end of the housing 1702. The box threads may be coupled to pin threads of a lower housing 1604 of a disconnect assembly (not shown). Additionally, pin threads may be disposed on the outer surface at a lower end of the housing 1702.

The bypass sleeve 1704 may have an inner surface and an outer surface. The bypass sleeve 1704 may be disposed concentrically in the housing 1702. Also, the bypass sleeve 1704 may be shearably coupled to the housing 1702 via pins 1706. Additionally, a portion of the outer surface of the bypass sleeve 1704 may obstruct bypass fluid ports 1710 disposed through the housing 1702. A seal (not shown) may be disposed on the bypass sleeve 1704 below the bypass fluid ports 1710. Accordingly, the bypass obstruction portion 1712 may inhibit fluid egress from within the bypass valve 1410 through the bypass fluid port 1710.

Figure 17B:
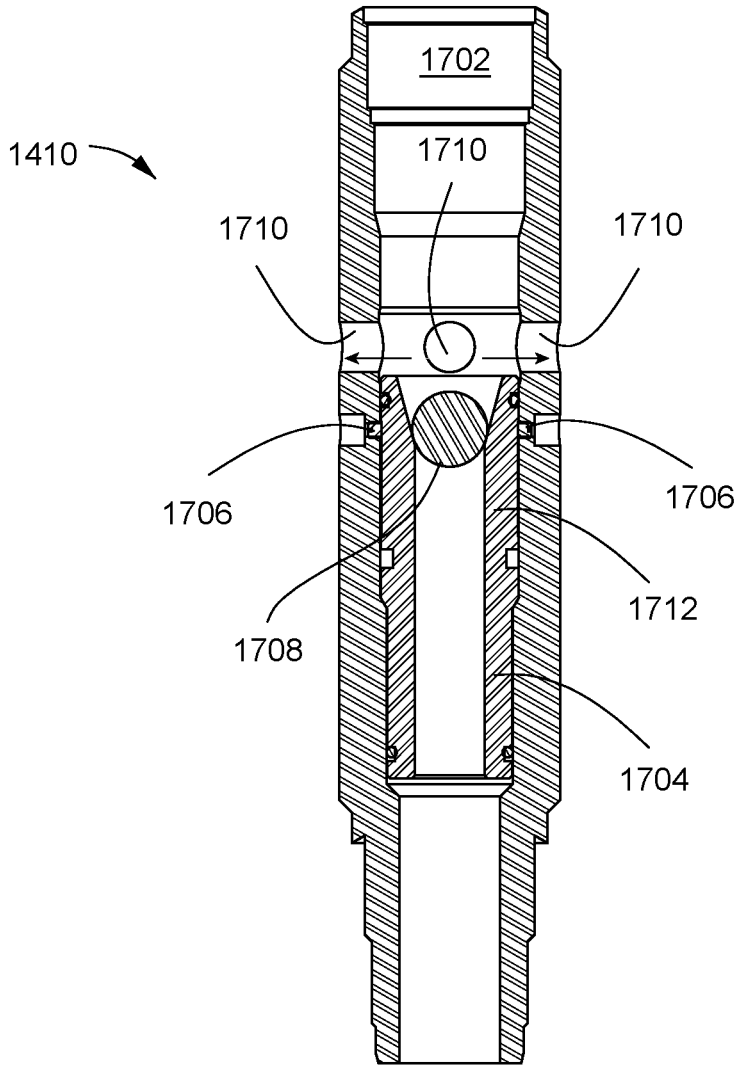
FIG. 17B illustrates a cross-sectional side view of a circulating valve assembly including a housing and a bypass sleeve disposed in an open position in the housing.

FIG. 17B illustrates a cross-sectional side view of a circulating valve assembly 1410 including a housing 1702 and a bypass sleeve 1704 disposed in an open position in the housing 1702. A dart 1708 may be landed on the bypass sleeve 1704.

In the open position, the bypass sleeve 1704 may be disposed below bypass fluid ports 1710 disposed through the housing 1702. Thus, in some cases, the bypass sleeve 1704 may not obstruct the bypass fluid ports 1710. Accordingly, fluid within the bypass valve 1704 may be flowed through the bypass fluid ports 1710.

Figure 18:
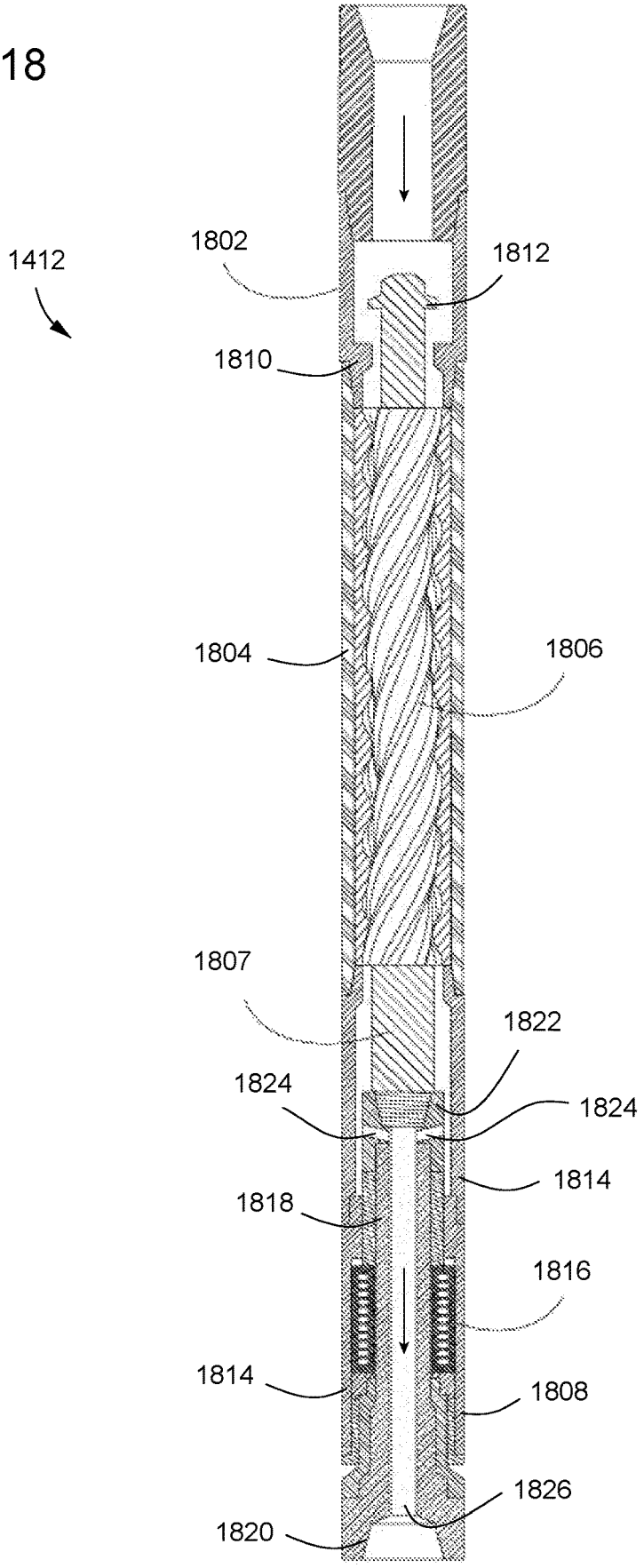
FIG. 18 illustrates a cross-sectional side view of a motor.

FIG. 18 illustrates a cross-sectional side view of a motor 1412. The motor 1412 may include an anti-drop adapter 1802, a stator 1804, a rotor 1806, and a drive shaft assembly 1808. The anti-drop adapter 1806 may be threadably coupled to an upper end of the stator 1804. The anti-drop adapter 1802 may have an inner surface having an inner collar 1810 extending therefrom. A portion of the rotor 1806 may be extended through the inner collar 1810 into the stator 1804. Additionally, the rotor 1806 may have an upper end having a rotor catch 1812 extending outwardly therefrom. The rotor catch 1812 of the rotor 1806 is capable of being abutted against the inner collar 1810 of the anti-drop adapter 1802. Therefore, in some cases, the anti-drop adapter 1802 may inhibit the rotor 1806 from falling through the anti-drop adapter 1802.

Additionally, the lower end of the rotor 1806 may include a universal coupling adaptor 1807. The universal coupling adaptor 1807 may be a flexible shaft. Moreover, the universal coupling adaptor 1807 may be threadably coupled to an upper end of the drive shaft assembly 1808.

In some versions, the universal coupling adaptor 1807 of the rotor 1806 may be a U-joint (not shown) pivotably coupled to an upper end of the drive shaft assembly 1808.

Returning to FIG. 18, the drive shaft assembly 1808 may include a housing 1814, bearing assemblies 1816, and a drive shaft 1818. The housing 1814 may be coupled (e.g., via threads) to a lower end of the stator 1804. The bearing assembly 1816 may be rotatably coupled to the housing 1814. The drive shaft 1818 may be rotatably coupled to the bearing assemblies 1816. The bearing assembly 1816 may be rotatably coupled to the drive shaft 1818. Further, the bearing assembly 1816 may be coupled to the housing 1814. The drive shaft 1818 may have a lower end having box threads 1820 that are capable of being coupled to pin threads of a cutter assembly (not shown).

Additionally, the drive shaft 1818 may include a coupler 1822. The coupler 1822 may be coupled to the universal coupling adaptor 1807 of the rotor 1806. Inlet fluid ports 1824 may be disposed through the coupler 1822. Fluid in the motor 1410 may be flowed through the inlet fluid ports 1824. Furthermore, a central aperture 1826 may be disposed through the ends of drive shaft 1818 (including the coupler 1822). The central aperture 1826 may be in fluid communication with the inlet fluid ports 1824.

Figure 19A:
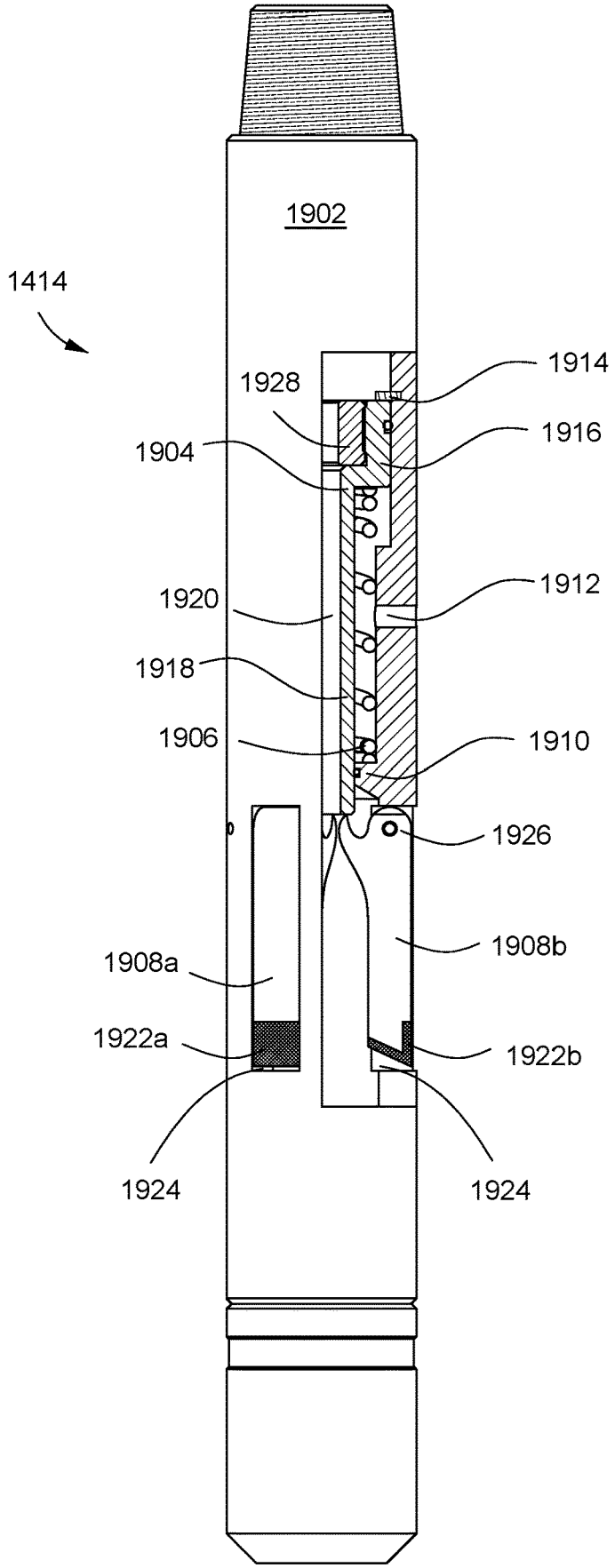
FIG. 19A illustrates a cross-sectional side view of a cutter assembly having blades in a retracted position.

FIG. 19A illustrates a cross-sectional side view of a cutter assembly 1414 including blades 1908*a*, 1908*b* disposed in a retracted position. The cutter assembly 1414 may include a housing 1902, a piston 1904, a coil 1906, and the blades 1908*a*, 1908*b*. The housing 1902 may have an inner surface and an outer surface. Pin threads may be disposed on the outer surface at an upper end of the housing 1902. The pin threads may be coupled to box threads 1820 of a drive shaft assembly 1818 of a motor (not shown). A first portion of the inner surface may have a collar 1910 extended therefrom towards the central axis line of the cutter assembly 1414. The coil 1906 may be disposed on an upper surface of the collar 1910. Additionally, fluid ports 1912 may be disposed through the housing 1902 adjacent to the coil 1906. Furthermore, pins 1914 may be disposed in the inner surface of the housing 1902. The pins 1914 may be disposed above the piston 1904.

The piston 1904 may have a piston head 1916 and a stem 1918. The piston head 1916 and the stem 1918 may be unitary. The stem 1918 may be extended through the coil 1906 and the collar 1910 of the housing 1902. The piston head 1916 may be disposed above the coil 1906. Therefore, the coil 1906 may be disposed between the collar 1910 and the piston head 1916. Furthermore, the coil 1906 may be abutted against the collar 1910 and the piston head 1916. Thus, the coil 1906 may cause the piston head 1916 of the piston 1904 to be biased away from the collar 1910. However, an upper surface of the piston head 1916 may be abutted against the pins 1914. Thus, the pins 1914 may inhibit movement of the piston 1904 away from the collar 1910.

Additionally, an inner surface of the piston 1904 may define a central aperture 1920 extending through the piston head 1916 and the stem 1918. A first portion of the inner surface of piston 1904 in the piston head 1916 may define a first diameter. A second portion of the inner surface of the piston 1904 in the stem 1918 may define a second diameter. The second diameter may be smaller than the first diameter.

Fluid may be flowed through the central aperture 1920. An insert 1928 may be disposed in the central aperture 1920 concentric with the piston head 1916. The insert 1928 may have an inner surface that defines an aperture therethrough. Also, the inner surface of the insert 1928 may define a third diameter. The third diameter of the insert 1928 may range from 3/16 inch to 7/8 inch. The third diameter of the inner surface of the insert 1928 may be smaller than or equal to the second diameter defined by the second portion of the surface of the piston 1904 in the stem 1918. The insert 1928 may inhibit fluid flow through the piston 1904.

Figure 19B:
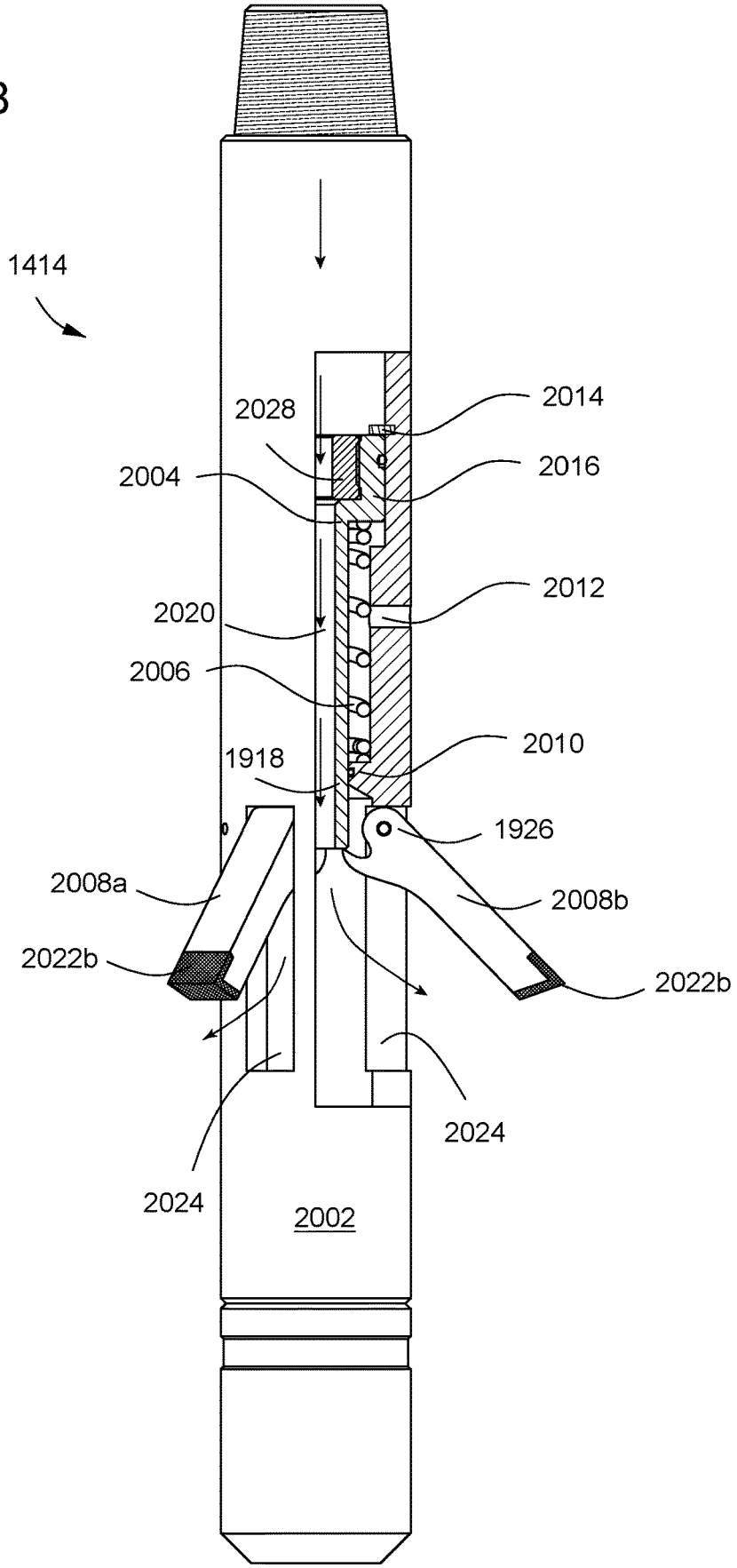
FIG. 19B illustrates a cross-sectional side view of a cutter assembly having blades in an extended position.

FIG. 19B illustrates a cross-sectional side view of a cutter assembly having blades in a cutting position. When the blades 1908 are in a cutting position, the stem 1918 may be abutted against a first portion of each blade 1908. Each blade 1908 may have pivot portion 1926 pivotably coupled to the housing 1902. Also, each blade 1908*a*, 1908*b* may be disposed in a window 1924 extending through the housing 1902. When the first portion of each blade 1908 is pushed, each blade 1908 would have a cutting end pivoted outwardly from the window 1924 away from the housing 1902. Each blade 1908 may have a cutting end 1922. The cutting end 1922 be composed of material such as tungsten carbide.

Figure 19C:
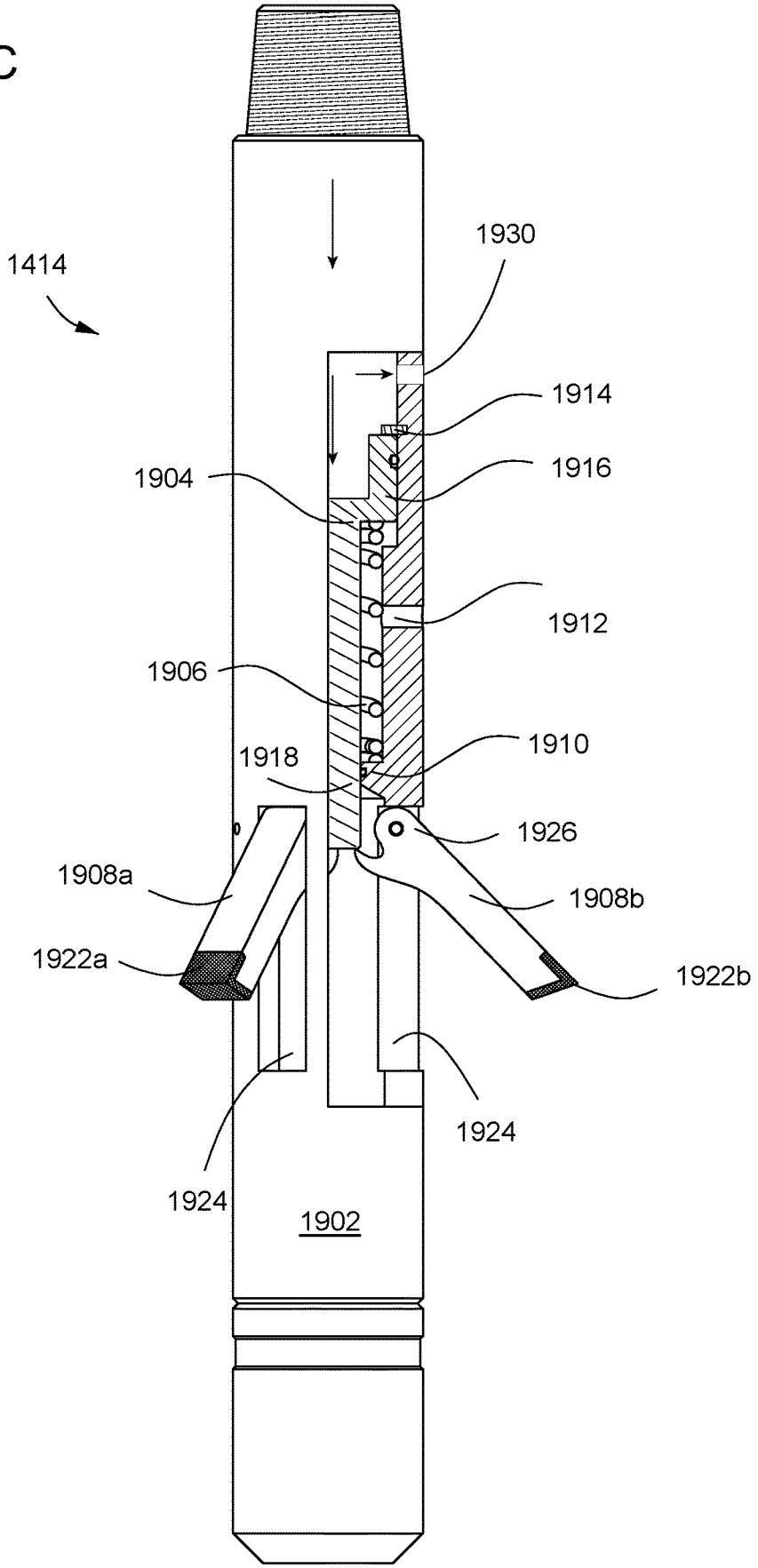
FIG. 19C illustrates a cross-sectional side view of another cutter assembly having a piston that is solid.

FIG. 19C illustrates a cross-sectional side view of another exemplary cutter assembly 1414 having blades 1908*a*, 1908*b* in a cutting position. The cutter assembly 1414 may include a housing 1902, a piston 1904, a coil 1906, and the blades 1908*a*, 1908*b*. The housing 1902 may have an inner surface and an outer surface. Pin threads may be disposed on the outer surface at an upper end of the housing 1902. The pin threads are capable of being coupled to box threads 1820 of a drive shaft assembly 1818 of a motor (not shown).

A first portion of the inner surface may have a collar 1910 extended therefrom towards the central axis line of the cutter assembly 1414. The coil 1906 may be disposed on an upper surface of the collar 1910. Also, fluid ports 1912 may be disposed through the housing 1902 adjacent to the coil 1906. Furthermore, pins 1914 may be disposed in the inner surface of the housing 1902. The pins 1914 may be disposed above the piston 1904.

One or more relief fluid ports 1930 may be disposed through the housing 1902. The one or more relief fluid ports 1930 may be disposed above the piston 1904. Fluid, e.g., mud, may be passed from the relief fluid ports 1930. The one or more relief fluid ports 1930 may be disposed at an angle relative to the central axis of the housing 1902. The angle of the one or more relief fluid port 1926 may range from 10, 20, 30, or 45 to 50, 60, 70, 80, or 90 degrees, or greater.

The housing 1902 of the cutter assembly 1414 may have one or more fluid ports 1912 disposed therethrough. The fluid ports 1912 may be adjacent to the piston 1904 and the coil 1906. Fluid in the cutter assembly 1414 may be flowed through the one or more fluid ports 1912. Conversely, fluid outside of the cutter assembly 1414 may be flow through the one or more fluid ports 1912.

The piston 1904 may be solid. In addition, the piston 1904 may be disposed below the pins 1914. Also, the piston 1904 may have a piston head 1916 and a stem 1918. Additionally, the piston head 1916 and the stem 1918 may be unitary. Moreover, the stem 1918 of the piston 1904 may be extended through the coil 1906 and the collar 1910. The piston head 1916 may be disposed above the coil 1906. Accordingly, the coil 1906 may be disposed between the collar 1910 and the piston head 1916. Furthermore, the coil 1906 may be abutted against the collar 1910 and the piston head 1916. Thus, the coil 1906 may cause the piston head 1916 of the piston 1904 to be biased away from the collar 1910. However, an upper surface of the piston head 1916 may be abutted against the pins 1914. Thus, the pins 1914 may inhibit movement of the piston 1904 away from the collar 1910.

In a cutting position, the stem 1918 may be abutted against a first portion of each blade 1908. Each blade 1908 may have an end pivotably coupled to the housing 1902. Also, each blade 1908 may be disposed in a window 1924 disposed through the housing 1902. When the first portion of each blade 1908 is pushed, each blade 1908 would have a cutting end pivoted outwardly from the window 1924 away from the housing 1902. Each blade may have a cutting end 1922. The cutting end 1922 be composed of material such as tungsten carbide. The cutting end 1922 may also have material that include tungsten, molybdenum, chromium, vanadium, cobalt, and/or carbon.

Figure 20A:
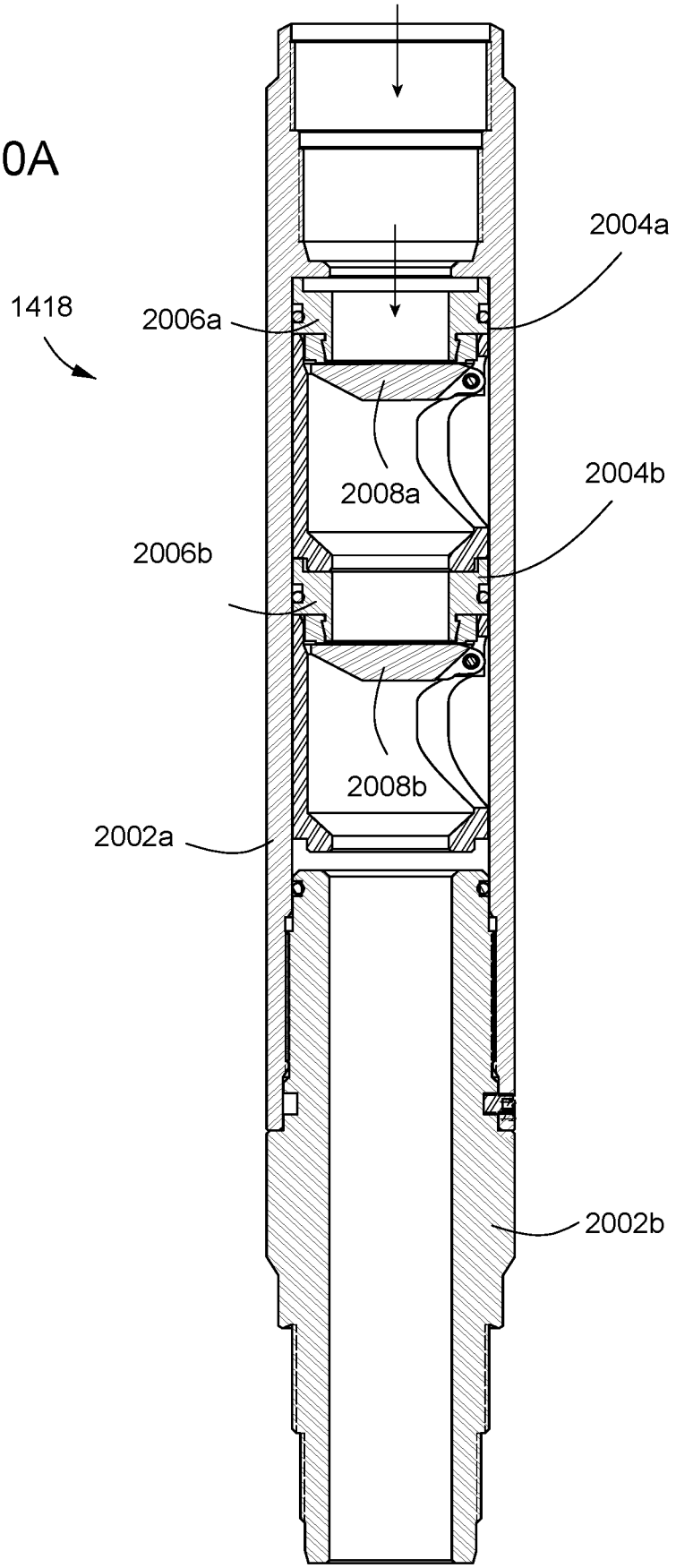
FIG. 20A illustrates a cross-sectional side view of a check valve assembly having flapper assemblies in a closed position.

FIG. 20A illustrates a cross-sectional side view of a check valve assembly 118 having flapper assemblies 2004*a*, 2004*b* in a closed position. The check valve assembly 118 may include a first housing 2002*a*, a second housing 2002*b*, and the one or more flapper assemblies 2004*a*, 2004*b*. The first housing 2002*a* and the second housing 2002*b* may be coupled to form a longer housing. The first housing 2002*a* may have an inner surface and an outer surface. Box threads may be disposed on the inner surface at an upper end of the first housing 2002*a*. The box threads may be coupled to pin threads of a landing mandrel (not shown).

The second housing 2002*b* may also have an inner surface and an outer surface. Pin threads may be disposed on the outer surface at an upper end of the second housing 2002*b*. The pin threads may be coupled to box threads at a lower end of the first housing 2002*a*. Pin threads may also be disposed on the outer surface at a lower end of the second housing 2002*b*. The pin threads are capable of being coupled to box threads of a motor (not shown).

The flapper assemblies 2004*a*, 2004*b* may be disposed as a stack within the first housing 2002*a*. The first flapper assembly 2004*a* be abutted against a collar within the first housing 2002*a*. The second flapper 2004*b* may be abutted against the first flapper 2004*a*. An upper face of the second housing 2002*b* may be abutted the second flapper assembly 2004*b*. Thus, the flapper assemblies 2004*a*, 2004*b* may be retained in the housing 2002*a*.

Each flapper assembly 2004 may include a housing 2006, a flapper 2008, and a spring (not shown). The flapper 2008 may be pivotably coupled to the housing 2006. The spring may be coupled to the flapper 2008 of each lapper assembly 2004. The spring may cause the flapper 2008 to be biased against the housing 2006 in closed position. Thus, in the closed position, fluid below each flapper assembly 2004 may not be flowed upwards therethrough.

Figure 20B:
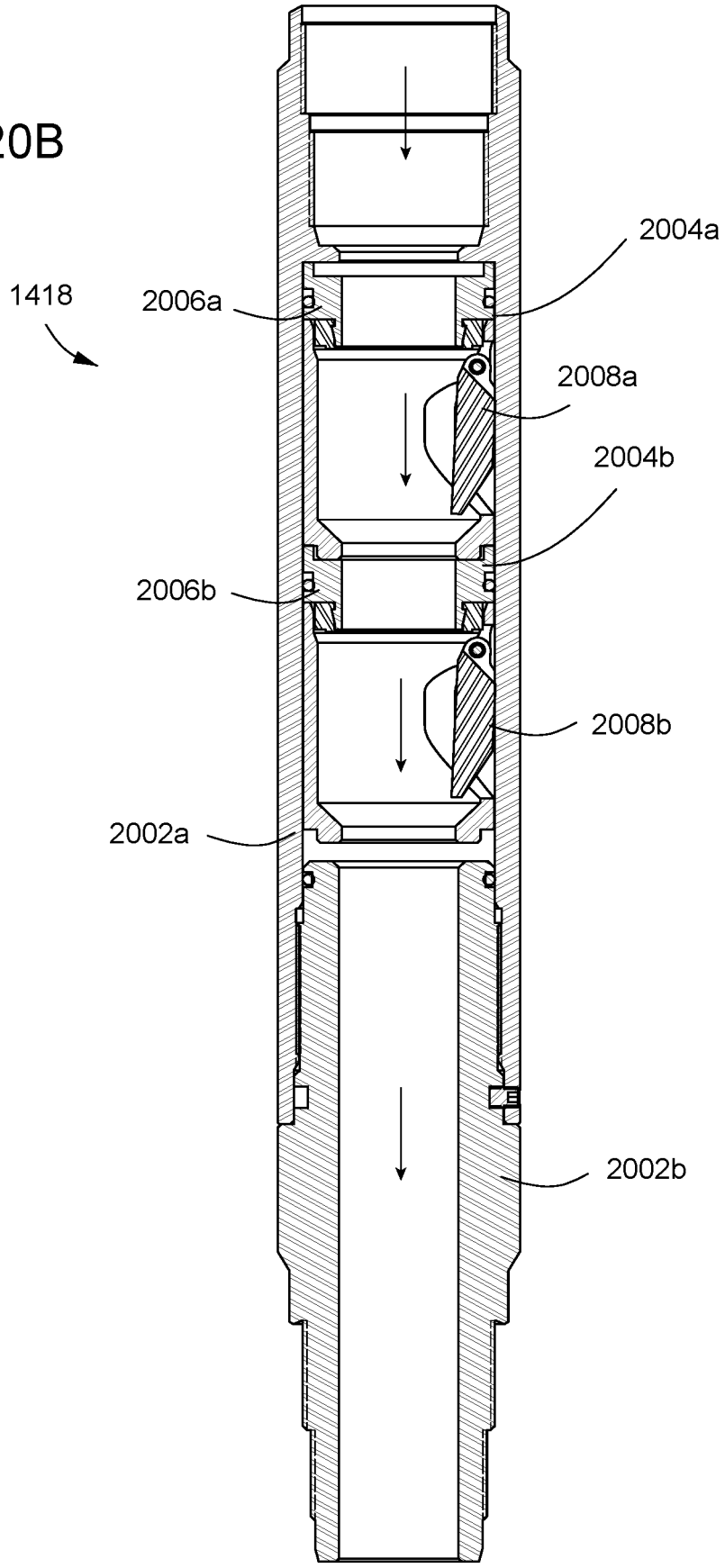
FIG. 20B illustrates a cross-sectional side view of a check valve assembly having flapper assemblies in an open position.

FIG. 20B illustrates a cross-sectional side view of a check valve assembly 118 having one or more flapper assemblies 2004*a*, 2004*b* in an open position. Fluid may be flowed into each check valve assembly 118 from above. At each check valve assembly 118, the fluid may cause a flapper 2008 in each flapper assembly 2004 to be bias downward into an open position. The fluid may then continue to be flowed down through the check valve assembly 118. Additionally, darts (not shown) may be carried in the fluid through the check valve assembly 118.

In alternate versions, a check valve assembly 118 may be coupled between a disconnect assembly 1408 and a motor (not shown). In some versions, a check valve assembly 118 may be coupled between a circulating valve assembly (not shown) and a motor (not shown). In other versions, a check valve assembly 118 may be coupled to an upper end of a disconnect assembly 1408 or a bypass valve 1410.

Referring to the views of FIGS. 14-20, an operator may perform the following steps to cut a downhole tubular string, e.g., casing, drill pipe, or liner hanger, that may include a landing seat 1402 coupled thereto. The landing seat 1402 may be coupled to a portion of the downhole tubular string at the surface and "tripped" and set at a certain location downhole prior to drilling. First, the operator may deploy a tubular cutting assembly 1404 down the downhole tubular string. The operator may place the tubular cutting assembly 1404 into an opening of the downhole tubular string at the surface. The operator may release the tubular cutting assembly 1404 without pumping any fluid. Gravity may cause the tubular cutting assembly 1404 to fall down the downhole tubular string. Preferably, the operator may pump the tubular cutting assembly 1404 along with fluid down the downhole tubular string at a pump down fluid flow rate. The pump down fluid flow rate may range from as low as 5, 10, 20, 30, 40 gallons per minute to as high as 45, 50, 55 gallons per minute or higher. The tubular cutting assembly 1404 may be pushed (via the fluid) down the downhole until it is landed on the landing seat 1402.

Teeth 1516*a* on a lock 1514 of the tubular cutting assembly 1404 may be coupled to teeth 1516*b* disposed in the landing seat 1402. Once the teeth 1516*a*, 1516*b* are coupled, the tubular cutting assembly 1404, in some cases, would be inhibited from being uncoupled from the landing seat 1402. Thus, back-pressure from below the tubular cutting assembly 1404, in some cases, may not cause the tubular cutting assembly 1404 to be pushed away from the landing seat 1402.

Male socket surfaces 1508 of a landing mandrel 1406 of the tubular cutting assembly 1404 may be aligned with female socket surfaces 1502 disposed on the landing seat 1402. If the male socket surfaces 1508 of the landing mandrel 1406 are rotated relative to the female socket surfaces 1502 disposed in the landing seat 1402, portions of the male socket surfaces 1508 would be abutted against portions of the female surfaces 1502. Accordingly, the tubular cutting assembly 1404 would be inhibited from rotating relative to the landing seat 1402. Thus, the tubular cutting assembly 1404 may be fixedly coupled to the landing seat 1402.

The fluid may be flowed through components of the tubular cutting assembly 1404, such as a landing mandrel 1406, a disconnect assembly 1408, a circulating valve assembly 1410, a motor 1412, a cutter assembly 1414, and a check valve assembly 118 (see arrows in FIGS. 15B, 16A, 17A, 18, 19B-C, and 20A-B). In the motor 1412, the fluid may be flowed across the surface of a rotor 1806. At the pump down fluid flow rate, pressure exerted against the surface of the rotor 1806 by the flowing fluid may cause the rotor 1806 to rotate relative to the stator 1804. The rotor 1806 may be coupled to a drive shaft assembly 1808. The drive shaft assembly 1808 may be coupled to the cutter assembly 1414. Therefore, the cutter assembly 1414 may be rotated correspondingly with the rotated rotor 1806.

Additionally, the fluid may be flowed against a piston 1904 of the cutter assembly 1414. The fluid may be flowed through an aperture 1920 disposed through the piston 1904. Pressure may be exerted on a piston head 1916 of the piston 1904 from the flow of the fluid under the pump down fluid flow rate. Pressure may be exerted on an insert 1928 disposed in the piston head 1916 from the flow of the fluid. However, at the pump down fluid flow rate, the pressure exerted on an upper surface of the piston head 1916 and insert 1928, in some cases, may not be greater than the pressure exerted by a coil against a lower surface of the piston head 1916. Therefore, in some cases, the fluid does not push the piston 1904 down. However, the fluid may be flowed through the piston 1904. The fluid may also be flow through windows 1924 disposed in the cutter assembly 1414. In some version where the piston is a solid piece, the fluid may be flowed through one or more relief fluid ports 1930 disposed through the housing 1902 of the cutter assembly 1414.

Consequently, the operator may detect an increase in pressure in the fluid because the flow of the fluid is partially inhibited by the pumped down cutting assembly 1404 coupled to the landing seat 1402. Next, the operator may pump additional fluid down the downhole tubular string at an actuation fluid flow rate that is greater than the pump down fluid flow rate. The actuation fluid flow rate may range from as low as 40, 50, 55, 60, 65 gallons per minute to as high as 70, 75, 80 gallons per minute or higher.

Pumped at the actuation fluid flow rate, the fluid may exert fluid pressure on the upper surface of the piston head 1916 and/or insert 1928 that is greater than pressure exerted by the coil 1906 on the lower surface of the piston head 1916. Correspondingly, downward fluid pressure against the piston head 1916 and/or insert 1928 may cause the piston head 1916 to compress the coil 1906. Furthermore, the piston 1904 may be slid down through the collar 1910. A stem 1918 of the piston 1904 may be abutted against portions of blades 1908*a*, 1908*b*. Cutting ends 1922 of the blades 1908*a*, 1908*b* may be pivoted outwardly and abutted against the downhole tubular string. The rotating cutter assembly 1414 may radially cut, e.g., shear, gouge, or scrape, the inner surface of downhole tubular string.

As the cutter assembly 1414 is cutting the downhole tubular string, the fluid may be flowed through the central aperture 1920 of the piston 1904. The fluid may also be flowed through the windows 1924 towards the blades 1908*a*, 1908*b* and the cut site on the downhole tubular string. The fluid may carry cuttings and/or debris away from the cut site.

In some versions, the fluid may be passed through the relief fluid port 1930. The passed fluid may be directed towards the blades 1908*a*, 1908*b* and the cut site on the downhole tubular string. The fluid may carry cuttings and/or debris away from the cut site.

Also, the operator may apply torque, e.g., rotation, to the downhole tubular string at the surface. In addition, the operator may lift the downhole tubular string at the surface. Lifting the downhole tubular string may stretch a portion of the downhole tubular string, particularly, the portion at or near the cut site. Applying additional distorting force, e.g., torque and/or tension, upon the downhole tubular string may cause it to part or break at or near the cut site.

After the downhole tubular string has been parted, the operator may perform additional downhole operations including cementation, disconnection of the downhole cutting assembly, and/or "fishing". Referring to the views of FIG. 17, the operator may deploy a dart 1708 down the downhole tubular string. The operator may deploy the dart in fluid pumped at an actuation fluid flow rate. The dart 1708 may be seated on a bypass sleeve 1704 of a circulating valve assembly 1410. Obstruction of fluid flow through the bypass sleeve 1704 by the dart 1708 may generate fluid pressure against the upper surfaces of the dart 1708 and the bypass sleeve 1704. The fluid pressure may cause pins 1706 to shear, e.g., snap and/or break. The bypass sleeve may now be slid down the housing 1702 of the circulating valve assembly 1410. Additionally, the bypass sleeve 1704 may be slid away from bypass fluid ports 1710. Thus, fluid may be flowed through the bypass fluid ports 1710 into the wellbore below.

In some cases, the operator may need to disconnect a portion of a tubular cutting assembly 1404 stuck downhole. Thus, the operator may deploy a dart 1601 down the downhole tubular string. The operator may deploy the dart in fluid pumped at an actuation fluid flow rate. The dart 1601 may be seated on a lock sleeve 1606 of a disconnect assembly 1408. Obstruction of fluid flow through the lock sleeve 1606 by the dart 1601 may generate fluid pressure against the upper surfaces of the dart 1601 and the lock sleeve 1606. The fluid pressure may cause pins 1610 to shear, e.g., snap and/or break. Once the pins 1610 are sheared, the lock sleeve 1606 may now be slid down an upper housing 1602 and a lower housing 1604 of the disconnect assembly 1408. A release groove 1616 disposed on an outer surface of the lock sleeve 1606 may be aligned with lugs 1618. Also, the lock sleeve 1606 may be slid away from bypass fluid ports 1608. Thus, the fluid may be flowed through the bypass fluid ports 1608 into the wellbore.

At this point, the upper housing 1602 and the lower housing 1604 may still be coupled. However, fluid pressure above the dart 1601 may have decreased because the fluid may be flowed through the bypass fluid ports 1608. The operator may detect the decrease in fluid pressure to indicate that the disconnect assembly 1408 is unlocked and can be uncoupled.

The operator may pull up on the drill string and cause the upper housing 1602 of the disconnect assembly 1408 to slide up relative to the lower housing 1604. A tapered end 1620 of each lug 1618 may be abutted against a surface defining a locking groove 1622. Pulling the upper housing 1602 upward may cause the surface defining the locking groove 1622 to push the lug out of the locking groove 1622. Simultaneously, portions of the lugs 1618 may be slid into the release groove 1616. The operator may continue pulling on the drill string to decouple the upper housing 1602 from the lower housing 1604.

What is claimed as the invention is:

1. A downhole landing assembly for an oil or gas well, comprising:

an upper seat cylinder capable of being coupled to an upper portion of a tubular string;

a lower seat cylinder capable of being coupled to a lower portion of the tubular string, wherein the lower seat cylinder is coupled to the upper seat cylinder;

a landing seat coupled to the lower seat cylinder, the landing seat having:

an upper seat end;

a lower seat end;

an inner bore extending between the upper seat end and the lower seat end;

a cylindrical wall surrounding the inner bore and including a spline that protrudes inwardly towards the inner bore and extends lengthwise, wherein the spline has two inner surfaces that share an intersection extending lengthwise; and a landing mandrel having:

an upper mandrel end;

a lower mandrel end; and two outer surfaces radially spaced from one another and extending lengthwise, wherein the landing mandrel is configured to be seated on the landing seat such that the two outer surfaces are disposed within the inner bore and the intersection of the two inner surfaces is disposed between the two outer surfaces and such that one of the two outer surfaces is abutted against one of the two inner surfaces of the spline to inhibit rotation of the two outer surfaces in a direction towards the two inner surfaces.

2. The downhole landing assembly of claim 1, wherein the two outer surfaces form an angle.

3. The downhole landing assembly of claim 1, wherein the two outer surfaces are tapered.

4. The downhole landing assembly of claim 1, wherein the two outer surfaces are capable of being aligned with the two inner surfaces of the landing seat.

5. The downhole landing assembly of claim 1, wherein the two inner surfaces of the landing seat are capable of inhibiting rotation of the landing mandrel.

6. The downhole landing assembly of claim 1, further comprising a lock disposed on the landing mandrel and capable of being coupled to the landing seat.

7. The downhole landing assembly of claim 1, further comprising a lock disposed on the landing seat and capable of being coupled to the landing mandrel.

8. A downhole landing assembly for an oil or gas well, comprising:

an upper seat cylinder capable of being coupled to an upper portion of a tubular string;

a lower seat cylinder capable of being coupled to a lower portion of the tubular string, wherein the lower seat cylinder is coupled to the upper seat cylinder;

a landing seat coupled to the lower seat cylinder, the landing seat having:

an inner bore; and a cylindrical wall surrounding the inner bore, the cylindrical wall including a spherical protrusion protruding towards the inner bore; and a landing mandrel for landing on the landing seat, the landing mandrel having:

an upper mandrel end;

a lower mandrel end; and two surfaces radially spaced thereon and defining a mandrel groove, wherein the landing mandrel is configured to be seated on the landing seat such that the two surfaces are disposed within the inner bore and the spherical protrusion is disposed between the two surfaces and such that the spherical protrusion is abutted against one of the two surfaces to inhibit rotation of the two surfaces in a direction towards the spherical protrusion.

9. The downhole landing assembly of claim 8, wherein the protrusion is a portion of a ball bearing extending through the landing seat.

10. The downhole landing assembly of claim 8, wherein the protrusion is capable of being abutted against a surface of the landing mandrel.

11. The downhole landing assembly of claim 8, wherein the landing mandrel is capable of being deployed down the tubular string to land on the landing seat after the landing seat has been deployed down the oil or gas well.

12. The downhole landing assembly of claim 8, wherein the landing mandrel has a tapered outer socket surface capable of being abutted against a tapered inner socket surface of the landing seat.

13. The downhole landing assembly of claim 8, wherein fluid in the tubular string is capable of ingress, egress, or both, through the upper seat cylinder, the lower seat cylinder, the landing seat, and the landing mandrel.

14. The downhole landing assembly of claim 8, wherein a portion of the lower seat cylinder is disposed between a portion of the upper seat and a portion of the landing seat.

15. A downhole landing assembly for an oil or gas well, comprising:

an upper seat cylinder capable of being coupled to an upper portion of a tubular string;

a lower seat cylinder capable of being coupled to a lower portion of the tubular string, wherein the lower seat cylinder is coupled to the upper seat cylinder;

a landing seat coupled to the lower seat cylinder, the landing seat having:

an upper seat end;

a lower seat end;

an inner bore extending between the upper seat end and the lower seat end; and a cylindrical wall surrounding the inner bore and including a spline that protrudes inwardly towards the inner bore and extends lengthwise, wherein the spline has two seat surfaces, wherein the two seat surfaces share an intersection extending lengthwise; and a landing mandrel for landing onto the landing seat;

a first protrusion protruding from the landing mandrel; and a second protrusion protruding from the landing mandrel and radially spaced from the first protrusion;

wherein the landing mandrel is configured to be seated on the landing seat such that first protrusion and the second protrusion are disposed within the inner bore and the intersection is disposed between the first protrusion and the second protrusion and such that either the first protrusion or the second protrusion is abutted against one of the two seat surfaces to inhibit rotation of the first protrusion and the second protrusion in a direction towards the two seat surfaces.

16. The downhole landing assembly of claim 15, wherein the first protrusion and the second protrusion are portions of ball bearings extending through the landing mandrel.

17. The downhole landing assembly of claim 8, wherein the protrusion is capable of being rolled along either surface of the two surfaces of the landing mandrel.

18. The downhole landing assembly of claim 15, wherein the first protrusion or the second protrusion is capable of being rolled along either surface of the two seat surfaces of the landing seat.

19. The downhole landing assembly of claim 5, wherein the intersection of the two inner surfaces of the landing seat extends towards the upper seat end and the lower seat end.

20. The downhole landing assembly of claim 5, wherein the spline has a shape of a chevron.

21. The downhole landing assembly of claim 15, wherein the intersection of the two inner surfaces of the landing seat extends towards the upper seat end and the lower seat end.

22. The downhole landing assembly of claim 15, wherein the spline has a shape of a chevron.

* * * * *